US007854573B2

(12) United States Patent
Knudson et al.

(10) Patent No.: US 7,854,573 B2
(45) **Date of Patent: *Dec. 21, 2010**

(54) LANDSCAPING PRODUCTS INCLUDING CONTINUOUS CHAMBER MASS CONFINEMENT CELLS AND METHODS OF USE THEREOF

(75) Inventors: Edward Alan Knudson, Annandale, MN (US); John Fitzgerald Dolan, Golden Valley, MN (US); Robert J Race, Eagan, MN (US); Lee Gordon Macklem, New Hope, MN (US); Vishal Nanasaheb Lokhande, Minneapolis, MN (US); Daniel Darst, Zimmerman, MN (US); Eric Jason Krause, Big Lake, MN (US)

(73) Assignee: New Technology Resources, Inc., Edina, MN (US)

( * ) Notice: Subject to any disclaimer, the term of this patent is extended or adjusted under 35 U.S.C. 154(b) by 178 days.

This patent is subject to a terminal disclaimer.

(21) Appl. No.: 11/463,820

(22) Filed: Aug. 10, 2006

(65) Prior Publication Data

US 2007/0003380 A1 Jan. 4, 2007

Related U.S. Application Data

(63) Continuation-in-part of application No. 11/126,546, filed on May 11, 2005, now Pat. No. 7,198,435.

(60) Provisional application No. 60/707,032, filed on Aug. 10, 2005, provisional application No. 60/741,737, filed on Dec. 2, 2005, provisional application No. 60/777,617, filed on Feb. 28, 2006.

(51) Int. Cl.
*E02D 29/02* (2006.01)

(52) U.S. Cl. ..... 405/284; 405/286; 405/262

(58) Field of Classification Search ..... 405/262, 405/284–286
See application file for complete search history.

(56) References Cited

U.S. PATENT DOCUMENTS 1,340,680 A 5/1920 Zimmerman
2,741,777 A 4/1956 Loye (Continued)

FOREIGN PATENT DOCUMENTS

CN 1119233 3/1996

(Continued)

*Primary Examiner*—Frederick L Lagman
(74) *Attorney, Agent, or Firm*—Fredrikson & Byron, P.A.

(57) ABSTRACT

The present invention relates to environment resistant landscaping products, such as retaining wall and earth retention products, edgers, paving stones and the like, that provide a natural earthen appearance, such as rock, stone, sand, soil, clay, wood, trees and foliage, water, or any other natural earthen appearance. The present invention also includes a mass confinement cell that may be used in retaining walls and earth retention systems that has a natural earthen appearance and is resistant to damage and wear caused by the environment. The mass confinement cells are generally light-weight and include a continuous chamber that at least partially aligns with confinement cells positioned above and below, thereby allowing the intermingling of fill material between adjacent cells. The mass confinement cells are capable of accepting and retaining any type of filling material. The filling material provides weight, stability and security to a retaining wall constructed of such mass confinement cells.

27 Claims, 45 Drawing Sheets

U.S. PATENT DOCUMENTS

| | | | | |
|---|---|---|---|---|
| 4,048,682 | A | 9/1977 | Smith | |
| D255,787 | S | 7/1980 | Morehead, Jr. | |
| 4,552,484 | A | 11/1985 | Nuttle | |
| 4,778,309 | A | 10/1988 | Bach et al. | |
| 5,044,834 | A | 9/1991 | Janopaul, Jr. | |
| RE34,314 | E | 7/1993 | Forsberg | |
| 5,230,195 | A | 7/1993 | Sease | |
| 5,294,216 | A | 3/1994 | Sievert | |
| 5,449,543 | A | 9/1995 | Bach | |
| 5,471,808 | A | 12/1995 | De Pieri et al. | |
| 5,501,040 | A | 3/1996 | White-Wexler et al. | |
| 5,586,408 | A | 12/1996 | Bergevin | |
| 5,615,529 | A | 4/1997 | Johnson et al. | |
| 5,658,098 | A | 8/1997 | Woolbright | |
| 5,688,079 | A | 11/1997 | Bolduc et al. | |
| 5,771,650 | A | 6/1998 | Williams et al. | |
| 5,832,687 | A | 11/1998 | Willemsen | |
| 5,927,506 | A | 7/1999 | Young et al. | |
| 5,927,906 | A | 7/1999 | Bach et al. | |
| 6,024,626 | A | 2/2000 | Mendelsohn | |
| 6,062,772 | A | 5/2000 | Perkins | |
| D429,004 | S | 8/2000 | Strand et al. | |
| 6,231,272 | B1 * | 5/2001 | Bishop | 405/286 |
| 6,287,054 | B1 * | 9/2001 | Egan et al. | 405/262 |
| 6,296,924 | B1 | 10/2001 | Bach | |
| 6,336,291 | B1 | 1/2002 | Skuba | |
| 6,394,705 | B1 * | 5/2002 | Lefebvre | 405/284 |
| 6,527,483 | B1 | 3/2003 | Agee | |
| 6,571,529 | B2 | 6/2003 | Knudson et al. | |
| 6,623,213 | B1 | 9/2003 | Maydew | |
| 6,663,323 | B1 | 12/2003 | Boys | |
| 6,817,154 | B2 | 11/2004 | Dolan et al. | |
| 6,918,503 | B1 | 7/2005 | Molander | |
| 7,000,347 | B2 | 2/2006 | Roskin | |
| 7,198,435 | B2 * | 4/2007 | Dolan et al. | 405/284 |
| 2004/0222222 | A1 | 11/2004 | Parnall et al. | |
| 2005/0102950 | A1 | 5/2005 | Knudson et al. | |

FOREIGN PATENT DOCUMENTS

| | | |
|---|---|---|
| CN | 1381654 | 6/1996 |
| CN | 1220334 | 11/2002 |
| EP | 0708208 | 4/1996 |
| FR | 2641296 | 7/1990 |
| JP | 2003313974 | 11/2003 |

* cited by examiner

DETAIL B

DETAIL A

LANDSCAPING PRODUCTS INCLUDING CONTINUOUS CHAMBER MASS CONFINEMENT CELLS AND METHODS OF USE THEREOF

CROSS-REFERENCE TO RELATED APPLICATION

This application is a continuation in part application of U.S. application Ser. No. 11/126,546 filed on May 11, 2005, now issued U.S. Pat. No. 7,198,435 and claims priority to U.S. Provisional Application Ser. No. 60/707,032, filed on Aug. 10, 2005, U.S. Provisional Application No. 60/741,737 filed on Dec. 2, 2005, U.S. Provisional Application No. 60/777,617 filed on Feb. 28, 2006, and U.S. application Ser. No. 11/463,816 filed on Aug. 10, 2006. The contents of the five previously mentioned applications are incorporated by reference herein.

FIELD OF THE INVENTION

The present invention relates to environment resistant landscaping products, such as retaining wall and earth retention products, edgers, paving stones and the like, that provide a natural earthen appearance, such as rock, stone, sand, soil, clay, wood, trees and foliage and water, or any desired design and/or appearance. The present invention also includes a mass confinement cell that may be used in retaining walls and earth retention systems that has a natural earthen appearance or other aesthetic design and is resistant to damage and wear caused by the environment. The mass confinement cells are generally light-weight and include a continuous chamber that at least partially aligns with confinement cells positioned above and below, thereby allowing the intermingling of fill material between adjacent cells. The mass confinement cells are capable of accepting and retaining any type of filling material that generally provides weight, stability and security to a retaining wall constructed of such mass confinement cells.

BACKGROUND OF THE INVENTION

The use of retaining walls to protect and beatify property in all types of environmental settings is a common practice in the landscaping, construction and environmental protection fields. Walls constructed from various materials are used to outline sections of property for particular uses, such as gardens or flower beds, fencing in property lines, reduction of erosion, stabilizing construction sites in potentially unstable and/or rough terrain and to simply beautify areas of a property.

Numerous methods and materials exist for the construction of retaining walls. Such methods include the use of natural stone, poured in place concrete, masonry, landscape timbers or railroad ties. In recent years, segmental concrete retaining wall units, sometimes known as dry-cast block, which are dry stacked (i.e., built without the use of mortar), have become a widely accepted product for the construction of retaining walls. Examples of such units are described in U.S. Pat. No. RE 34,314 (Forsberg) and in U.S. Pat. No. 5,294,216 (Sievert).

However, many of the materials utilized in the construction of retaining walls are susceptible to deterioration, heavy, cumbersome and/or not very aesthetically appealing. The ability of these retaining walls to withstand sunlight, wind, water, general erosion and other environmental elements is a problem with most retaining wall products.

One particular concern is the utilization of erosion protection materials in water shorelines. Leaving the shoreline natural can lead to erosion, cause an unmanageable and unusable shoreline, create high maintenance, and potentially destroy an aesthetically pleasing property. Many materials utilized in retention of shorelines are subject to immediate deterioration and/or are not as aesthetically appealing as one would desire. Furthermore, many materials utilized on shoreline structures are difficult to maintain due to the awkward location in the water and also the prevalent growth and presence of organic materials that can get caught and flourish in such a structure. For example, many lakeshore or ocean side properties utilize riprap as a retention device for prevention of erosion. Riprap is a configuration of very heavy, large to medium size stones placed along the shoreline. One problem with waterfront properties that use a continuous wall of typical riprap is the shoreline will retain some organic material, will accumulate additional organic material brought in by the water and/or will allow vegetation to grow within the openings between stones. This usually leads to an unmanageable and aesthetically displeasing shoreline or higher maintenance. Furthermore, the riprap is never uniform in color and size and therefore does not provide the most aesthetically pleasing shoreline or complete coverage of the shoreline. The lack of uniform shoreline coverage allows for some erosion, collection of unwanted materials and the potential growth of undesirable vegetation.

Another problem with materials normally utilized in the construction of retaining walls, such as poured in place concrete, masonry, landscape timbers, railroad ties or dry-cast blocks (e.g. blocks produced by Keystone® Inc. or Anchor® Retaining Wall Systems, Inc.) is that regulations in most states and counties prohibit their use in or near bodies of water because of the potential chemical diffusion into the body of water and/or the crumbling or deterioration of the material into the body of water over time. Many of these retaining wall materials diffuse chemicals, dissolve, crumble, break apart and/or float into the body of water of which they are lining, thereby causing problems with the shoreline and pollution of the water. For example, the average life of various types of dry-cast block in water environments is approximately a couple of years. A need exists for a retaining wall, which would be resistant to such deterioration.

An additional concern that exists in the construction of retaining walls is the weight of the materials. Concrete blocks (e.g. wet or dry cast), large or medium size stones or timbers can be heavy and cumbersome to move into the wall location and maneuver when constructing retaining walls and earth retention systems. Many locations for which retaining walls are constructed are positioned in awkward terrain. Therefore, heavy building materials are difficult to move into such locations and furthermore are difficult to position when constructing the retaining wall, thereby adding additional cost and labor for installation. However, the heavy materials can be beneficial once the wall is constructed to provide stability and security to the structure. Therefore, what is needed are easy to install light-weight units used for the construction of retaining walls and earth retention systems, which can be weighted once placed into position thus retaining the units in position and stabilizing the completed retaining wall.

SUMMARY OF THE INVENTION

Embodiments of the present invention relate to retaining wall products including mass confinement cells that are resistant to damage and wear caused by the environment. The mass confinement cells generally include a front panel adjoined to a back panel by one or more side panels to thereby form a continuous chamber. The continuous chamber of the mass confinement cell allows the flow of fill material to adjacent mass confinement cells below and above. The deterioration resistant mass confinement cell is generally a hollowed frame or shell of a deterioration resistant material that is light-weight and is configured to interlock with adjacent confinement cells, thereby forming a continuous chamber system capable of accepting and retaining any type of filling material. The filling material provides weight, density, structure and stability to the retaining wall cells and also ultimately provides stability and security to the retaining wall constructed of such cells.

As previously mentioned, various embodiments of the deterioration resistant mass confinement cells of the present invention comprise a front panel, back panel and one or more side panels, which adjoin the front panel and back panel thereby forming a confinement cell having a continuous flow chamber. In various embodiments at least two of the side panels extend from the front panel to the back panel at angles (e.g. less than 90°), thereby allowing for a back panel that is of shorter length than the front panel. The shorter back panel allows the product to produce curves in retaining walls or revetments. Additionally, the continuous flow chamber of these mass confinement cells generally forms a series of integrated channels when placed in a wall or earth retention structure, thereby allowing the flow of fill material between adjacent confinement cells.

The cells of the present invention may further include one or more anchoring devices for securing each cell to adjacent cells or securing them into position in the retaining wall. In various embodiments of the present invention one or more of the panels include one or more peg extensions or locking extensions for interconnecting the stacked confinement cells. The peg extensions or locking extensions assist in positioning and/or adjoining adjacent cells and facilitating the flow of fill material to the adjacent cells. Additionally, the peg extensions or locking extensions assist in retaining the fill material within the adjoined confinement cells and also may lock the adjacent cells to each other. As previously suggested, the continuous chambers are adapted for receiving and retaining fill materials, such as sand, dirt, gravel, pea rock, class V, concrete or any other similar material, which provides the permanent weighting and stability of each retaining wall cell.

In additional embodiments of the present invention, the cells may comprise two or more separated panels that are adjoined by a securing mechanism, such as a "T-hook and T-slot", or a "peg and socket system". For example, the front panel, side panels and/or back panel may be separate panels that are secured together to form the confinement cells of the present invention. These embodiments provide the benefits of providing two or more substantially flat panels and/or nestable panels that may be assembled to form each cell. Also, such a process may open other beneficial manufacturing techniques to form such panels, such as extrusion, thermoforming and vacuum forming. Such embodiments will also generally provide benefits related to transportation and storage in that the various components nest and/or may be transported in relatively flat panels.

Embodiments of the deterioration resistant mass confinement cells of the present invention may be used in constructing retaining walls and earth retention systems on a number of property terrains, such as along waterfront properties or along gradual or steep embankments. The deterioration resistant confinement cells are particularly useful for terrains near water or underwater due to their resistance to degradation. However, the deterioration resistant cells could also be used for land applications for those that want a light-weight retaining wall product that can be filled on-site to add weight and stability and also does not require heavy equipment for moving and installing. Therefore, the deterioration resistant mass confinement cells could be utilized to construct any form of wall, earth retention system or fence structure.

One unique feature of the present invention is the light-weight characteristic of each confinement cell before it is filled and the stable and weighted characteristic after it is filled. As previously mentioned, embodiments of the present invention may be filled with any type of fill material located at the site, such as rocks (e.g. crushed rock and pea rock), sand, gravel, soil, concrete or similar materials. The filling characteristic of the deterioration resistant confinement cells means that when the cells are not filled they are very light-weight. This light-weight feature provides individuals constructing such walls the advantage of easily moving large numbers of the confinement cells to the site of construction with relative ease. Furthermore, the lightweight characteristic of such cells allows for easy maneuvering of the cells into final position when constructing a retaining wall or revetment, but still allows for the stability as found in heavy concrete products when these same confinement cells are filled. These characteristics are met by each mass confinement cell being made of a lightweight material, such as plastic (e.g. high density polyethylene), and by it also being configured to receive a heavy fill material once it has been placed in its final position on the retaining wall.

Individuals would be more inclined to install products made of a deterioration resistant material, rather than cement block, timbers, dry cement process (or dry-cast) block (e.g. Keystone® or Anchor® block) and the like, because of their installation ease attributed to the light-weight properties and enhanced longevity. The weight of most regular retaining wall block is approximately 12-120 lbs, whereas embodiments of the present invention are approximately 2-20 lbs. Of course, weight may vary depending on the size and materials utilized in manufacturing embodiments of the present invention.

Embodiments of the present invention are also superior to other retaining wall products due to the precise nature of the materials and manufacturing processes. Such processes generally exhibit minimal to no difference in unit dimensions and feature characteristics, thereby allowing for precision in product specifications and building structures with such units. Examples of possible manufacturing methods include but are not limited to injection-molding, structural foam molding (e.g. low pressure multi-nozzle structural foam), extrusion, roto-molding, thermoforming, vacuum forming and blow-molding. However, it is noted that any high volume application for production may be utilized in manufacturing the present invention.

The individual units of the present invention are light-weight, aesthetically pleasing, easy to install, prevent shoreline and other terrain erosion and compliment preexisting retaining wall products. Various embodiments of mass confinement cells of the present invention are also waterproof and/or absorption resistant, can withstand ice damage due to their flexible nature and are easily replaced or repaired in case of damage. Furthermore, the confinement cells of the present invention are rugged and require very low maintenance. Additionally, embodiments of the present invention are easily transportable, storable and installable due to their light-weight and possible stacking and/or nesting features.

As previously suggested, embodiments of the present invention are also resistant to deterioration, such as wear, discoloration, crumbling and breaking. Therefore, the deterioration resistant mass confinement cells do not have to be replaced as often and/or increase the lifespan of the retaining wall or earth retention system. Due to these characteristics, the cells of the present invention generally have a much greater lifespan than the life of a regular dry-cast concrete type block or timber. The increased lifespan of the confinement cells translates to fewer or no occurrences of replacement of individual cells or the potential complete reconstruction of the entire wall. Furthermore, retaining wall materials, such as concrete block formed by the dry cast process, (e.g. Keystone® blocks) and timbers are typically not used in water applications because they dissolve, crumble and/or break down over time and exposure. The durability and deterioration resistant characteristics of the present invention reduce and prevent the structural degradation of the product, thereby making it very beneficial for all applications that come in contact with water.

Another advantage of embodiments of the present invention relates to the high cost of waterfront property and people's inclination to improve their property to keep it well-maintained and aesthetically pleasing. As previously mentioned riprap, is commonly stacked along property shorelines to prevent erosion. The trouble with this shoreline preservation application is that rip rap is generally heavy, thereby making it difficult to install. Furthermore, rip rap will generally leave many crevices for organic material to reside and, since it is close to water, the crevices are prominent areas for the growth of vegetation. In addition, many waterfront properties suffer water damage when water levels rise above the shoreline. The mass confinement cells of the present invention are a solution to water retention and erosion problems in such areas of threatening high or rising water levels. Furthermore, the mass confinement cells pose a solution in locations where there is a flood plane or areas that are washed out by any type of water movement. Sandbags have been a solution to such problems, but are not a permanent or aesthetically pleasing solution. The retaining wall cells can replace sand bags in an area for which a more permanent and aesthetically pleasing alternative is desired.

As previously suggested, the deterioration resistant mass confinement cells can be produced in any type of shape, configuration, color and design. In addition each confinement cell may include any design or color located anywhere on one or more panels or walls of the confinement cell.

In summary, the utilization of conventional type materials for retaining walls, such as concrete blocks (wet or dry cast), timbers, rip rap and other wall or revetment construction materials, have caused problems related to their inherent weight, deterioration tendencies and aesthetic deficiencies. Therefore, the present invention provides an aesthetically pleasing, durable and easy to use product for all persons intending to construct a retaining wall or earth retention system.

BRIEF DESCRIPTION OF THE DRAWINGS

FIG. 4 is a back perspective view of an embodiment of a deterioration resistant mass confinement cell including a peg and socket securing mechanism and integral back and side panels.

FIG. 18*b* is a back view of one embodiment of a fascia that may be utilized with the deterioration resistant cells of the present invention.

FIG. 26 is a perspective view of one embodiment of a front panel including a partial top panel and a plurality of securing mechanisms.

FIG. 27 is a back perspective view of an embodiment of a load cell that may be used with a deterioration resistant mass confinement cell of the present invention.

DETAILED DESCRIPTION OF THE INVENTION

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

Figure 1A:
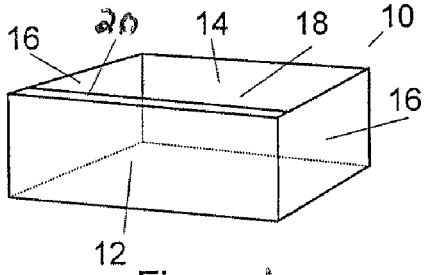
FIG. 1*a* is a front perspective view of one embodiment of a deterioration resistant mass confinement cell.
Figure 1B:
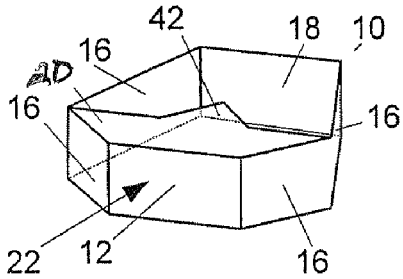
FIG. 1*b* is a front perspective view of an embodiment of a deterioration mass confinement cell with a beveled front panel.

Various embodiments of the deterioration resistant mass confinement cell 10 generally comprise a front panel 12, a back panel 14 and one or more side panels 16 as depicted in FIGS. 1*a* and 1*b*. The side panels 16 of these embodiment operably join the front panel 12 and back panel 14 to form the confinement cell 10 having a continuous flow chamber 18. The continuous flow chamber 18 is positioned within the front panel 12, back panel 14 and side panels 16.

It is noted that various embodiments of the mass confinement cell 10 of the present invention include no top panel or a partial top panel and no bottom panel or a partial bottom panel. The assembly of a retaining wall with a plurality of such confinement cells, which include an open top and bottom, allows for the flow and/or commingling of fill material from adjacent cells positioned above and/or below through each cell's continuous flow chamber 18. In other embodiments, the bottom panel may include one or more apertures to allow for at least a partial alignment of openings, thereby allowing the flow and commingling of fill material from one confinement cell to cells positioned above and/or below.

Figure 2A:
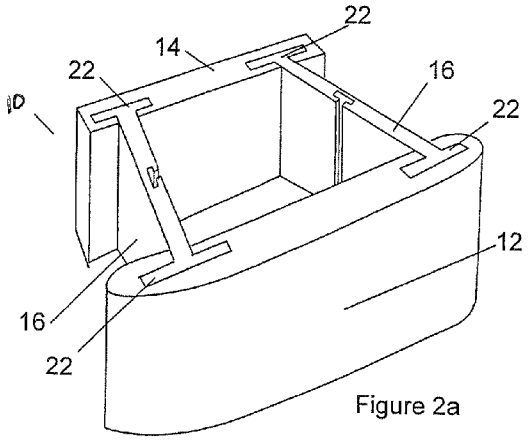
FIG. 2*a* is a front perspective view of an embodiment of a mass confinement cell having a T-slot securing mechanism.
Figure 2B:
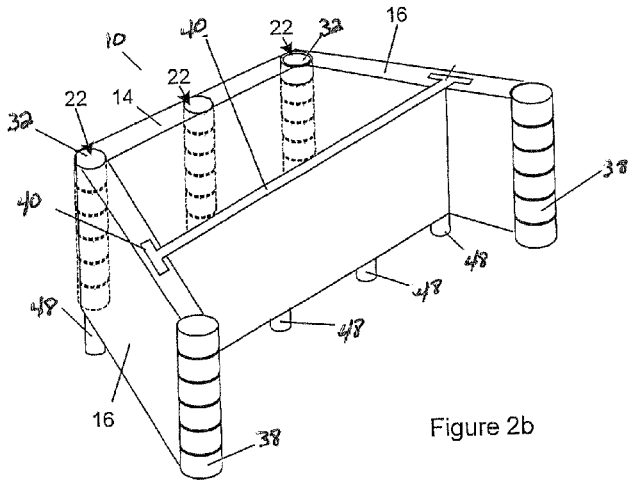
FIG. 2*b* is a front perspective view of an embodiment of a partial mass confinement cell having a peg and socket securing mechanism and an inner partition.
Figure 2C:
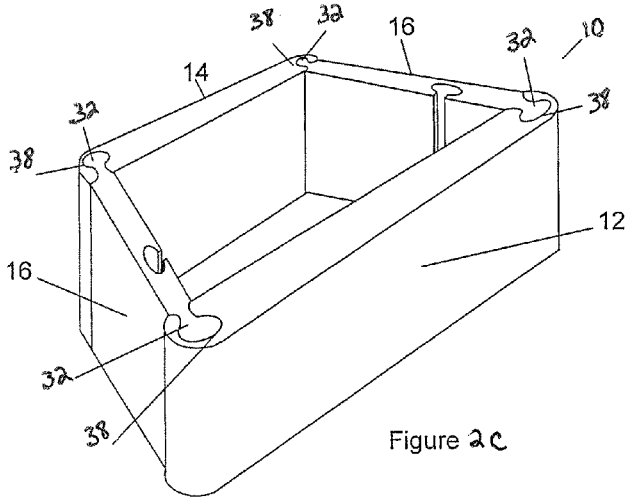
FIG. 2*c* is a front perspective view of an embodiment of a mass confinement cell having an integral peg and socket securing mechanism.

Additionally, the mass confinement cell 10 of various embodiments of the present invention may include two or more separated panels 12, 14, 16 or sections that are operably connected with one or more securing mechanisms 22 to join the two or more panels 12, 14, 16 or two or more sections (e.g. sections may be two or more panels that are integrally adjoined without securing mechanisms), thereby forming the confinement cell 10. FIGS. 2*a-c* depict three embodiments of the present invention that include panels 12, 14, 16 that are adjoined with securing mechanisms 22. In other embodiments, the mass confinement cells 10 utilize securing mechanisms 22 to join three or more panels 12, 14, 16 or sections to form the mass confinement cell 10. Also, in still other embodiments, the mass confinement cells 10 of the present invention utilize securing mechanisms 22 to join four or more separated panels 12, 14, 16 or sections to form the confinement cell 10. In many of these embodiments, the one or more side panels 16 are operably joined to the front panel 12 and/or back panel 14 with two or more securing mechanisms 22 to form a continuous flow chamber 18 within the mass confinement cell 10.

It will be found that various mass confinement cell embodiments of the present invention are especially advantageous for mega-cell products of sizes equal to or greater than one foot in height, two feet wide and one foot deep (e.g. at least about 1.5 feet in height, 3 feet wide and 1.5 feet deep). Such large confinement cells allow for easy storage and transportation of such mega-cells by allowing them to flatten or nest, thereby decreasing the space needed for large numbers of cells.

In various embodiments of the present invention, the front panel 12 of the cell may be flat, rounded or beveled and are generally molded or fabricated (e.g. lamination, painting, U.V. Coating) to provide the desired earthen appearance. FIG. 1*a* depicts an embodiment of a cell 10 with a flat front panel 12. FIG. 1*b* depicts an embodiment of a cell 10 with a beveled front panel 12. FIG. 2*a* depicts an embodiment of a cell 10 with a rounded front panel 12. However, it is noted that in other embodiments a fascia may be secured to the front panel 12 to provide the desired appearance. In various embodiments of the present invention, the front panel or fascia may also be beveled, rounded, substantially flat or include positions of relief to provide a more natural earthen appearance, such as stone or wood.

Figure 3:
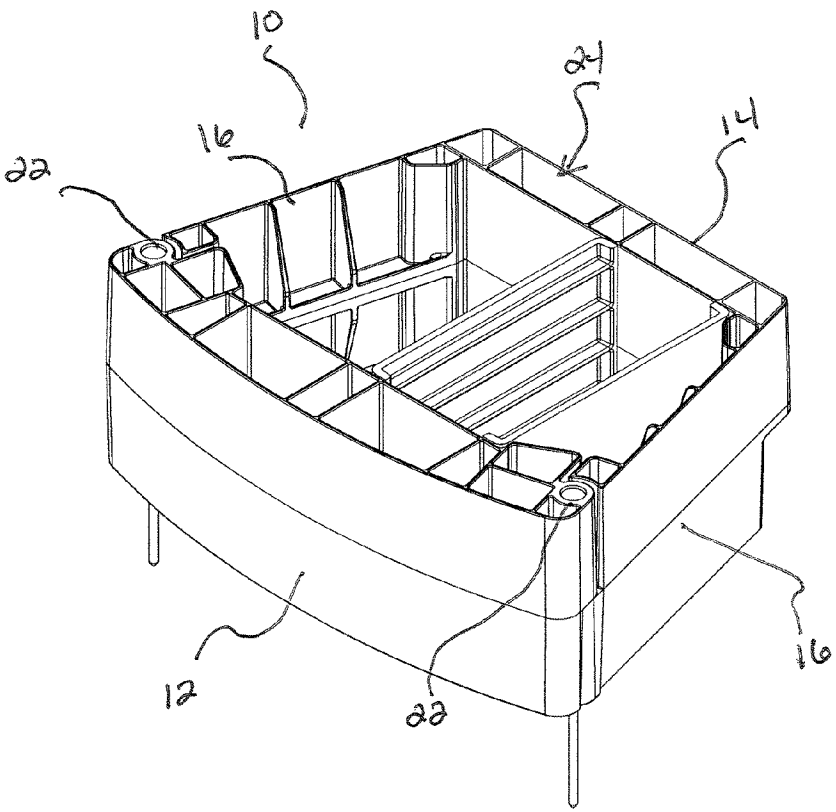
FIG. 3 is a front perspective view of an embodiment of a deterioration mass confinement cell including a peg and socket securing mechanism and integral back and side panels.

FIGS. 3 and 4 depict another embodiment of the mass confinement cell 10 of the present invention wherein the cell 10 includes side panels 16 and a back panel 14 that are formed or manufactured in a single part or section 24, thereby foregoing the need for one or more of the securing mechanisms 22 to secure the side panels 16 with the back panel 14. It is noted that a section may be a combination of two or more panels, such as a back panel secured to one or more side panels or a front panel secured to one or more side panels. Such an embodiment has benefits in providing for additional stability of the confinement cell structure and the ability to manufacture the entire confinement cell 10 with a limited number of parts (e.g. two part system; a side/back section and a front panel or a side/front section and a back panel). Such embodiments allow for the back and side panels 14, 16 to be formed in a single part by processes that have manufacturing benefits, such as injection molding, structural foam molding (e.g. low pressure multi-nozzle structural foam), extrusion or thermoforming. Once the single back/side or front/side section 24 is provided, it may be adjoined to a molded and/or fabricated front panel 12 or a back panel 16 by securing the pieces together with one or more securing mechanisms 22.

Figure 1:
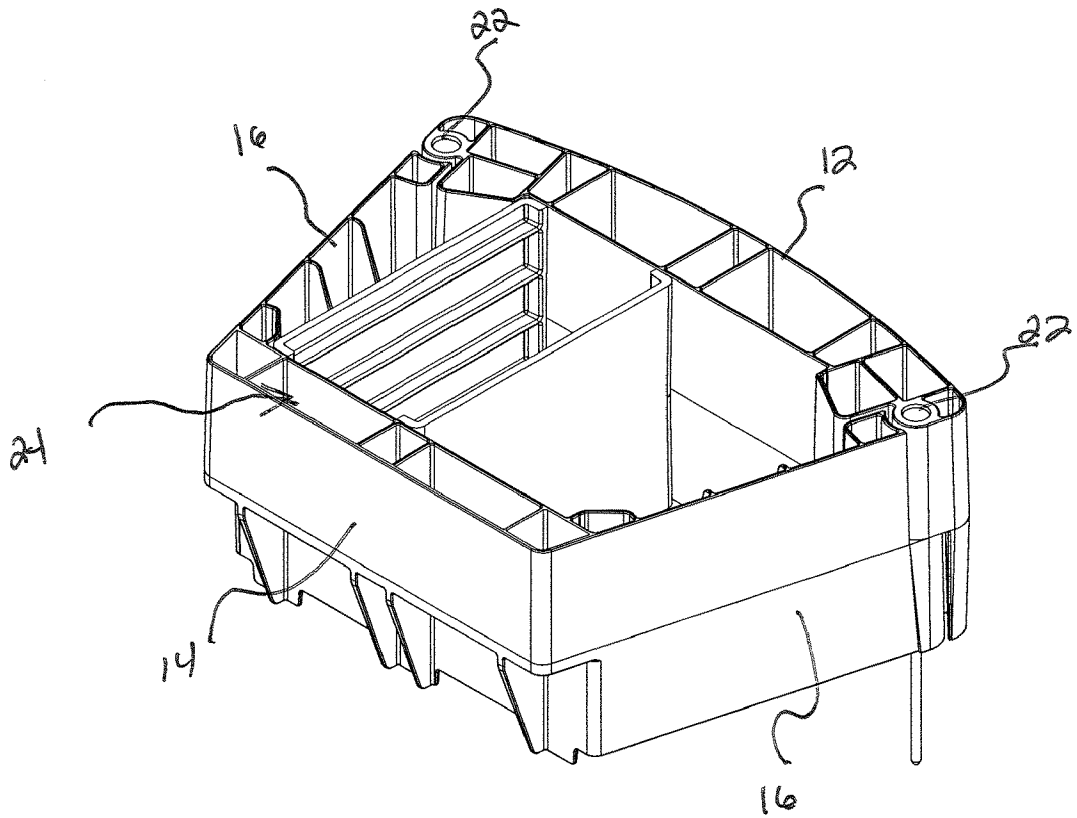
Figure 5:
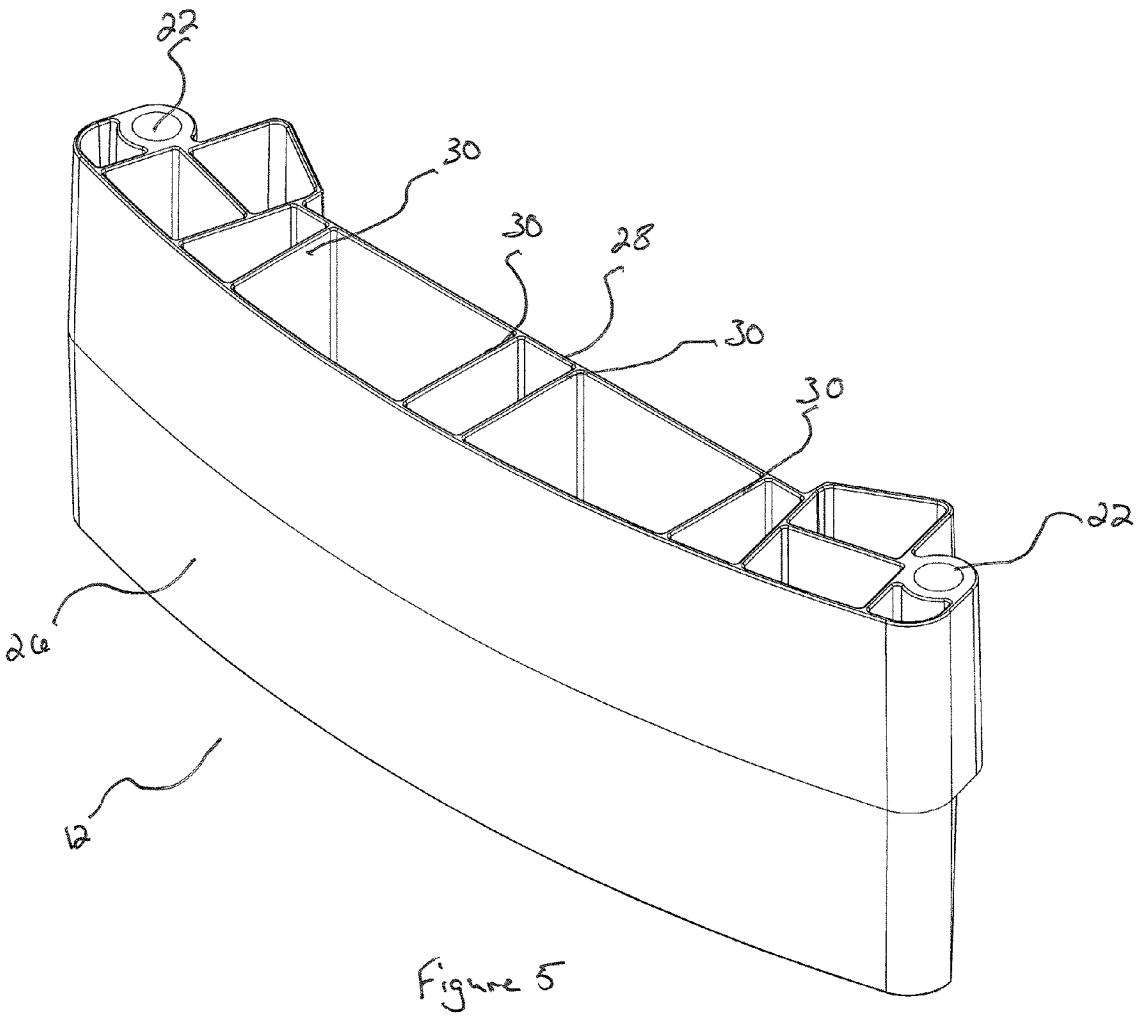
FIG. 5 is a front perspective view of an embodiment of a front panel of a deterioration resistant mass confinement cell.

In various embodiment of the present invention, the front panel 12 of the cell 10 may be flat, rounded or beveled. For example, FIG. 5 depicts a front panel 12 of the cell 10 depicted in FIGS. 1 and 2. The front panel 12 of this embodiment includes a rounded front panel 12, but may include a flat or a beveled front having one or more bends and/or slants. It is noted that the front panel 12 may also include positions of relief or creases and clefts to provide a more natural appearance.

The front panel of this embodiment further includes a front plate 26 and a back plate 28 that are separated by one or more ribs 30 to adjoin and provide support and stability to the front plate 26 and back plate 28. Alternatively, a corrugated or waved ribbing system (not shown) may separate the front plate 26 and back plate 28 rather than straight ribs to provide a pressure absorption means, thereby removing the pressure produced by the fill material on the front panel 12. The front panel 12 of this embodiment further includes at least part of one or more securing mechanisms 22. As will be explained further below, the front plate 26 and/or front panel 12 generally will display an earthen appearance or other aesthetic design that may be molded into the surface or applied to the surface.

Figure 6A:
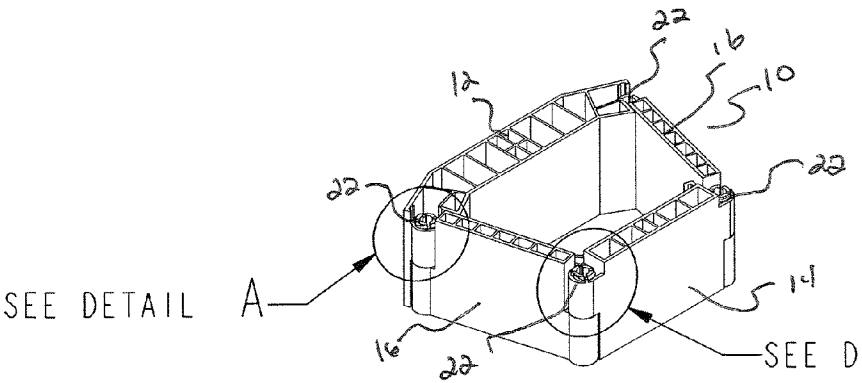
FIG. 6*a* is a perspective view of an embodiment of a deterioration resistant mass confinement cell including a peg and socket securing mechanism.
Figure 6C:
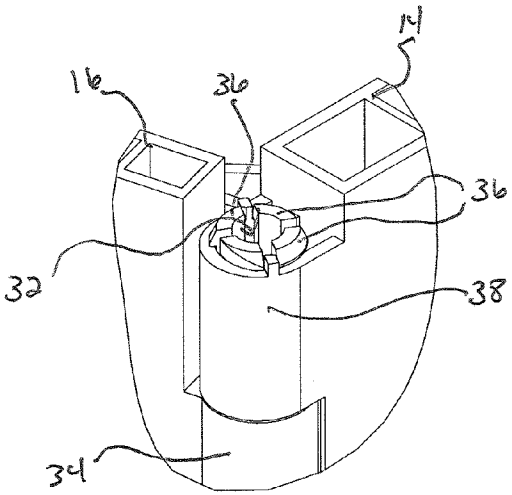
FIG. 6*c* is a perspective view of the Detail B peg and socket securing mechanism of FIG. 9*a*.
Figure 6B:
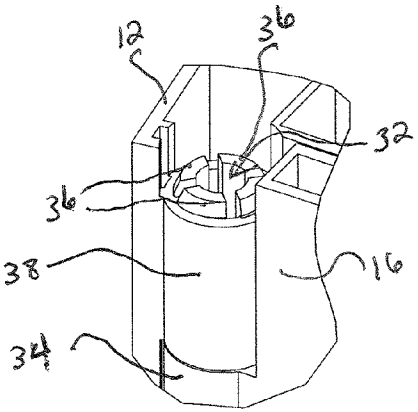
FIG. 6*b* is a perspective view of the Detail A peg and socket securing mechanism of FIG. 9*a*.

As previously mentioned, various embodiments of the mass confinement cell 10 generally include one or more securing mechanisms 22 that provide a sufficient means for securing the separated panels 12, 14, 16 to each other. A sufficient means is generally one wherein the securing mechanisms 22 will not release when the force of the fill material is applied to the panels 12, 14, 16 of the mass confinement cell 10. FIGS. 6*a*-6*c* depict one embodiment of a securing mechanism 22 that may be utilized to form one embodiment of a mass confinement cell 10 of the present invention. FIG. 6*a* depicts one embodiment of a mass confinement cell 10, wherein the confinement cell 10 includes a front panel 12 and back panel 14 adjoined to two side panels 16 with securing mechanisms 22. FIGS. 6*b* and 6*c* depict one embodiment of a securing mechanism 22 utilized to adjoin the panels 12, 14, 16 of the confinement cell 10 of the present invention. In this embodiment, the securing mechanism 22 includes a peg and socket system including a peg 32 having a base 34 and two or more elongated keys 36 extending upward from the base 34. In some embodiments, the keys 36 may include a beveled top that allows for the keys 36 to be inserted into a socket 38 and lock the panels 12, 14, 16 into place when completely inserted.

Other embodiments of securing mechanisms that may be utilized in the present invention include the peg and socket systems (threaded, integrated and non-integrated) (See FIGS. 2*b-c*), T-hook and T-slot (See FIG. 2*a*), locking snaps and other mechanisms that would adjoin and secure the panels into the confinement cell configuration. Examples of some securing mechanisms are disclosed or suggested in U.S. application Ser. No. 11/126,546 filed on May 11, 2005, U.S. Provisional Application 60/707,032, filed on Aug. 10, 2005, U.S. Provisional Application No. 60/741,737 filed on Dec. 2, 2005 and U.S. Provisional Application No. 60/777,617 filed on Feb. 28, 2006, the contents of which are incorporated by reference herein.

The various mass confinement cell embodiments may further include one or more interior partitions 40. The interior partitions 40 may also be utilized to add additional support to the confinement cell 10 to prevent any possible crushing or expansion of the cell 1O. FIGS. 3 and 4 depict one confinement cell embodiment wherein the interior partitions 40 are within the interior of the cell 10 and are present to define separate chambers that can accommodate filling of each individual chamber 18 with appropriate fill material, such as sand, gravel, crushed rock, pea rock, soil, cement, concrete or any other suitable material. The interior partitions 40 may be secured to the front panel 12, back panel 14 or to the two side panels 16 utilizing one or more securing mechanisms (e.g. peg and socket systems, T-hook and T-slot systems, panel slot systems, snap systems or any other securing means). Alternatively, the interior partitions 40 may be secured to the opposing panels utilizing other adjoining means, such as screws, rivets, hooks, adhesives or any other materials to adequately adjoin the opposing panels.

Figure 7A:
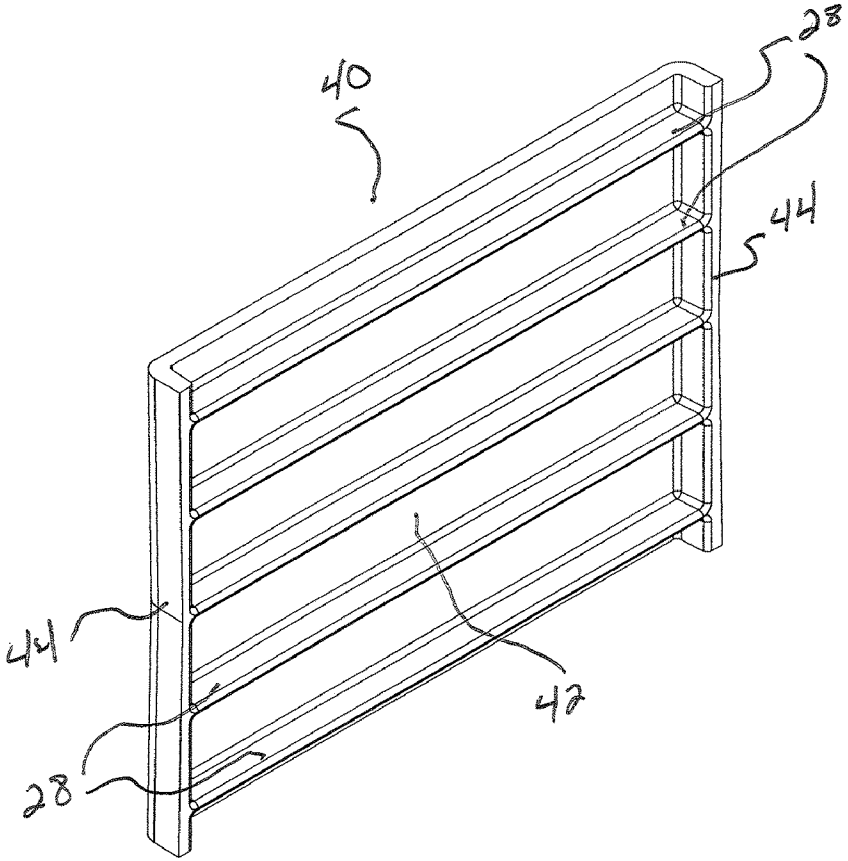
FIG. 7*a* is a back perspective view of one embodiment of a stabilizing partition.
Figure 7D:
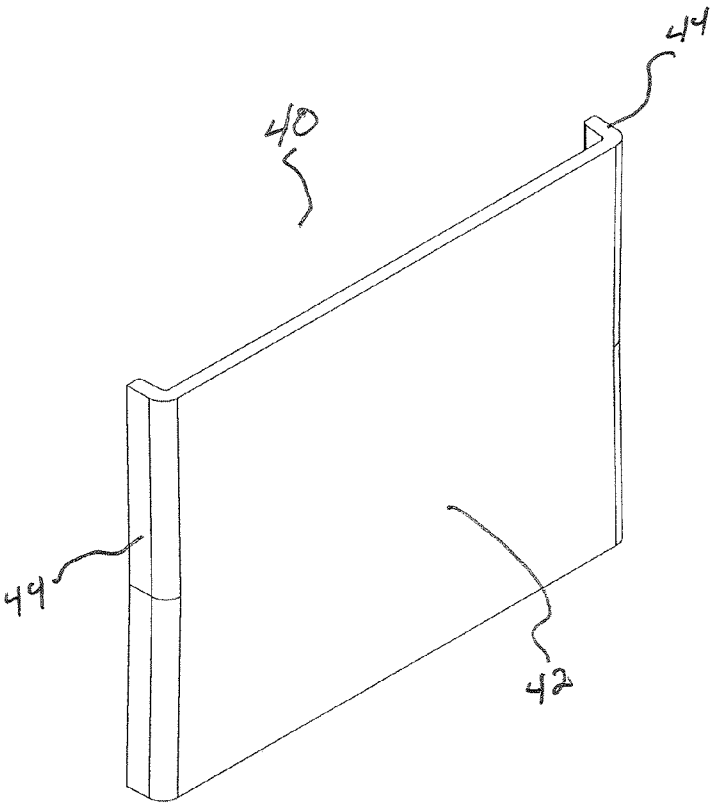
FIG. 7*b* is a front perspective view of one embodiment of a stabilizing partition.

FIGS. 7*a* and 7*b* depict interior and exterior views of one embodiment of an interior partition 40. The interior partition 40 of this embodiment generally includes a sheet 42 having panel attachments 44 at each end that can butt against and accommodate securing of the partition 40 to a panel 12, 14, 16. As previously mentioned, any securing or adjoining means may be utilized to adjoin the interior partition 40 to the front panel 12, back panel 14 or side panels 16. To further stabilize the interior partition 40, the partition 40 may also include one or more ribs 28 that extend between the panel attachments 44 or extend from the top to the bottom of the interior partition 40 in a vertical direction.

Additionally, multiple chambers 18 and partitions 40 also allow for the mass confinement cell 10 to be cut into various shapes or into partial cells and still maintain a chamber 18 that can receive and retain fill materials. The ability to cut the retaining cells 10 and still retain the same features is particularly useful in preparing ends and awkward segments of retaining walls. In one embodiment, a confinement cell 10, as depicted in FIGS. 3 and 4, may be cut to a desired width, and adjoined with a partition 40 positioned on the front panel 12 and back panel 14 to thereby secure the front panel 12 to the back panel 14 of the cell 10 at approximately the points where they were cut.

Figure 8:
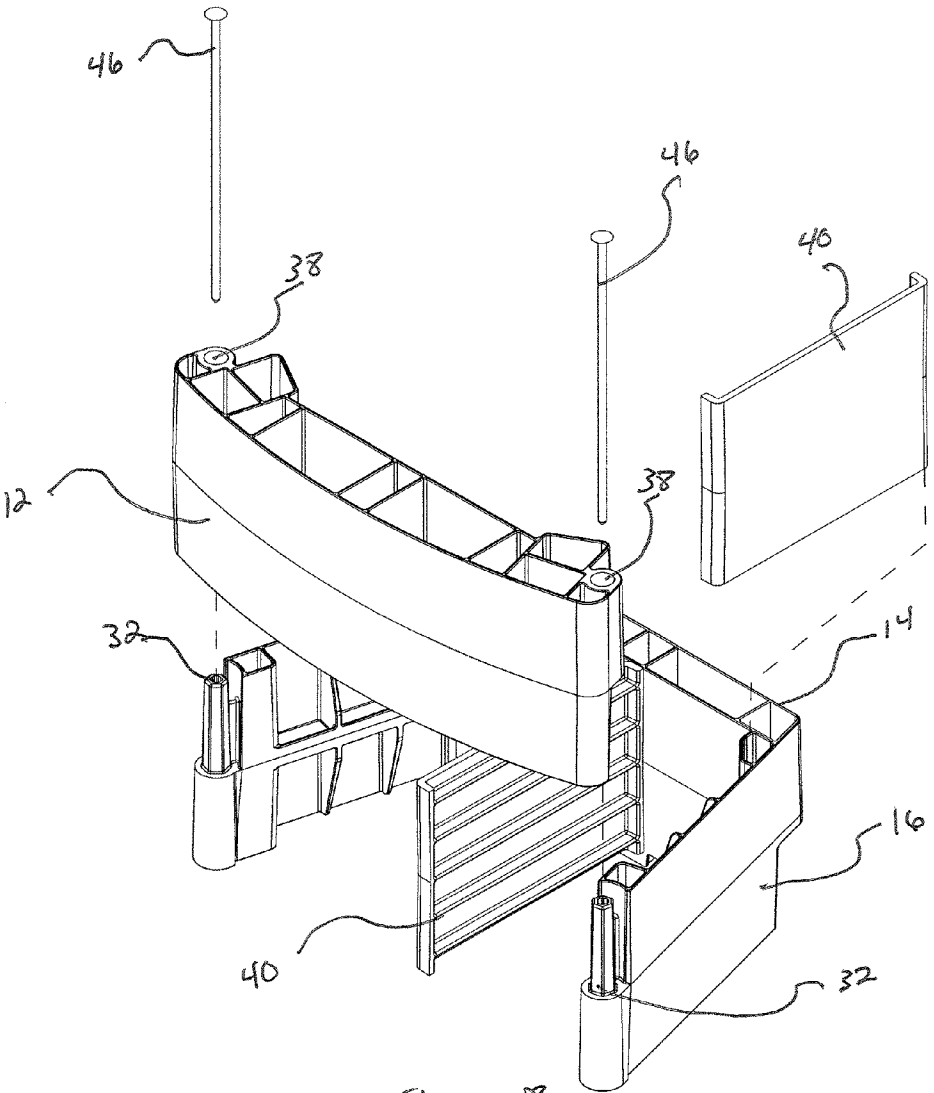
FIG. 8 is an exploded front view of one embodiment of a deterioration resistant mass confinement cell including integral side and back panels.
Figure 9:
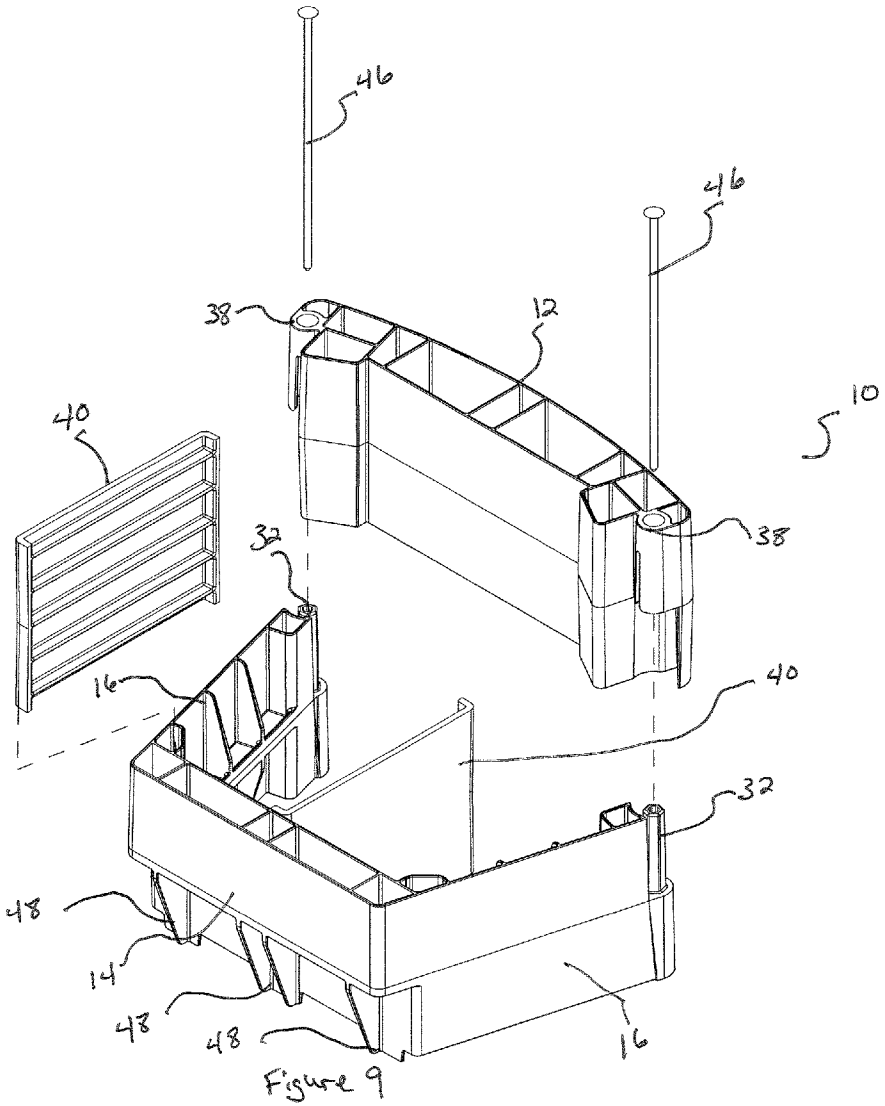
FIG. 9 is an exploded back view of one embodiment of a deterioration resistant mass confinement cell including integral side and back panels.

FIGS. 8 and 9 depict exploded views of the mass confinement cell of FIGS. 3 and 4, thereby illustrating the assembly of this embodiment of the present invention. In this embodiment, the front panel 12 includes two sockets 38 that are adapted to accept two pegs 32 that are adjoined to the two side panels 16. In some embodiments, the pegs 32 may be polygonal in shape and the socket 38 circular in shape to thereby secure the front panel 12 to the remainder of the cell 10 when the pegs 32 are inserted into the sockets 38. Furthermore, one or more partitions 40 may be positioned in the cell 10 to added additional stability to the confinement cell 10 or to provide an outer panel when cutting.

The various embodiments of the present invention may also include one or more pins 46 that may be inserted into apertures in the securing mechanism 22 or slots (not shown) positioned anywhere on the confinement cell to further secure the confinement cell 10 into position in a retaining wall and also may secure the confinement cell 10 to geogrid that is positioned between rows of cells 10 when constructing a wall. FIGS. 8 and 9 depict one embodiment of the pins 46 that may be utilized with the cells of the present invention.

Figure 10:
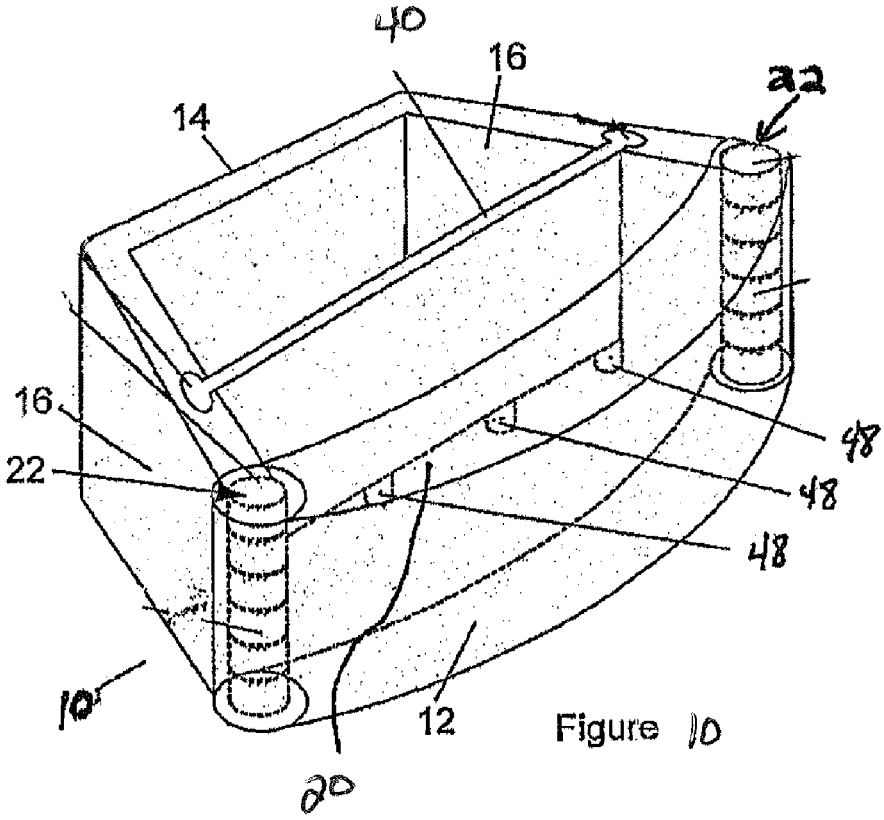
FIG. 10 is a front perspective view of one embodiment of a deterioration resistant mass confinement cell including integral side and back panels and a stabilizing partition.

The various mass confinement cell embodiments of the present invention may further include one or more positioning flanges or setting extensions 48 as depicted in FIG. 9. On a constructed wall, each retaining flange or setting extensions 48 are wall retention devices that operate to assist in placing the confinement cell in the proper position during wall assembly, and also inhibits outward movement of the wall once constructed. Normally, the retaining flange or setting extensions 48 extend downward from the back of the back panel 14 and rest against the back of the mass confinement cell or cells 10 located below. In other embodiments, the flange or setting extensions 48 may also extend downward from the front panel 12, side panels 16 or an interior partition 40. FIG. 10 depicts one embodiment wherein the setting extensions 48 extend downward from the partition 40. The retaining flange or setting extension 48 may be a unitary piece extending downward or upward from the mass confinement cell 10 or a series of fingers extending downward or upward from the confinement cell 10. It is also noted that the setting extensions 48 may further be utilized to anchor the confinement cell into the fill material below, thereby inhibiting movement of the cell upon filling.

Figure 11A:
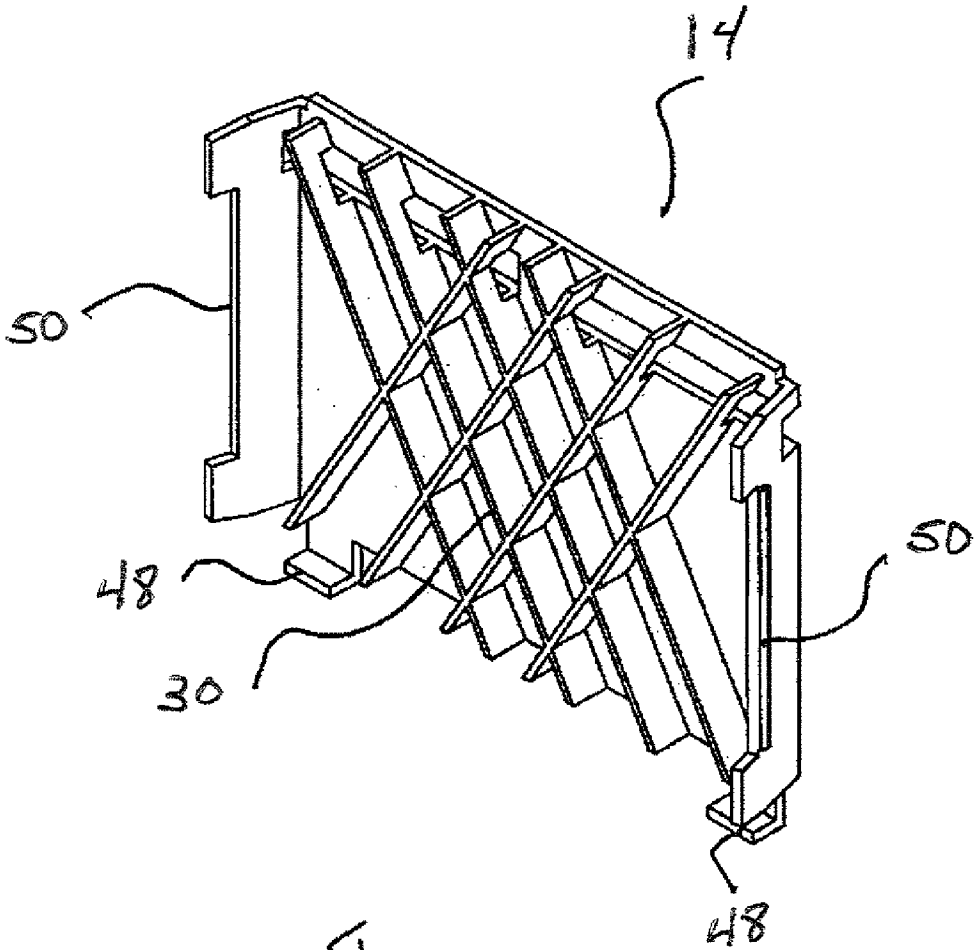
FIG. 11*a* is a back perspective view of an embodiment of a back panel that includes a locking peg extension.
Figure 11B:
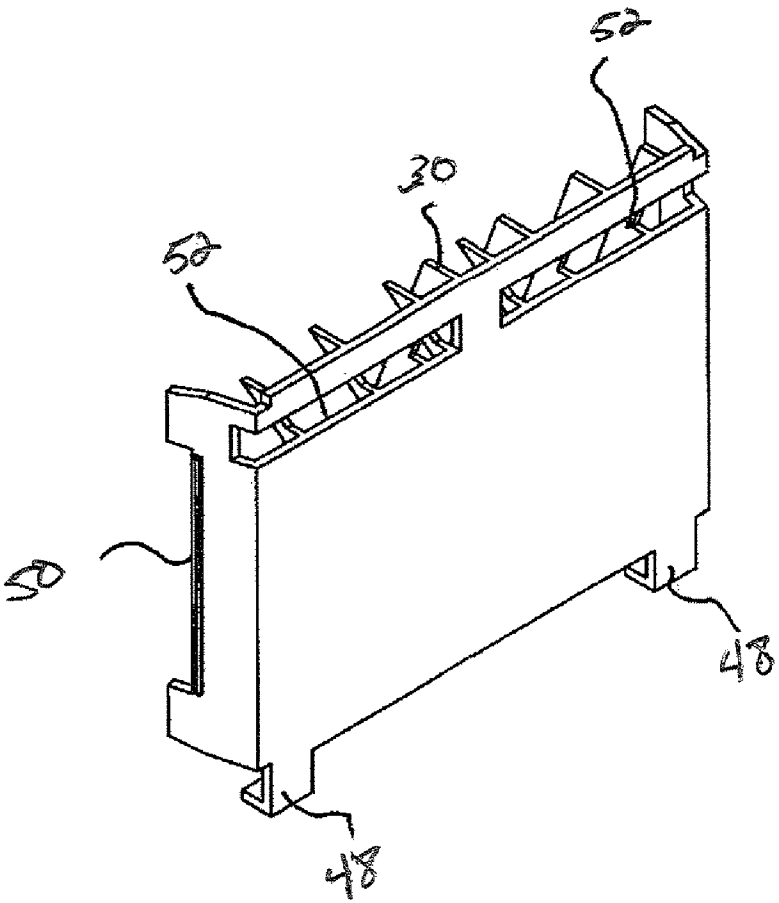
FIG. 11*b* is a front perspective view of an embodiment of a back panel that includes a locking peg extension.

FIGS. 11*a* and 11*b* depict another embodiment of an anchoring device and securing mechanism that may be utilized with various embodiments of the present invention. In this embodiment the one or more anchoring devices are peg extensions 48 that may be utilized to position and secure each cell 10 when assembling a wall and may also function to reduce or prevent overturn of the cells upon filling and compacting the fill material. In this embodiment, the peg extensions 52 are positioned on the back panel 14 are designed to fit in or under one or more peg extension slots or ridges (not shown) positioned on the two cells 10 located below when constructing a wall, revetment or other earth retention system.

The back panel 14 of the embodiment of FIGS. 11*a* and 11*b* may also include ribs 30 that can be positioned on the front or back of the back panel 14 to provide additional stability. In various embodiment when the back panel 14 is separated from the side panels 16, the back panel 14 may include a securing mechanism 22 in the form of larger snaps 50 that may be inserted into apertures 52 positioned on the side panels 16.

Figure 12:
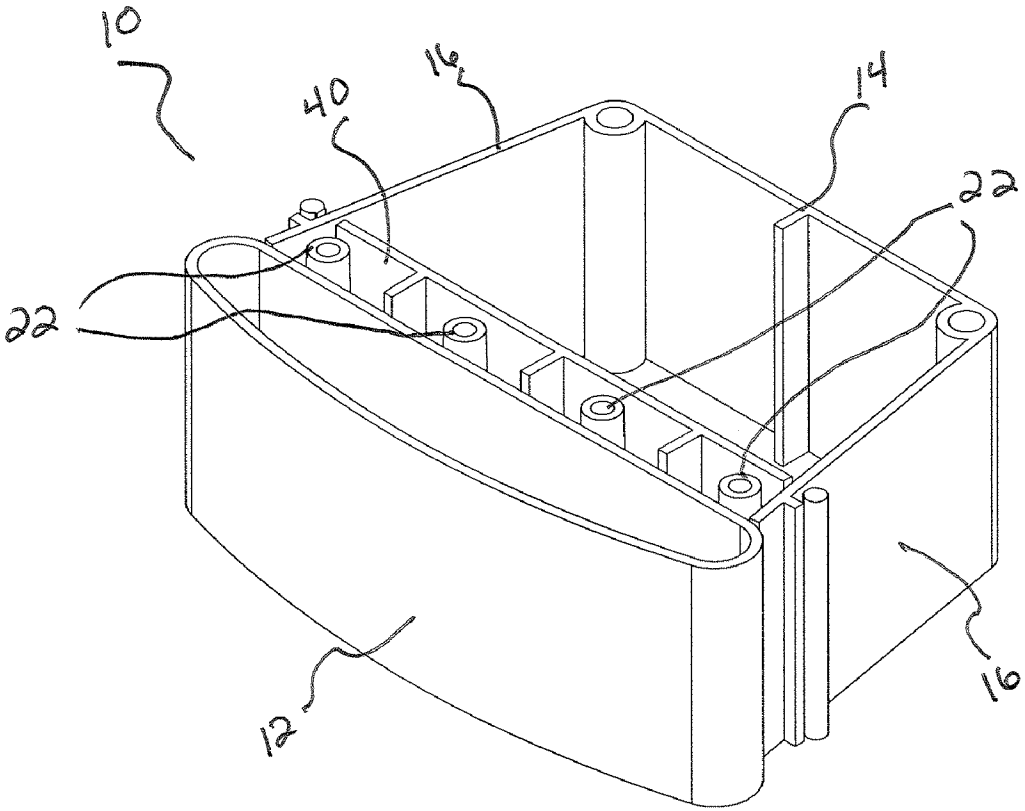
FIG. 12 is a front perspective view of one embodiment of a deterioration resistant mass confinement cell including an interior partition.
Figure 13:
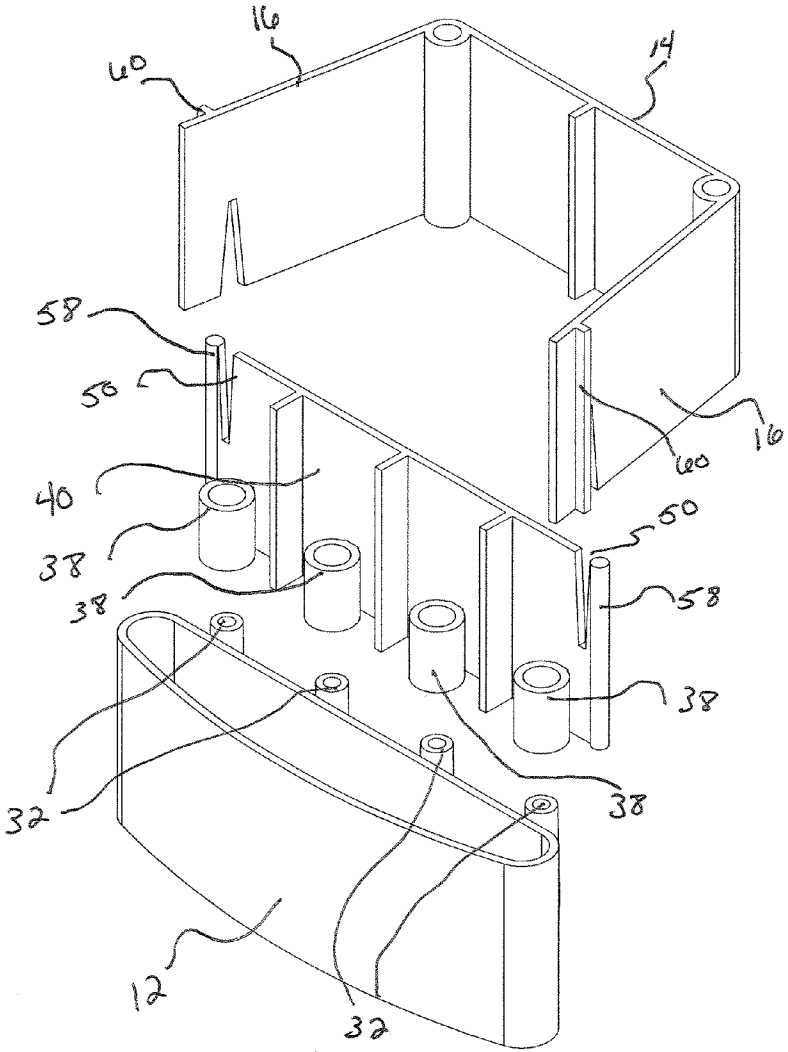
FIG. 13 is an exploded front view of one embodiment of a deterioration resistant mass confinement cell including an interior partition.
Figure 14:
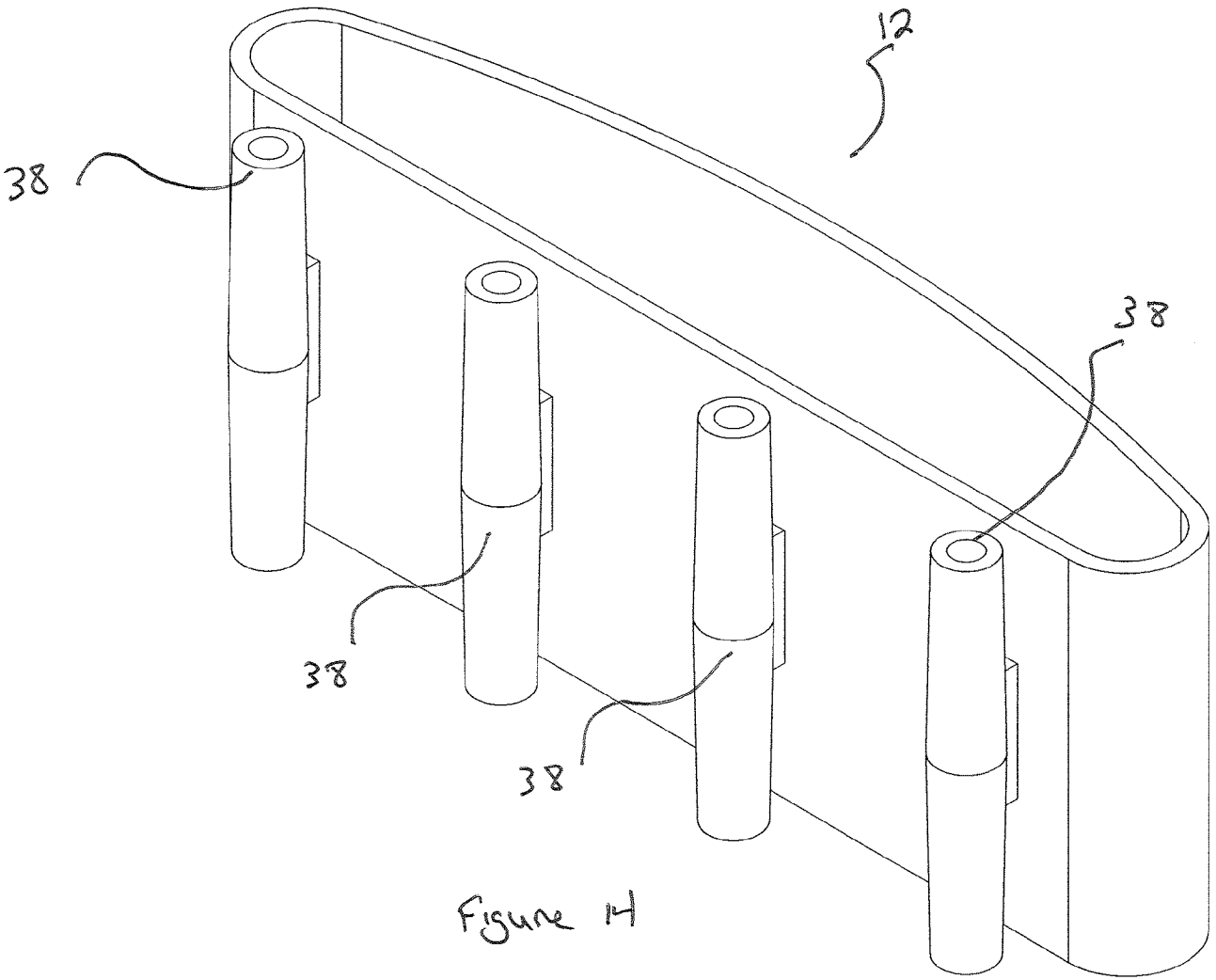
FIG. 14 is a back perspective view of an embodiment of a front panel of a deterioration resistant mass confinement cell of FIG. 12.

In yet another embodiment of the present invention, a securing mechanism 22 may be provided as a hybrid of a slot system and the peg and socket system. FIG. 12 depicts one embodiment of the present invention wherein an interior partition 40 includes the hybrid slot system and peg and socket system to secure the front panel 12 to the side panels 16 and back panel 14. As depicted in the exploded view of FIG. 13, the partition 40 includes two or more partition slits 54 to accommodate the securing of the two side panels 16 and back panel 14. The side panels 16 also include one or more panel slits 56 that are inserted into the slits 54 on the interior partition 40. One or more partition pegs 58 may be positioned adjacent to the partition slits 54 on the interior partition 40 and utilized to stabilize the partition 40 by positioning the pegs 58 against side panel ridges 60 after assembly of the side panels 16 and back panel 14 to the interior partition 40. The side panel ridges 60 prevent the partition 40 from rotating when assembly is complete. The partition 40 further includes one or more sockets 38 for receiving pegs 32 positioned on the front panel 12 (as depicted in FIG. 14) when securing the front panel 12 to the rest of the confinement cell 10.

As depicted in FIGS. 10 and 12, the stabilizing partition 40 may be included in the mass confinement cell 10 to further stabilize the cell structure, take pressure off of the front panel caused by the packed fill material and also provide a divider so that different fill materials may be added to the same cell 10 (e.g. a packing material toward the back of the confinement cell and a planting fill material in the front of the cell). In some embodiments, as depicted in FIG. 10, the partition 40 may include peg extensions 48 that operate as a cell positioning and securing means when constructing a retaining wall. The peg extensions 48 may be placed anywhere on the partition 40 including the ends and/or dispersed along the bottom edge of the partition 40. In construction of a wall, the peg extensions 48 may butt up against one or more partitions present in blocks positioned below, thereby holding the confinement cell 10 in position and providing an indication of proper positioning of the cell 10. It is noted that the peg extensions 48 may be included on the front panel 12, back panel 16 or side panels 16 rather than or in addition to the partition 40 so as to butt up against the front panel 12, back panel 14 or partitions 40 of the confinement cells positioned below.

Figure 15:
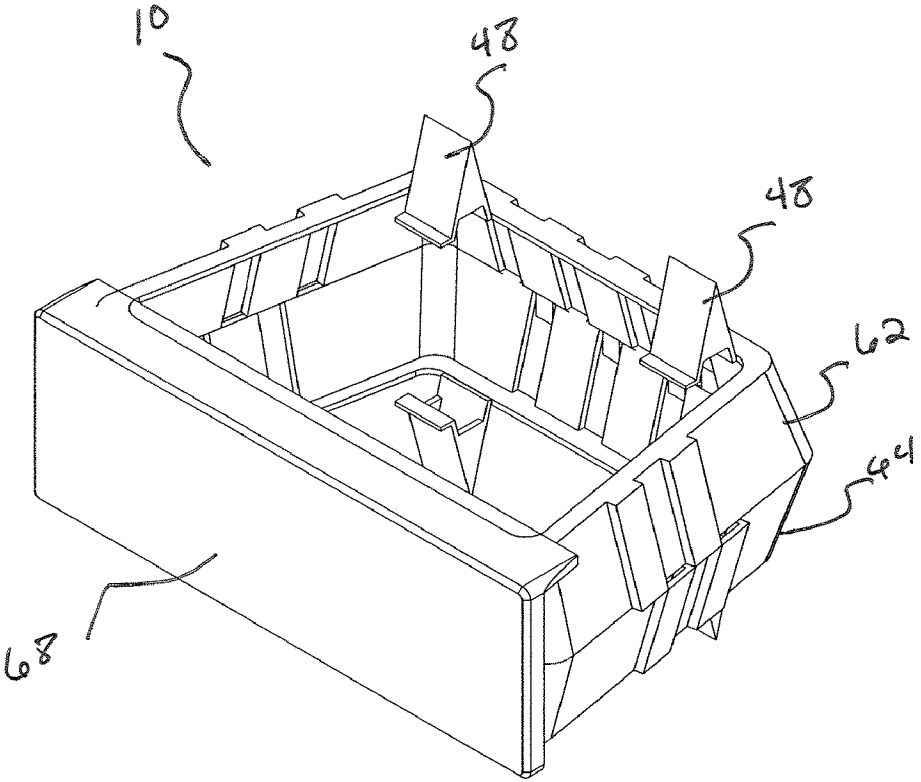
FIG. 15 is a front perspective view of one embodiment of a deterioration resistant mass confinement cell including two adjoinable frame sections.
Figure 16:
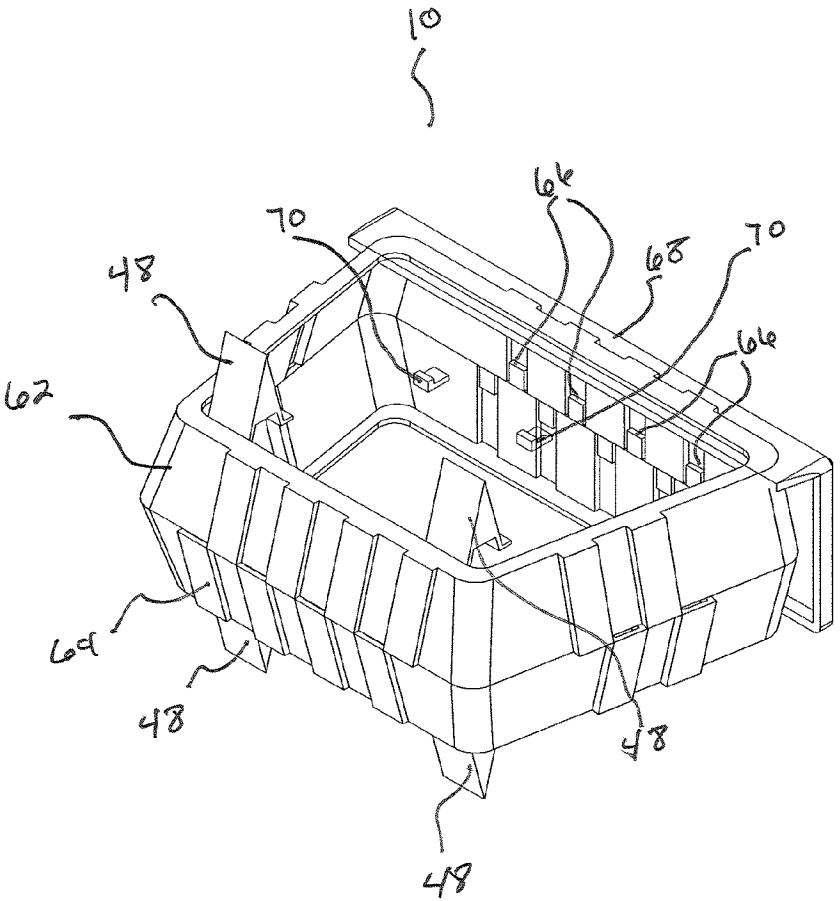
FIG. 16 is a back perspective view of one embodiment of a deterioration resistant mass confinement cell including two adjoinable frame sections.

FIGS. 15 and 16 depict another embodiment of the continuous chamber mass confinement cell of the present invention. The confinement cell 10 of this embodiment generally includes a frame comprising a top frame section 62 and a bottom frame section 64 that are adjoined with one or more section fasteners 66. The confinement cell 10 of this embodiment further includes a fascia 68 adjoined to the front of the cell 10. The fascia 68, in many embodiments of the present invention, is generally adjoined with one or more fascia fasteners 70, including but not limited to locking pegs, hooks, screws, rivets, adhesives, pins and the like. Generally, the top frame section 62 and bottom frame section 64 are sloped so as to allow each section and other top frame sections and/or bottom frame sections to nest within each other when disassembled to enhance transportation and storage efficiency. Finally, the confinement cell 10 of this embodiment may further include one or more retaining flanges or setting extension 48 for positioning and retaining each cell in the wall.

Figure 17:
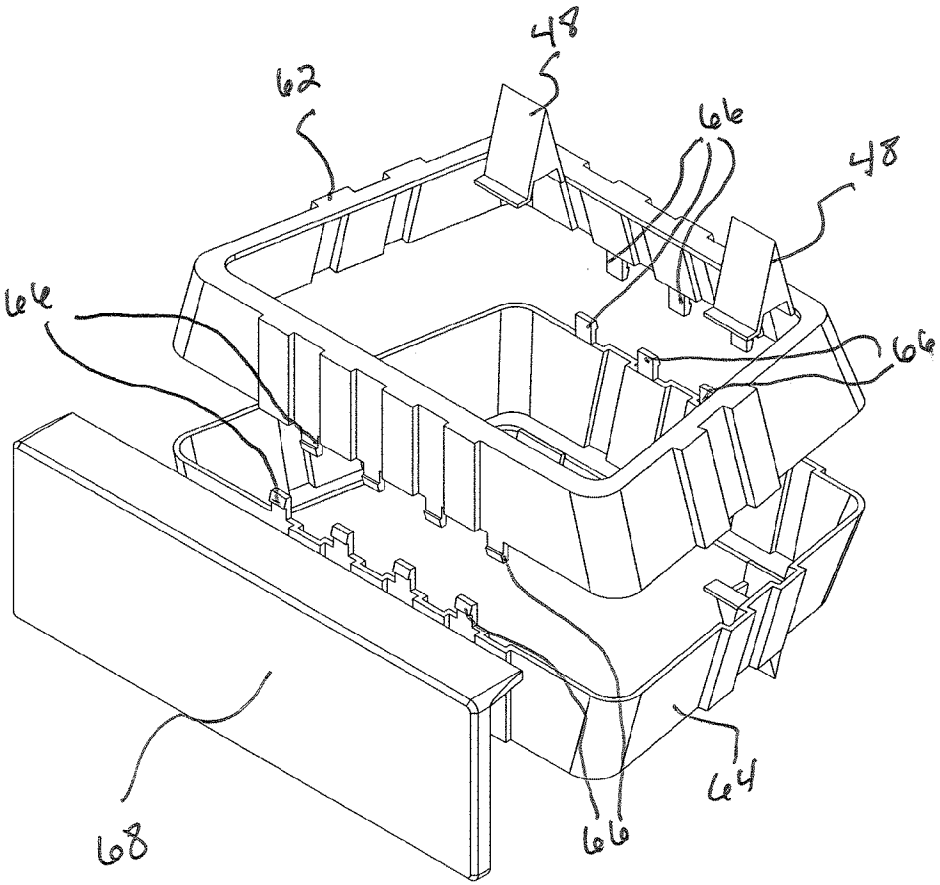
FIG. 17 is an exploded front view of one embodiment of a deterioration resistant mass confinement cell including two adjoinable frame sections.

FIG. 17 depicts an exploded view of the mass confinement cell illustrated in FIGS. 15 and 16. In assembly, the top frame section 62 and bottom frame section 64 are pushed together as shown until the fasteners 66 are engaged. Once the top frame section 62 and bottom frame section 64 are adjoined, the fascia 68 is secured by aligning the fascia 68 with the front of the two sections 62, 64 and engaging the fascia 68 to the sections 62, 64 with the fascia fasteners 70.

Figure 18A:
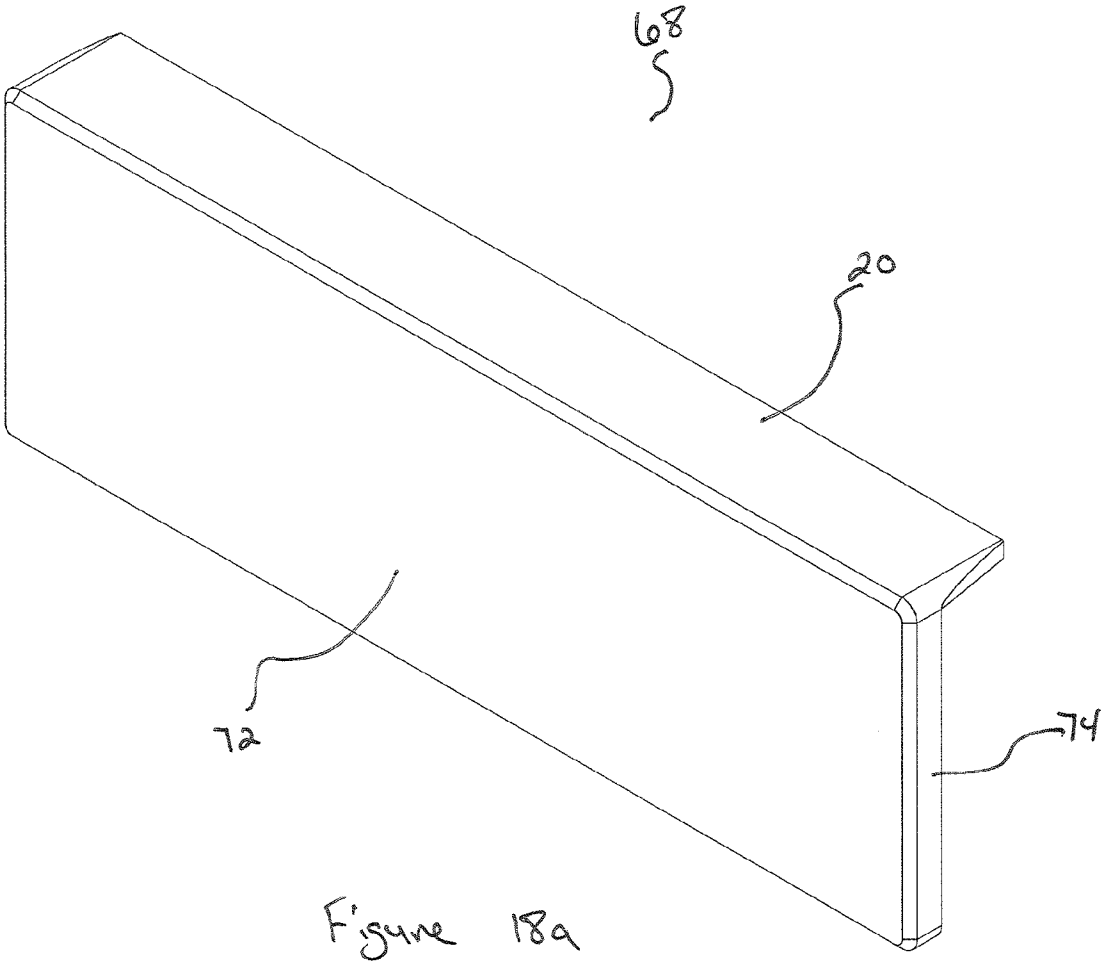
FIG. 18*a* is a front view of one embodiment of a fascia that may be utilized with the deterioration resistant cells of the present invention.
Figure 18A:
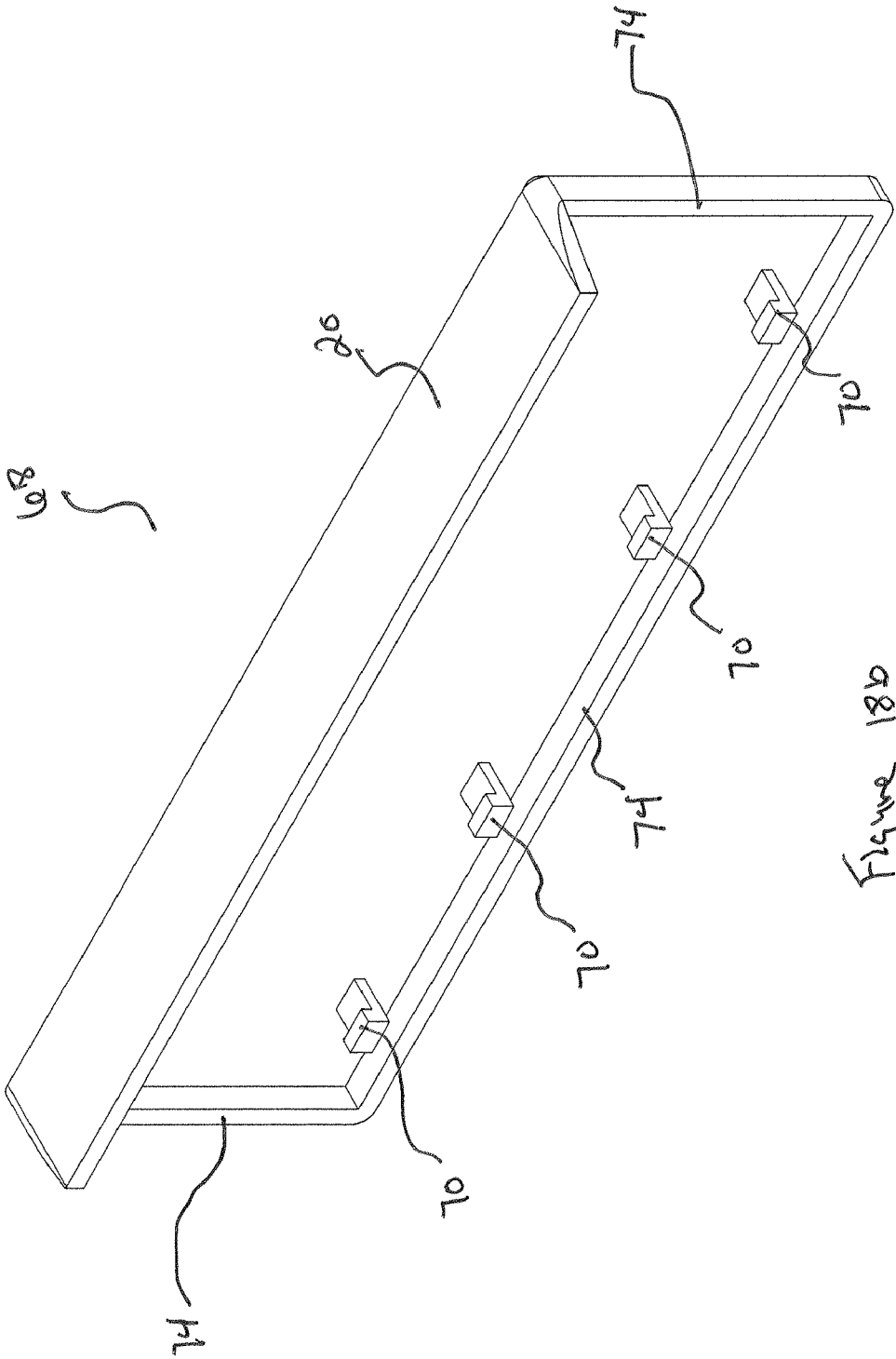
Figure 19A:
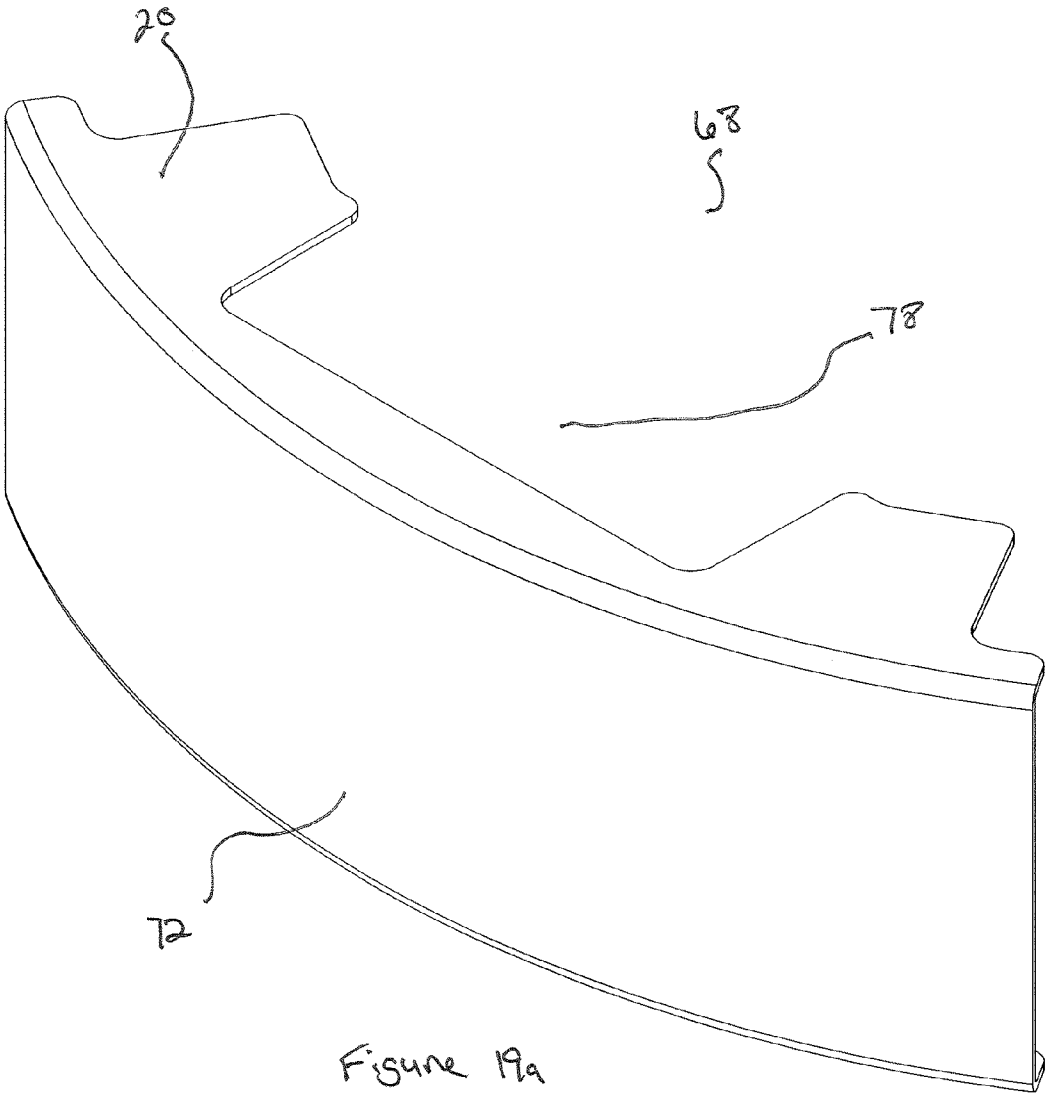
FIG. 19*a* is a front view of one embodiment of a fascia that may be utilized with the deterioration resistant cells of the present invention.
Figure 19B:
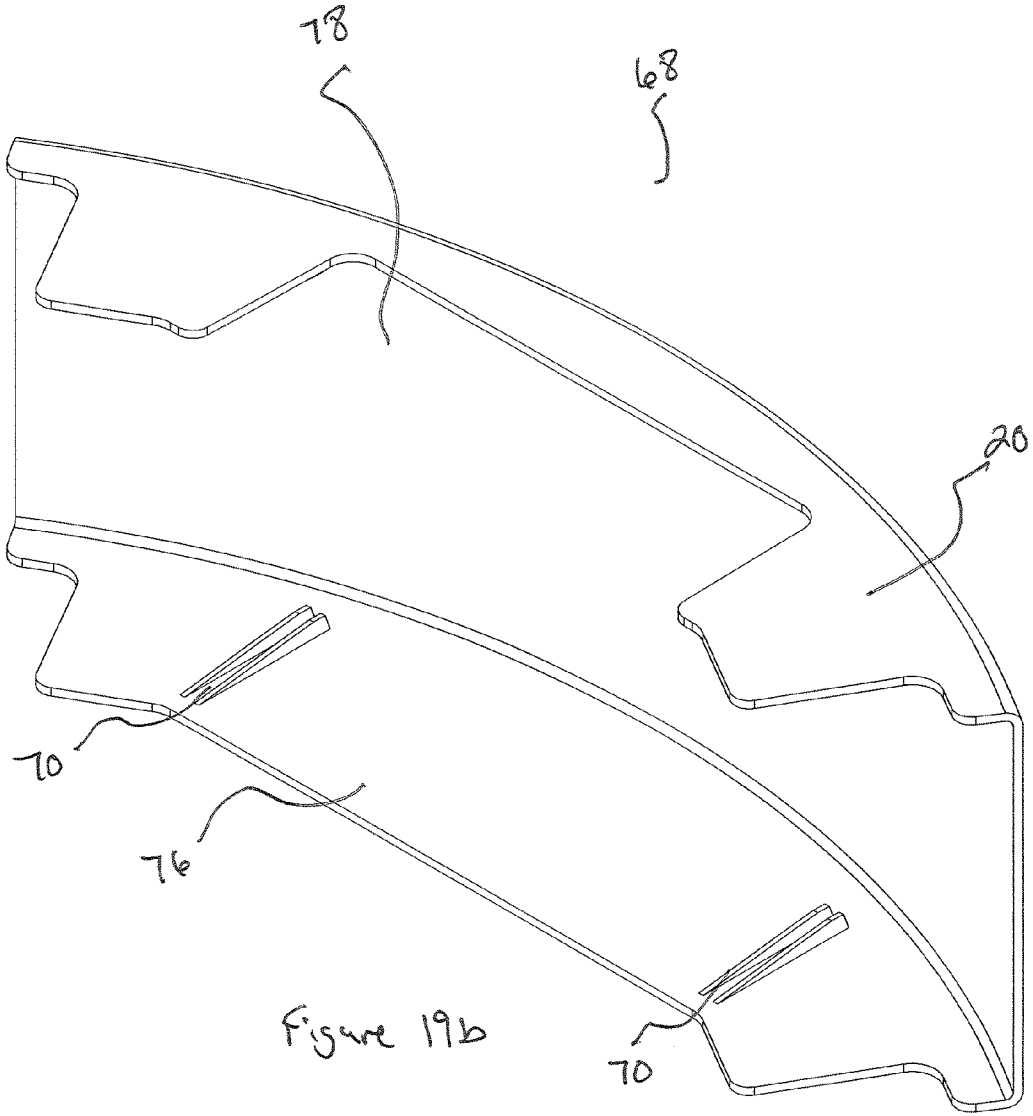
FIG. 19*b* is a back view of one embodiment of a fascia that may be utilized with the deterioration resistant cells of the present invention.

Other embodiments of the present invention may also include a fascia with the desired aesthetic appearance, rather than having the aesthetic appearance (e.g. texture and color) molded into the front face of the front panel 12. FIGS. 18*a-b* depicts a front view and back view of one embodiment of a fascia 68 that may be utilized with any embodiment of the present invention. Generally, the fascia 68 includes a front surface 72, a partial top panel 20 and one or more fascia fasteners 70. The fascia 68 may also optionally include wrap around sides 74, that wrap around the side panels 16 and bottom panel upon assembly. The front surface 72, top panel 20 and wrap around sides 74 may be textured and include color and/or other additives (e.g. U.V. inhibitor) to provide the earthen appearance, a crystalline appearance or desired aesthetic design. Additionally, the fascia 68 may be prepared utilizing any of the techniques discussed below or those known in the art for forming the desired appearance. FIGS. 19*a-b* depict the front view and back view of a fascia 68 of the present invention, wherein the fascia 68 also includes a partial bottom panel 76. In all of the embodiments of the present invention that include a fascia 68, the fascia 68 may be permanently fixed to the front panel 12 or may be removable so as to be replaced when damaged or a change is desired. The fascia 68 may also include one or more indentations 78 for surrounding a load bearing member (not shown) that is positioned on the front panel 12 and functions to support the load of the cells positioned above. These load bearing members 204 are configured to take pressure off the fascia 254 when a wall is assembled, thereby allowing for greater ease in removal and replacement when desired.

Figure 20:
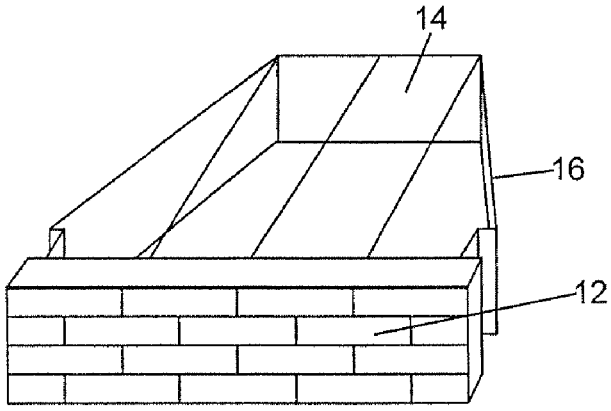
FIG. 20 is a front perspective view of one embodiment of a deterioration resistant mass confinement cell including a front face that appears like multiple individual units.
Figure 20A:
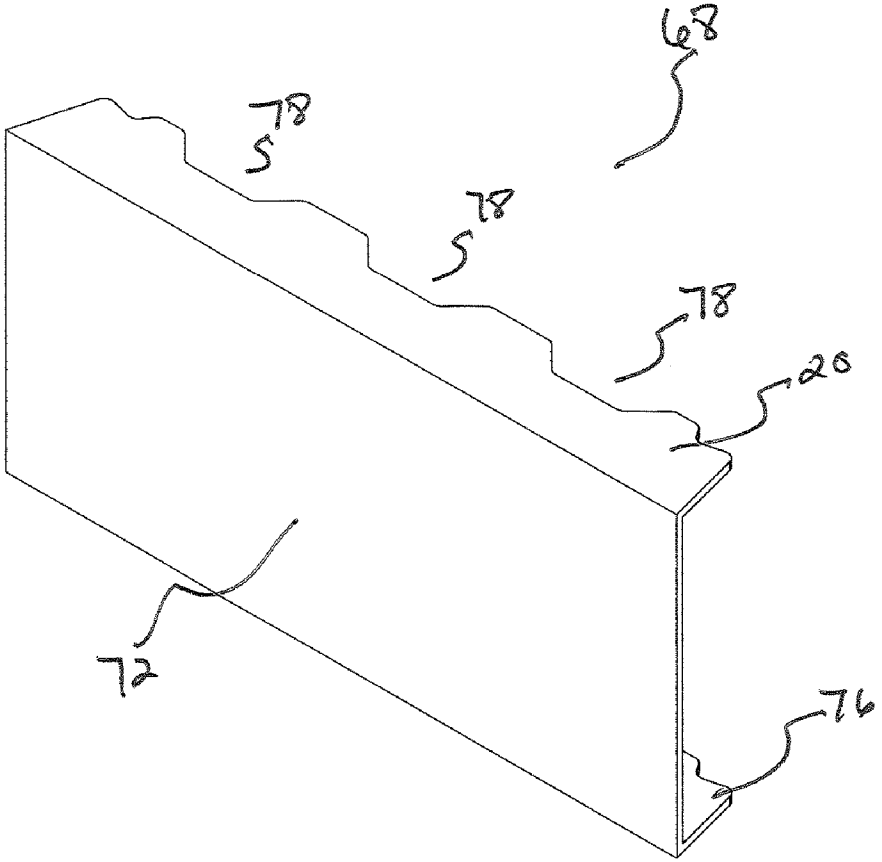
FIG. 20*a* is a front view of one embodiment of a fascia that may be utilized with the deterioration resistant cells of the present invention.
Figure 20B:
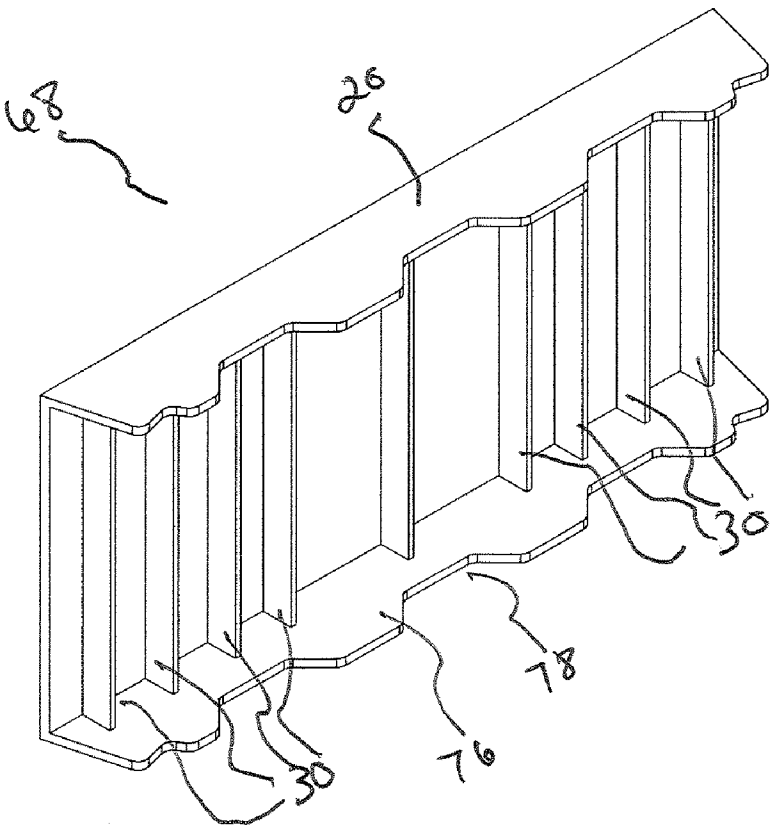
FIG. 20*b* is a back view of one embodiment of a fascia that may be utilized with the deterioration resistant cells of the present invention.

Another embodiment of a fascia 68 of the present invention is depicted in FIGS. 20*a* and 20*b*. These FIGS. depict a front and back view of one embodiment of a fascia 68 that may be utilized with the confinement cells of the FIGS. described herein. Further explanation of fascia design and manufacture will be discussed below. The fascia 68 in various embodiments of the present invention may include a plurality of ribs 30 to add stability and structure to the fascia 68. It is noted that the top panel 20 of the fascia 68 may include one or more indentations 78 to accommodate and alternate between load bearing members 204 upon administering the fascia 68 to the front panel 12.

Figure 21A:
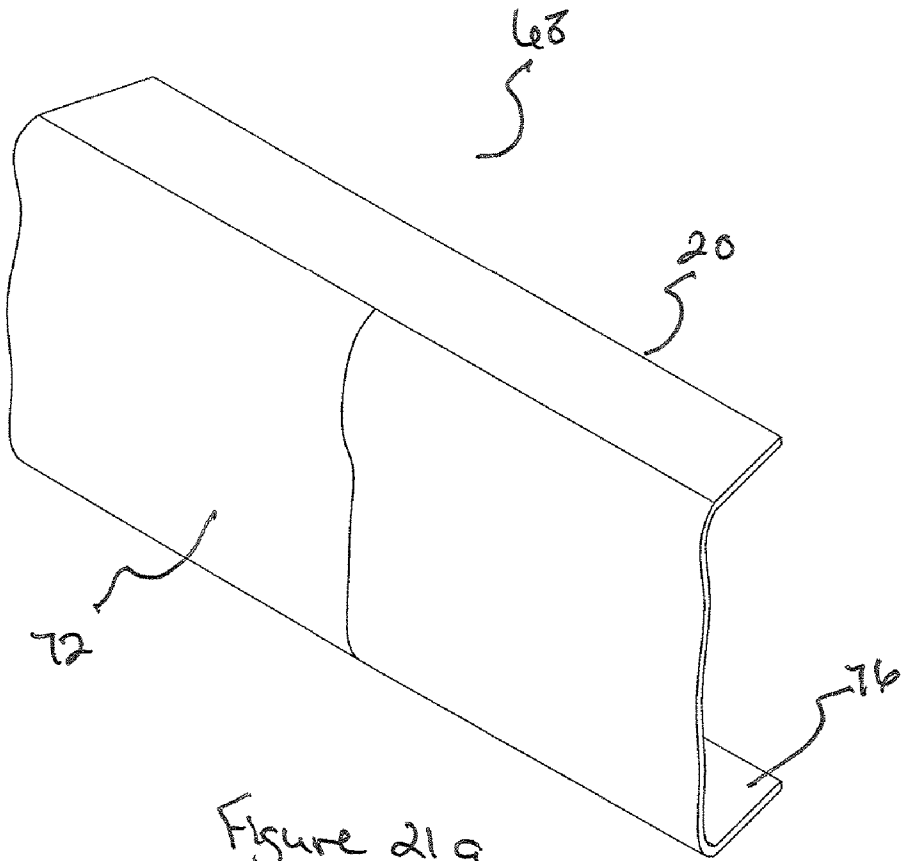
FIG. 21*a* is a front view of one embodiment of a fascia that may be utilized with the deterioration resistant cells of the present invention.
Figure 21B:
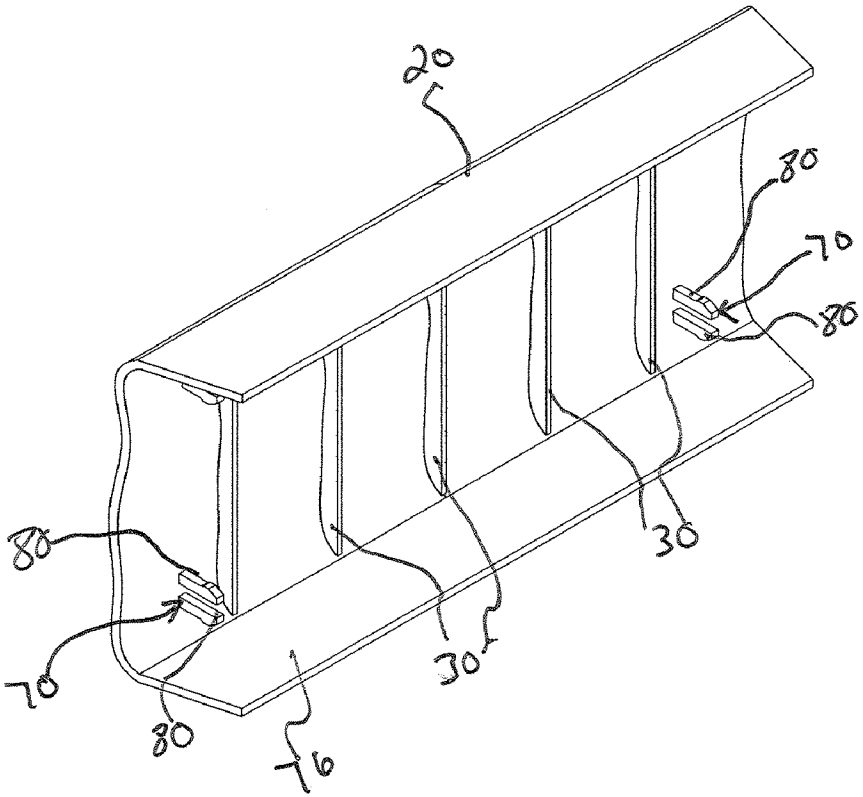
FIG. 21*b* is a back view of one embodiment of a fascia that may be utilized with the deterioration resistant cells of the present invention.

FIGS. 21*a-b* depict yet another embodiment of the fascia 68 that may be utilized with the confinement cells 10 of the present invention. The fascia 68 generally includes a front surface 72, partial top panel 20, partial bottom panel 76, stability ribs 30 and two or more fascia fasteners 70. In this embodiment the fascia fasteners 70 include two or more fascia keys 80 that are designed to flex enough to pass through and aperture in the front panel 12, thereby securing the fascia 68.

As previously suggested, the mass confinement cell embodiments depicted in previously disclosed FIGS. and the embodiments of the present invention are also especially advantageous for mega-cell products of sizes equal to or greater than one foot in height, two feet wide and one foot deep (e.g. approximately 1 feet in height, 2 feet wide and 1.5 feet deep or 2 feet in height, 4 feet wide and 2 feet deep) and multi-cell products (e.g. products that appear like multiple individual units that are approximately 3-36 in height, 2-4 feet wide and 9 inches to 4 feet deep; see FIG. 20) that are advantageous for the mass consumer market. Such large confinement cells and multi-unit cells allow for easy storage and transportation of such mega-cells and multi-cells by allowing them to be transported or stored in flat or nested configurations. Such configurations reduces the space needed for the transportation and storage of large numbers of cells.

In various embodiments of the mass confinement cells 10 of the present invention, the surface visible to the observer, such as the front panel 12 or fascia 68 of the mass confinement cell 10 will generally include a molded and/or fabricated texture and/or pattern in the deterioration resistant material. In various embodiments of the present invention the exposed surface of the landscaping product, such as the front panel 12 or fascia 68, will have a natural earthen appearance simulating the texture and color of natural earthen surfaces. For example in some embodiments, the exposed surface of the front panel 12 or the surface of the fascia 68 may be textured and colored to have the appearance of rock, natural stone, sand, soil, clay, wood, trees and foliage, water, or any other natural earthen appearance. In other embodiments, the front panel 12 or fascia 68 will have a crystalline appearance or will have another aesthetically appealing design. Additionally, in other embodiments, the exposed surface of the landscaping product, such as the front panel 12 or fascia 68, may further include one or more designs (e.g. symbols, company names, logos, images) that may be positioned in the natural earthen appearance texture and color, crystalline texture and color or other design (e.g. a company logo embedded in a stone color and texture). Also, in other embodiments of the present invention, the front panel 12 or fascia 68 may further include a design, such as the appearance of multiple bricks, stones, or blocks. See FIG. 20 for an example of a multi-stone design. This allows for the installation of larger mass confinement cells (e.g. mega-cells) in a wall that appears to include a multitude of bricks, stones, blocks, timbers and the like.

In various embodiments of the present invention the texture of the front panel 12 or fascia 68 is produced by imaging an actual natural surface, such as natural stone, brick or wood and producing a mold that mimics that particular image. The imaging of the natural surface can be performed by processes such as casting the natural surface or by digital scanning the natural surface. When casting the natural surface a mirror image of the surface can be produced by preparing a solidifying material, such as silicone, and casting it over the natural surface. Once the solidifying material sets the newly casted mold is removed and an opposite image or negative of the natural surface is produced. Once the casted mirror image is produced, a mold or a mold insert manufactured from a suitable mold material, such as aluminum, steel or a ceramic, can be produced for mass manufacture. In various embodiments of the present invention ceramic molds are produced to provide the desired detail found in the natural surface which then can be transferred to a more durable steel or aluminum mold for mass manufacture. One source for such molds formed of ceramic materials is Arrow Pattern and Foundry Company, 9725 South Industrial Drive, Bridgeview Ill. Alternatively, a mold may be prepared by digitally scanning the natural surface, such that the surface of a stone, brick or piece of wood. Once scanned, a mold can be produced from a suitable mold material for mass manufacture of the front panels or fascias having a front surface supporting the scanned image.

As previously suggested, many embodiments of the present invention have a molded or fabricated front panel 12, partial top panel (not shown), fascia 68 and/or other portions of the mass confinement cell 10 (e.g. endcaps and topcaps), that exhibit an earthen appearance, crystalline appearance or other aesthetic design. This may be accomplished in a number of ways including but not limited to thermal molding, lamination and/or surface coating (e.g. U.V. activated coating or polymer adhesion painting). For example, in some embodiments of the present invention the texture and color of the confinement cell 10 may be formed by thermal molding one or more resins that include colors and other additives in a mold that has a desired texture. Such a process may be performed by any process known in the art, such as thermoforming, extrusion, injection molding, structural foam molding (e.g. low pressure multi-nozzle structural foam), vacuum molding or any combination thereof. For example, one or more polymers, such as HDPE, polypropylene or a polyester (e.g. Polyethylene terephthalate (PET), polycarbonate), that includes one or more colors, fillers, and/or additives (e.g. U.V. inhibitors) may be injected into a mold that includes a desired shape and texture to form a front panel 12, fascia 68 or other visible part of the mass confinement cell 10. One example, of such a desirable material that may be utilized to produce components of the present invention by thermal molding is a bulk molding compound (BMC) or thermoset that includes one or more polyester resins, glass fibers and other additives and is manufactured and/or molded by Bulk Molding Compounds, Inc. 1600 Powis Court West, Chicago Ill. 60185 and Kenro Incorporated, a Carlisle Company, 200 Industrial Drive, Fredonia, Wis. 53021. In various embodiments, the texture may also be imprinted on the mass confinement cell 10, 210 310 in a secondary process after formation of one or more components of the confinement cell 10, 210, 310 by rolling a die that imprints the texture on the surface of the polymeric front panel 12, fascia 68 and/or other portion of the cell 10.

In other embodiments of the present invention, the earthen appearance or other design can be achieved through a lamination process. In various embodiments, a sheet of polymeric material including the desired color and additives (e.g. UV inhibitor, natural or synthetic stone particles . . . ) is laminated over the portions of the mass confinement cell 10 that are intended to have the earthen appearance or other design. In various embodiments of the present invention a sheet of polymeric material may include natural or synthetic particles (e.g. granite, marble, aluminum trihydrate, aluminum oxide, calcium oxide . . . ). Generally, in the lamination process, the front panel 12 or fascia 68 may have a sheet of polymeric material heat welded or adhered to the front surface plastic of the front panel 12 or fascia 68. Such a lamination step may happen in a secondary step after formation of the front panel 12 or fascia 68. Alternatively, the lamination plastic sheet may be inserted into the front side of a mold and formed over the resin that is administered into the mold (e.g. in-mold decoration). For example, a sheet of polymeric material may be placed in the front end of an injection molding mold and subsequently thermoformed or vacuum formed to the front surface of the mold prior to filling the mold with resin when manufacturing the front panel 12 or fascia 68. Next, melted resin is shot into the injection mold, thereby integrating the laminated sheet into the face and optionally top of the front panel 12 or fascia 68.

In yet other embodiments of the present invention, the earthen appearance or aesthetic design may be achieved by utilizing a solid surface coating. The solid surface coating generally includes one or more natural mineral or fiber fillers, one or more polymeric binder resins and one or more initiators. The natural mineral or fiber fillers may include but are not limited to natural stone or rock filler (e.g. granite, marble, quartz, limestone, shale particles), wood fiber, hydrated alumina (e.g. aluminum trihydrate), ground silica, acrylic chips, calcium carbonate, aluminum oxide with pigmented polymer coated quartz, sand, and any other filler that would provide a natural earthen appearance.

Various embodiments of the present invention include one or more polymerizable binder resins. In one embodiment, the present invention provides a system comprising initiators and one or more of the polymerizable binder resins, each binder resin bearing one or more polymerizable groups. In accordance with this embodiment, the photoinitiator group serves to initiate polymerization of the polymerizable groups, thereby forming a polymeric coating, e.g., in the form of a layer covalently bound to the support surface (e.g. block surface or landscaping product surface) of a desired article via the one or more initiators. As used herein, "polymerizable group" shall generally refer to a group that is adapted to be polymerized by initiation via free radical generation, and more preferably by photoinitiators activated by visible or long wavelength ultraviolet radiation.

Suitable polymerizable compounds are selected from monomeric polymerizable molecules (e.g., organic monomers), and macromeric polymerizable molecules (e.g., organic macromers). As used herein, "macromer" shall refer to a macromolecular monomer having a molecular weight of about 250 to about 25,000, and preferably from about 1,000 to about 5,000. For purposes of the present invention, and unless specified otherwise, the term "monomer" when used in this respect shall generally refer to monomeric and/or macromolecular polymerizable molecules.

In yet another embodiment, the polymerizable monomer compounds of the present invention comprise macromeric polymerizable molecules. Suitable macromers can be synthesized from monomers such as those illustrated above. According to the present invention, polymerizable functional components (e.g., vinyl groups) of the macromer can be located at either terminus of the polymer chain, or at one or more points along the polymer chain, in a random or nonrandom structural manner.

Examples of some polymerizable binder resins that may be utilized in the present invention include, but are not limited to, polyurethanes, polyepoxides, epoxy-acrylates, epoxide and epoxy resins, urethane acrylates, methacrylates, unsaturated polyesters, polyols, acrylics and monomers and oligomers having similar backbone structures of these resins.

The coatings also include one or more initiators. Generally the initiators are polybifunctional reagents of the invention carry one or more pendent latent reactive (e.g. photoreactive or thermoreactive) moieties covalently bonded to the resin. Various embodiments of the coatings of the present invention include one or more photoreactive moieties that are sufficiently stable to be stored under conditions in which they retain such properties. Latent reactive moieties can be chosen that are responsive to various portions of the electromagnetic spectrum, with those responsive to ultraviolet and visible portions of the spectrum (referred to herein as "photoreactive") being particularly preferred.

Photoreactive moieties respond to specific applied external stimuli to undergo active specie generation with resultant covalent boding to an adjacent chemical structure, e.g., as provided by the same or a different molecule. Photoreactive moieties are those groups of atoms in a molecule that retain their covalent bonds unchanged under conditions of storage but that, upon activation by an external energy source, form covalent bonds with other molecules.

The photoreactive moieties generate active species such as free radicals and particularly nitrenes, carbenes, and excited states of ketones upon absorption of external electric, electromagnetic or kinetic (thermal) energy. Photoreactive moieties may be chosen to be responsive to various portions of the electromagnetic spectrum, and photoreactive moieties that are responsive to e.g., ultraviolet and visible portions of the spectrum are preferred and are referred to herein occasionally as "photochemical" moiety.

Photoreactive aryl ketones, such as acetophenone, benzophenone, anthraquinone, anthrone, and anthrone-like heterocycles (i.e., heterocyclic analogues of anthrone such as those having N, O, or S in the 10-position), or their substituted (e.g., ring substituted) derivatives are utilized in some embodiments of the present invention. The functional groups of such ketones are preferred since they are readily capable of undergoing the activation/inactivation/reactivation cycle described herein. Benzophenone is one photoreactive moiety that may be utilized, since it is capable of photochemical excitation with the initial formation of an excited singlet state that undergoes intersystem crossing to the triplet state. The excited triplet state can insert into carbon-hydrogen bonds by abstraction of a hydrogen atom (from a support surface, for example), thus creating a radical pair. Subsequent collapse of the radical pair leads to formation of a new carbon-carbon bond. If a reactive bond (e.g., carbon-hydrogen) is not available for bonding, the ultraviolet light-induced excitation of the benzophenone group is reversible and the molecule returns to ground state energy level upon removal of the energy source. Photoactivatable aryl ketones such as benzophenone, thioxanthone, camphorpyinone and acetophenone are of particular importance inasmuch as these groups are subject to multiple reactivation in water and hence provide increased coating efficiency.

Other initiators may include one or more photointiated reagents including four or more reactive groups. Examples of such initiators include tetrakis (4-benzoylbenzyl ether), the tetrakis (4-benzoylbenzoate ester) of pentaerythritol, and an acylated derivative of tetraphenylmethane.

The azides constitute another class of latent reactive moieties and include arylazides (C6R5N3) such as phenyl azide and particularly 4-fluoro-3-nitrophenyl azide, acyl azides (—CO—N3) such as benzoyl azide and p-methylbenzoyl azide, azido formates (—O—CO—N3) such as ethyl azidoformate, phenyl azidoformate, sulfonyl azides (—SO2—N3) such as benzenesulfonyl azide, and phosphoryl azides (RO)2PON3 such as diphenyl phosphoryl azide and diethyl phosphoryl azide. Diazo compounds constitute another class of photoreactive moieties and include diazoalkanes (—CHN2) such as diazomethane and diphenyldiazomethane, diazoketones (—CO—CHN2) such as diazoacetophenone and 1-trifluoromethyl-1-diazo-2-pentanone, diazoacetates (—O—CO—CHN2) such as t-butyl diazoacetate and phenyl diazoacetate, and beta-keto-alpha-diazoacetates (—CO—CN2—CO—O—) such as t-butyl alpha diazoacetoacetate. Other photoreactive moieties include the aliphatic azo compounds such as azobisisobutyronitrile, the diazirines (—CHN2) such as 3-trifluoromethyl-3-phenyldiazirine, the ketenes (—CH═C═O) such as ketene and diphenylketene.

The solid surface coating may be applied to the surface of the landscaping product of the present invention by any type of process that would provide substantial coverage of the product surface and secure attachment of the coating, such as spray coating, dip coating and the like. In various embodiments of the present invention, the solid surface coating may be administered to the product surface in a one step or two-step process. For example, in a one step process, a substantially homogenous mixture of the filler, polymerizable resin and initiators are administered to the surface of the product and the initiators then subsequently activated to polymerize the resin and attach the coating to the surface.

Alternatively, a two step or grafting process may be utilized to administer the solid surface coating. In such a process, the initiator is first administered to the surface and activated to attach the initiator to the surface. Once the initiator is attached, a substantially homogenous mixture of the filler and polymerizable resin is administered to the surface and the initiator is again activated to polymerize the resin and attach the mixture to the surface. It is noted that in various embodiments of the present invention, a tie-in layer may be applied to the surface to facilitate better attachment of the solid surface coating. For example, one or more layers, such as a silane, Plexar, Binel, siloxane and/or Parylene layer(s) may be applied to the surface prior to administration of the solid surface coating.

In other embodiments of the present invention, the landscaping products, including the exposed components of the mass confinement cells (e.g. front panel, fascia, end cap, cell cap), may be colored and further textured utilizing a painting process. One such painting process that may be used with various embodiments of the present invention is a polymer adhesion painting process wherein a polymeric paint is adhered to the surface of the mass confinement cell 10 after the surface of the cell, such as the front panel 12, the fascia 68, the end cap 82 or the cell cap, has been flame treated or plasma treated. In one polymer adhesion painting method, the mass confinement cell is manufactured utilizing a process, such as injection molding, structural foam molding (e.g. low pressure multi-nozzle structural foam), rotomolding, thermoforming, extrusion or any other process. Next, all surfaces of the mass confinement cell intended to be painted are flame treated or plasma treated with an ion gun prior to applying paint. The flame treating may be performed with any gas torch system, such as propane, acetylene and the like. Plasma treatment may also be performed by any device that forms a gas plasma that can be directed to the polymeric surface. The flame or plasma treated surface should be painted within 24 hours, optionally within 8 hours and further optionally within 5 hours. Once the surface has been flame or plasma treated, a polymeric paint, such as a polyurethane paint, is mixed with a crosslinker and applied to the surface or surfaces of the mass confinement cell 10. It is noted that the polymer adhesion paint mixture should be applied shortly after mixing; in some embodiments almost immediately. One example of the types of polymeric paints that may be utilized with embodiments of the present invention is a two component polyurethane that generally includes a mix ratio of five parts colored paint with one part crosslinker (e.g. XL-003 crosslinker or an isocynate). Two examples of two such polyurethane based paints are as follows:

EXAMPLE 1

| HIGH SOLIDS ALLPHATIC POLYURETHANE 120 Series | |
|---|---|
| DESCRIPTION | |
| High Solids 3.5 V.O.C. two component polyurethane for metal, plastic, and interior wood. It is used for industrial and automotive applications. This system has excellent chemical and stain resistance. It has shown excellent adhesion to many substrates with good mar and abrasion resistance and it has 2-3H hardness. | |
| CHARACTERISTICS | |
| Density - lbs/gal: | 7.95-13.0 |
| Solids, wt. %: | 51-70 |
| Solids, volume: | 42.9-60 |
| Viscosity: | 35-42 Sec. |
| Flash Point ° F. | 80 |
| Application Method: | Conventional of HVLP |
| Reduction for Application: | 5-base; 1-XL009; 1-acetone<br>6-base; 1-XL003; 1-20LT161 |
| Pot Life: | 3-HRS @ 70° F. |
| Cure Schedule: | 30 min @ 180° F. |
| Gloss 60°: | Flat to 96 |
| VOC as supplied - lbs/gallon: | 3.0-3.6 |
| VOC as applied - lbs/gallon: | 2.9-3.5 |

EXAMPLE 2

| MEDIUM SOLIDS ALLPHATIC POLYURETHANE 121 Series | |
|---|---|
| DESCRIPTION | |
| The 121 Series is a medium solids, low temperature cure two component polyurethane for use on metal and plastic. It is used for industrial and automotive applications. This system has excellent chemical, stain, and water soak resistance. It has good adhesion to many substrates with good mar and abrasion resistance and it has 2H hardness. | |
| CHARACTERISTICS | |
| Density - lbs/gal: | 7.92-11.0 |
| Solids, wt. %: | 45-67 |
| Solids, volume: | 37-48 |
| Viscosity: | 45 sec Zahn#2 |
| Flash Point ° F. | 78 |
| Application Method: | HVLP; Conv. |
| Reduction for Application: | 4-base; 1-XL009<br>5-base; 1-XL003 |
| Pot Life: | 2 hrs @ 70° F. |
| Cure Schedule: | 35 min @ 160° F., Air Dry tack free 40 min |
| Gloss 60°: | Flat to 96 |
| VOC as supplied - lbs/gallon: | 3.6-4.3 |
| VOC as applied - lbs/gallon: | 3.37-4.0 |

Both polymer adhesion paints of Examples 1 and 2 are manufactured and distributed by:

PRIME COATINGS
1002 Hickory Street
Pewaukee, Wis. 53072
www.primecoatings.net
Telephone: (262) 691-1930

The polymer adhesion paints may be applied in any manner known in the art including, but not limited to, spraying, dipping, brushing, sponging and any other paint application method. In various embodiments polymer adhesion paint is applied by spraying. Generally, less than 40 mils of paint is applied to the surface intended to be painted. In other embodiments less than 20 mils of paint is applied and in other embodiments less than 10 mils of paint is applied to the surface intended to be painted. In one example, approximately 0.2 to 1.5 mils dry film thickness of base color was applied to the entire surface of a fascia. Once the base paint has been applied, secondary colors may optionally be applied to the wet or dry base coat as desired. Such secondary colors may be applied in similar ways as the base paint, such as spraying, dipping, brushing, sponging and any other spray technique known in the art. It is also noted that a primer layer may be applied to the substrate surface prior to applying the paints described herein. For example, a coating of binel, parylene or another primer coat may be applied to the surface prior to applying the paint to promote optimum adhesion.

Once the paint has been applied to the desired surface of the mass confinement cells, the product is then cured. In various embodiments of the present invention, the product is oven cured following painting at a temperature of 220° F. and less (e.g. 175° F. to 220° F.); in other embodiments 185° F. and less (e.g. 150° F. to 185° F.); and in still other embodiments 160° F. less (e.g. 100° F. to 150° F.). In various embodiments the paint, is cured at the above mentioned temperatures for a period of 2 minutes to 4 hours; in other embodiments 5 minutes to 2 hours and in still other embodiments 10 minutes to 30 minutes. The product is then allowed to air dry. Once air dried, the mass confinement cell is ready for installation. It is noted that the curing process may be performed at room temperatures, but the curing time usually will be lengthened accordingly.

Figure 22A:
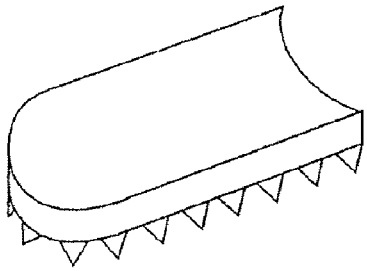
FIG. 22*a* is a perspective top view of one embodiment of an edger that may include the surface coating or lamination of the present invention.
Figure 22B:
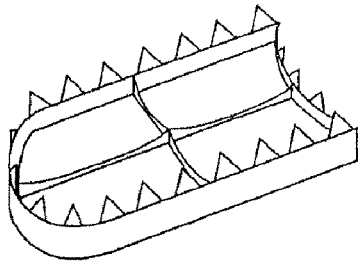
FIG. 22*b* is a perspective bottom view of one embodiment of an edger that may include the surface coating or lamination of the present invention.
Figure 23A:
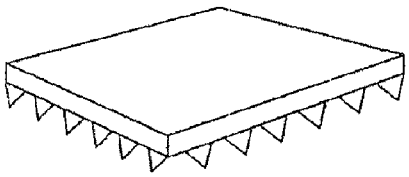
FIG. 23*a* is a perspective top view of one embodiment of a paving stone that may include the surface coating or lamination of the present invention.
Figure 23B:
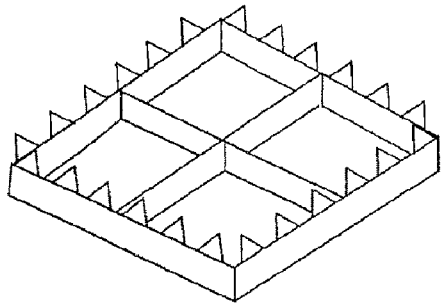
FIG. 23*b* is a perspective bottom view of one embodiment of a paving stone that may include the surface coating or lamination of the present invention.

It is noted that the solid surface coating, polymeric sheet or polymer adhesion paint may be administered or laminated to any landscaping product comprised of a deterioration resistant material (e.g. plastic, fiberglass, etc.), such as landscaping edgers, stepping or patio stones, artificial rocks and boulders, mass confinement cell front panels and fascia and lawn furniture. In such embodiments, the solid surface coating, polymeric sheet or polymer adhesion paint is applied to one or more surfaces of the landscaping products. FIGS. 22*a-b* and 23*a-b* depict two embodiments of the landscaping products that may provide surfaces coated with the solid surface coating, polymeric sheet or thermal paint of the present invention. FIGS. 22*a* and 22*b* depict a top view and bottom view of an edger and FIGS. 23*a* and 23*b* depict a top view and bottom view of a stepping stone. In both of these embodiments, the surface exposed to the outside environment is coated with the solid surface coating or polymeric sheet.

As previously indicated the mass confinement cells 10 of the present invention generally include one or more side panels 16 that engage and extend from the front panel 12 back to engage with a back panel 14. As depicted generally in a number of the FIGS., various embodiments of the present invention include side panels 16 engaging the front panel 12 at angles to provide for a tapering of the confinement cell as it moves back in width. The angle formed between the front panel 12 and side panel 16 is generally less that 90° when the front panel 12 is substantially straight and less than 150° when the front panel 12 is rounded or beveled. In other embodiments, the angle is between about 45° and 85° for substantially straight front panels 12 and between 60° and 110° for beveled and rounded front panels 12. In various embodiments the side panels 16 may extend from the front panel 12 at angles that would allow them to engage each other at the back of the confinement cell, thereby forming the back panel 14 and chamber 18 by their engagement (e.g. a triangle or diamond configuration). Finally, in various embodiments, the top edge of the side panels 16 may slightly slope down from front to back, thereby providing a back end of the confinement cell that is slightly lower than the front of the confinement cell (e.g. 0.5-10 mm).

Furthermore, the side panels 16 may further include one or more grid fasteners (not shown), wherein geogrid can thread over and secure when utilized between rows of confinement cells 10. In other embodiments, the grid fastener may include an overhanging portion (not shown) that the grid can slide under, thereby inhibiting vertical movement of the grid once in position. The side panels 16 may further include lightening apertures (not shown). Such apertures allow for reduction of resin and thereby make the product more light-weight and cost efficient.

Figure 24:
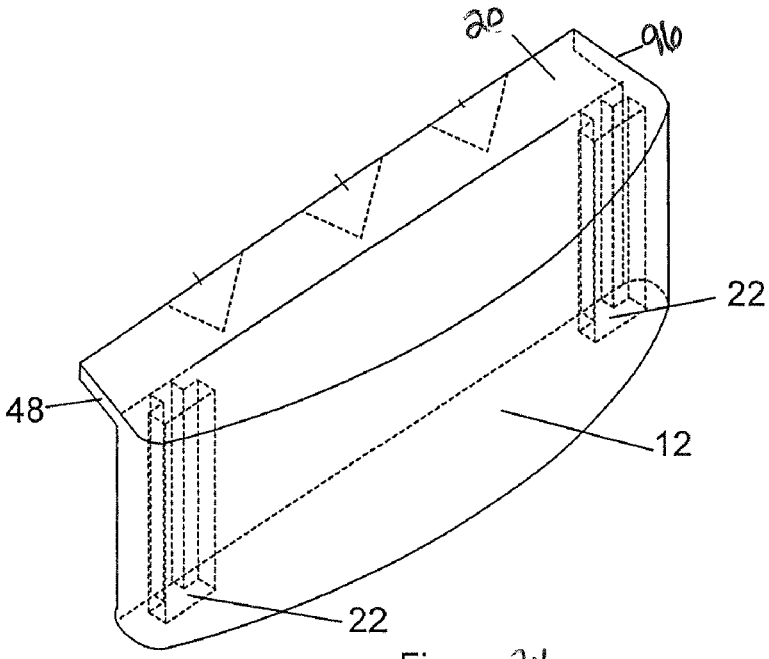
FIG. 24 is a perspective view of one embodiment of a front panel including a partial top panel.

In various embodiments of the present invention, the mass confinement cell 10 further includes a partial top panel that extends from the front panel 12 or fascia 68 that is exposed when a retaining wall is constructed. The partial top panel assists to close or partially close the top front portion of the confinement cell 10 that may be exposed to the outer environment. In various embodiments, the mass confinement cells 10 include a partial top panel that extends from the front panel 12 or fascia 68 back to no more than 75% of the depth of the confinement cell 10. It is noted that cell depth is measured from the front panel 12 or fascia 68 to the back panel 16 of the confinement cell 10. In other embodiments of the present invention, such a partial top panel extends from the front panel 12 or fascia 68 no more than 50% of the depth of the confinement cell. In yet other embodiments the partial top panel extends from the front panel 12 or fascia 68 no more than 35% of the depth of the confinement cell (e.g. 5% to 30%). Such a partial top panel provides for at least a partial sealing of the confinement cell at the top front portion, of which may be exposed when the retaining wall is constructed in a configuration wherein the wall inclines back toward the surface or slope intended to be protected. FIG. 24 depicts one embodiment of the present invention wherein the front panel includes one embodiment of a front panel 12 with a partial top panel 20. It is noted that in various embodiments the top panel may further include one or more planting apertures 94 (e.g. see FIG. 25) that may allow plant growth from the top surface of the confinement cell 10. As previously suggested, the open top and bottom of each mass confinement cell 10 allows for the receiving and commingling of fill material that may flow from and through the confinement cell 10 to one or more adjacent cells 10 below or above.

The partial top panel may further include optional top side panels 96 that extend downward from the partial top panel and may extend over or within the side panels of the confinement cell (not shown). Also, various embodiments, as depicted in FIG. 26 may also include more than two securing mechanisms 22 positioned at various positions in the front panel 12. This is advantageous if partial cells are required. For example, the confinement cell 10 may be cut and a peg of the side panel 16 may be secured into the additional socket of the securing mechanism of the front panel to secure the front panel 12 to the rest of the confinement cell 10. By providing additional securing mechanisms 22, the cutting of the front panel 12 still allows for the remaining portion of the front panel 12 to have two outer securing mechanisms 22 for securing a side panel 16 to the cut front panel 12. Partial confinement cells 10 may further include one or more shorter stabilizing partitions to assist in securing the two halves of the cell together and further stabilizing the confinement cell 10 after cutting.

Figure 25:
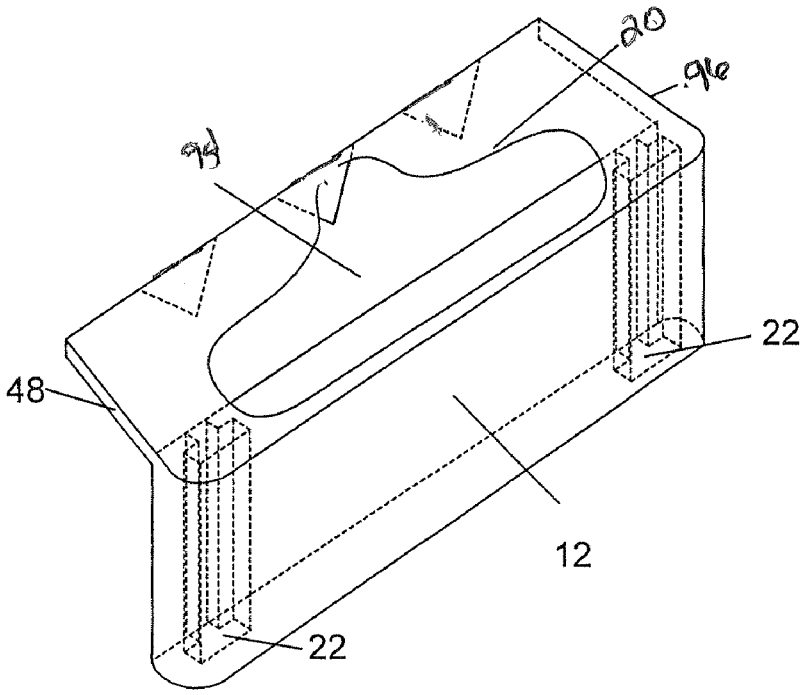
FIG. 25 is a perspective view of one embodiment of a front panel including a partial top panel having a planting aperture.

It is noted that in some embodiments, the partial top panel 20, as depicted in FIGS. 24-26 may extend back from the top edge of the front panel 12 to the top edge of a partition 40. Therefore, an example of such an embodiment would provide for a partial top panel 20 extending from the front panel 12 to the partition 40 on the mass confinement cell of FIG. 10. In some embodiments, ribbing or inner stability ridges (not shown) may be positioned between the front panel 12 and partition 40 to provide additional stability to the structure.

Also, in various embodiments, two or more of the panels may be adjoined to other panels of the cell with living hinges. Living hinges generally comprise a thin flexible plastic (e.g. HDPE, polypropylene) that can bend into position without breaking when the panels are formed into an assembly position to form the chamber.

Figure 29:
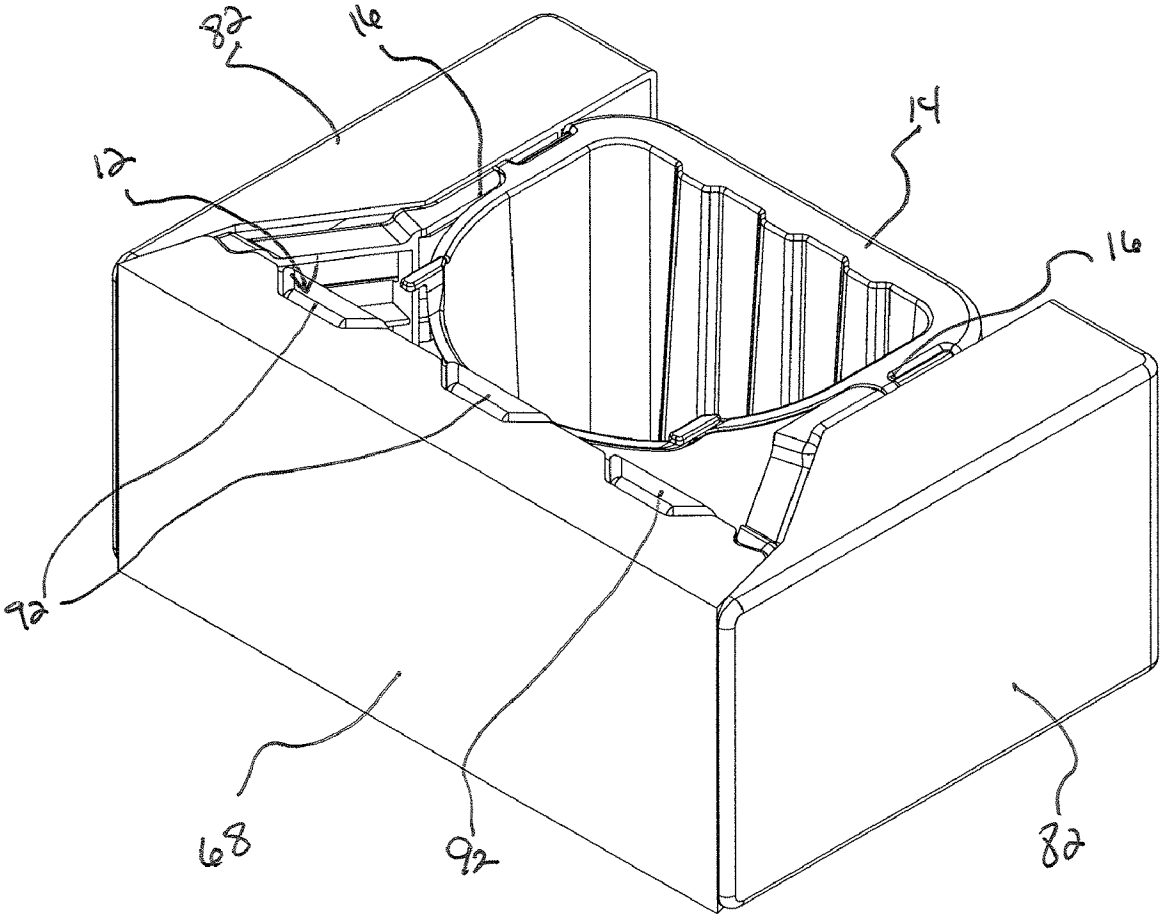
FIG. 29 is a front perspective view of one embodiment of a deterioration resistant mass confinement cell of the present invention that includes a frame, load cell, fascia and end caps.
Figure 30A:
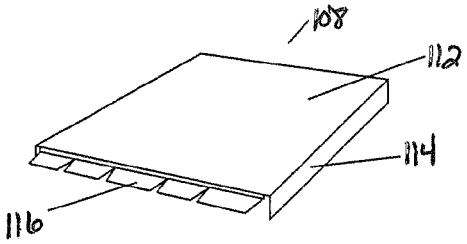
FIGS. 30*a-b* are perspective views of two top cover embodiments used to cap a deterioration resistant mass confinement cell.
Figure 30B:
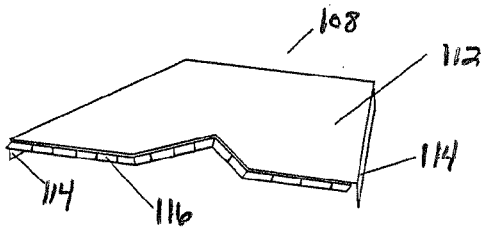

It is further noted that the mass confinement cell embodiments may further include a load cell 98 positioned within the front panel 12, side panels 16 and optionally a back panel 14. A further description of load cell embodiments is described below. Such load cells positioned in and/or attached to the confinement cell 10 may be added to provide additional structural support to the cell. FIG. 27 depicts one embodiment of a load cell 98 that may be secured to the confinement cell 10 by one or more load cell fasteners 100. Generally, the load cell 98 is a cylinder that when attached to the confinement cell 10 forms and/or resides within the continuous chamber 18. In this application a cylinder may comprise a cylinder that includes a circular or elliptical structure and may also include a structure that has one or more substantially straight sides and one or more rounded sides. In the embodiment of FIG. 29 the load cell 98 includes a substantially straight back panel 14 integrally adjoined to a rounded front section 102. The back panel 14 may further include ribs 30 that may be position on the front and/or back of the back panel 14 to provide additional stability. The load cell 98 may further include an anchoring ridge 104 or aperture (not shown) that may be utilized to accept the anchoring devices for confinement cell 10 positioning and overturn prevention or reduction.

The load cell fasteners 100 may be any fastening device or material that securely adjoins the load cell 98 to the confinement cell 10. In one embodiment, as depicted in FIG. 29 the load cell fastener 100 is one or more projections that extend inward from the outer edge of the anchoring ridge 104. In operation, the load cell 100 is inserted into one or more apertures in the confinement cell 10 so that the load cell fastener 100 engages with a load cell aperture (not shown) or ridge on the side panels 16.

The load cell may further include one or more grid fasteners 106 for securing and positioning geogrid when it is utilized in a wall structure. The grid fastener 106 is configured to be inserted in an aperture of the geogrid and positioned over the geogrid at connection so that the grid does not move in a vertical direction once it is applied.

In some embodiments of the confinement cells 10 of the present invention, a plurality of load cells 98 may be adjoined together and secured to the larger frame of the cell to reduce the flow forces of the fill materials in the larger walls. The load cells of the multi-load cell embodiments may be adjoined with tabs that may be separated to curve the wall when desired. Furthermore, the multi-cell embodiments of the present invention may be utilized to install large sections of wall with few components and still provide the appearance of a multitude of individual cells.

Additionally, in other embodiments, the load cell may be split vertically in two or more sections, wherein one section nests with the other section. The two nested sections allows for the compression of the sections together to make a smaller load cell that may be utilized when secured to a cut confinement cell for partial confinement cells. In such embodiments, the two sections would further include a fastening device to fixedly secure the two sections together when the proper size is achieved, thereby preventing movement of the two sections of the load cell.

Figure 28A:
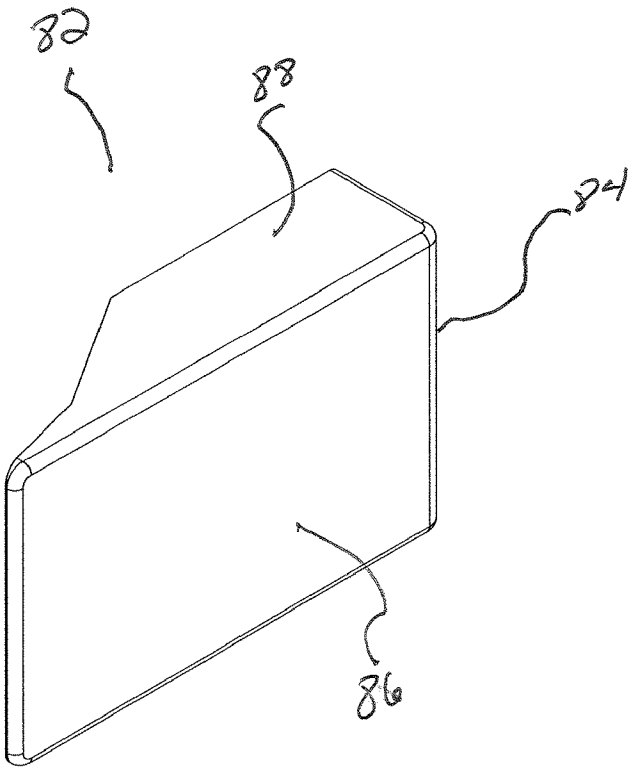
FIG. 28*a* is a front view of one embodiment of an end cap that may be utilized with the deterioration resistant cells of the present invention.
Figure 28B:
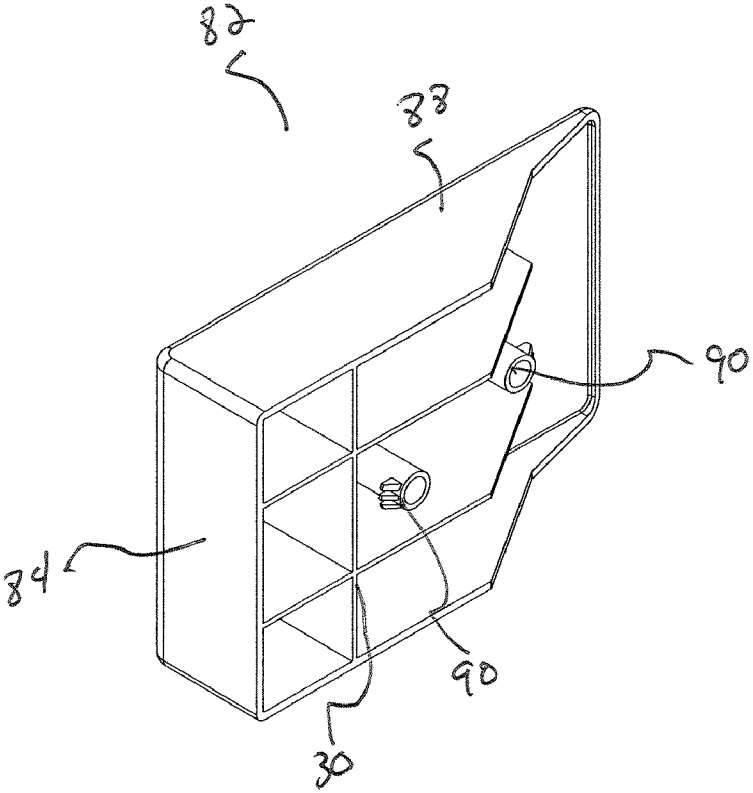
FIG. 28*b* is a back view of one embodiment of an end cap that may be utilized with the deterioration resistant cells of the present invention.

The mass confinement cell 10 of the various embodiments of the present invention may further be fitted with an end cap 82 to finish the end of a wall, provide an end finish for a sharp turn (e.g. 90° turn) in the wall or to accommodate a partial confinement cell when a confinement cell must be cut for fitting. A front and back view of one embodiment of an end cap 82 is depicted in FIGS. 28*a* and 28*b*. In most embodiments, the end cap 82 will include a back surface 84 and side surface 86 that is textured and colored similar to the front panel 12 or fascia 68 of the mass confinement cell 10. Additionally, the top surface 88 of the endcap 82 may include a texture and color similar to the front panel 12 or fascia 68 of the mass confinement cell 10. In one embodiment, as depicted in FIG. 28*b*, the end cap 82 includes one or more securing pegs 90 that may be inserted into lightening apertures (not shown) or other attachment points positioned in the side panels 16 of a confinement cell 10. The end cap 82 may also include ribs 30 to provide stability to the structure. FIG. 29 depicts one embodiment of a fully assembled mass confinement cell 10 that includes end caps 82. The embodiment of FIG. 29 includes a front panel 12 having load bearing members 92, back panel 14, side panels 16, fascia 68 and two endcaps 82.

FIGS. 30*a-b* and 31*a-b* depict various embodiments of top covers 108 and bottom covers 110, which are configured and adapted to securely fit over or under embodiments of the mass confinement cell 10 of the present invention. Generally, in some embodiments, the top covers 108 and bottom covers 110 utilized in constructing some of the retaining walls of the present invention are at the very top of the wall and very bottom of the wall to at least partially seal the continuous chamber channels. However, the use of such covers 108, 110 at intermediate locations through the wall may also be performed. In various embodiments of the present invention, the top cover 108 generally includes a continuous top panel 112 that includes optional overlapping edges 114, which overlap securely over the outside side and back panels 14, 16. In some embodiments of the invention, the overlapping edges 114 may be present around the entire perimeter of the top of the confinement cell 10. Alternately, a forward extending apron 116 may be positioned at the front of the top cover 108 and utilized to secure the cover 108 to the adjacent confinement cell 10 below by inserting the apron 116 under the partial top panel of the cell 10 below.

Figure 31A:
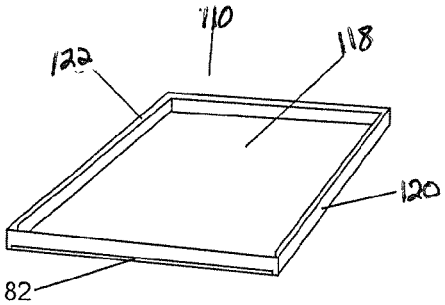
FIGS. 31*a-b* are perspective views of two bottom cover embodiment used to seal a deterioration resistant mass confinement cell.
Figure 31B:
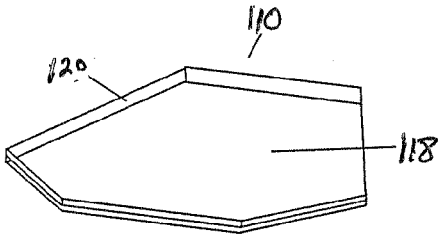

Embodiments of the bottom covers 110 of the present invention, as depicted in FIGS. 31*a-b*, may include a bottom panel 118 with attached bottom side walls 120 extending around the perimeter of bottom of the cell. The side walls 120 may be configured to overlap the front, back and side panels 12, 14, 16 or configured to nest within the front, back and side panels 12, 14 and 16. In other embodiments, as depicted in FIG. 31*a*, the overlapping sides may include an optional channel 122 for receiving and retaining the front, side and back panels 12, 14, and 16 of the adjacent confinement cell 10 above. Alternatively, the top covers 108 and/or bottom covers 110 may include only a top panel 112 or bottom panel 118 that nest and optionally secure into place just within the front panel 12, back panel 14 and side panels 14 of the confinement cell 10. Additionally, the top cover 108 may include one or more planting apertures (not shown) for allowing the growth of vegetation from the mass confinement cell.

Figure 32:
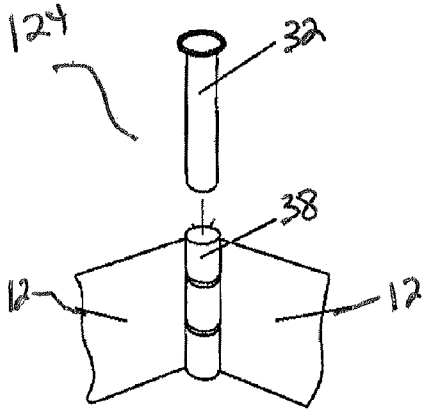
FIG. 32 depicts an exploded perspective view of an embodiment of an interlocking mechanism used with the deterioration resistant mass confinement cell that includes pegs and hinges.
Figure 33:
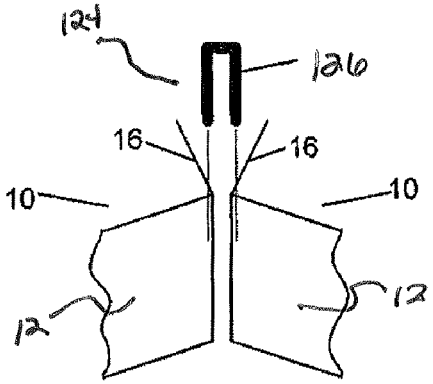
FIG. 33 depicts a perspective view of an embodiment of an interlocking mechanism use with the deterioration resistant mass confinement cell of the present invention that is a clipping device.
Figure 34:
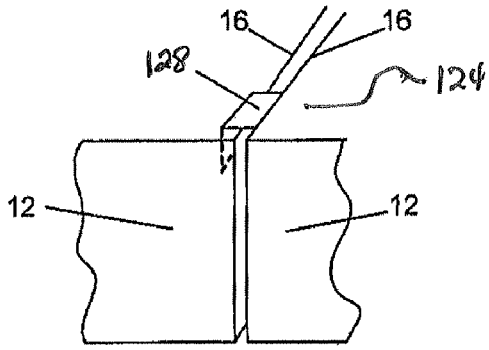
FIG. 34 depicts a perspective view of an embodiment of an interlocking mechanism use with the deterioration resistant mass confinement cell of the present invention of the present invention that is an integral hook.

FIGS. 32-34 depict other embodiments of the present invention wherein the mass confinement cells 10 include an interconnecting device 124. It is noted that in the mass confinement cell 10 embodiments, the interconnecting device 124 may be a securing mechanism as described above or a variation thereof. In various embodiments, as depicted in FIG. 32 the interconnecting device 124 includes a peg and socket system having one or more insertable pegs 32 to adjoin two or more confinement cells by inserting the pegs 32 into a socket 38. The sockets 38 are generally positioned on an edge or just inside the edge of the front, side and/or back panels 12, 16, 14. The sockets may be integral to the front or back panels 12, 14 or may be secured to the panels 12, 16, 14 in any manner known in the art. The pegs 32 are configured to be securely receivable by the sockets and may be configured to swivel the confinement cell 10. The insertable pegs 32 can be made of any shape and size, which can be securely fit into the sockets.

Alternatively, in one embodiment of the present invention side by side adjacent confinement cells 10 may be adjoined with a clipping device 126. In one embodiment the clipping device 126 may be configured in a U shape and sized to snuggly fit over the side panels 16 of two adjacent confinement cells. An illustration of one embodiment of a clipping device is depicted in FIG. 33.

FIGS. 34 depicts an additional embodiment of the present invention, similar to hook attachments, wherein the mass confinement cell 10 includes an interlocking feature that comprises a hook or peg 128. An optional pocket (not shown) may also be placed in the confinement cell 10 for receiving the hook 128 from adjacent confinement cells 10. In such an embodiment one or more hooks or pegs 128 extend from one side panel 16 of a mass confinement cell 10 and may be inserted over the opposite side panel 16 of an adjacent cell 10. Such interlocking mechanisms provides for a overall secure retaining wall structure by reducing the amount of movement that may occur during filling with unsecured individual cells.

Figure 35:
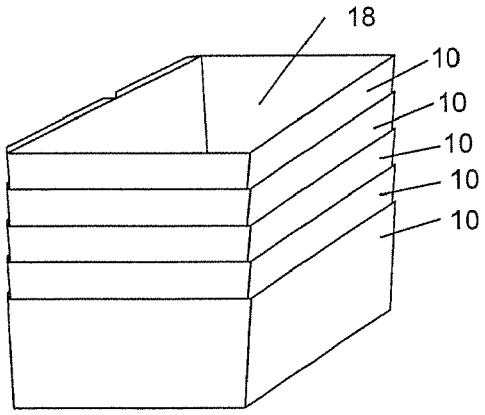
FIG. 35 depicts a perspective view of a plurality of deterioration resistant mass confinement cells in nesting positions.
Figure 36:
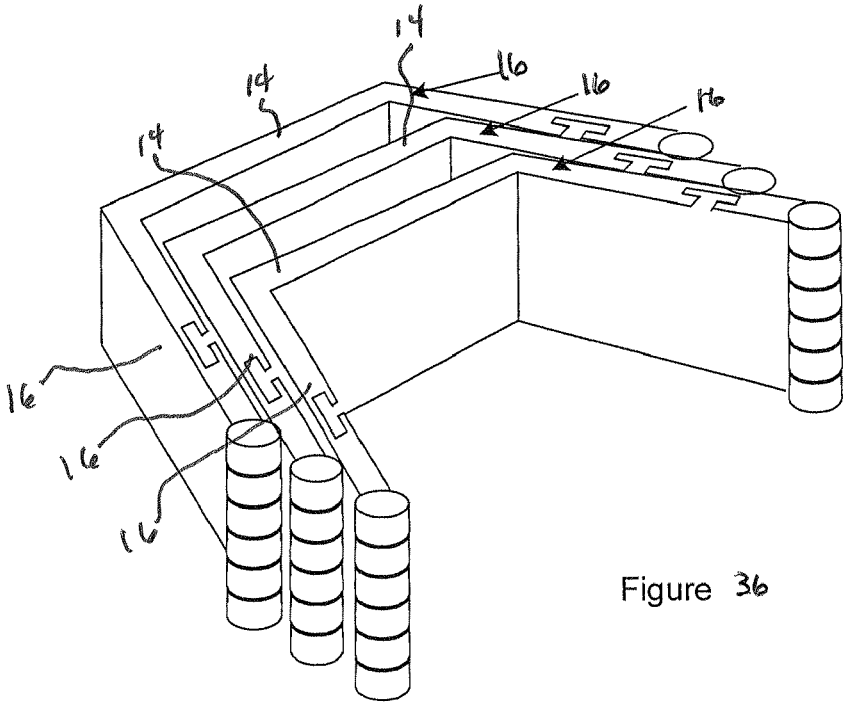
FIG. 36 depicts a perspective view of a plurality of nestable deterioration resistant mass confinement cells without the front panel in nesting positions.
Figure 37:
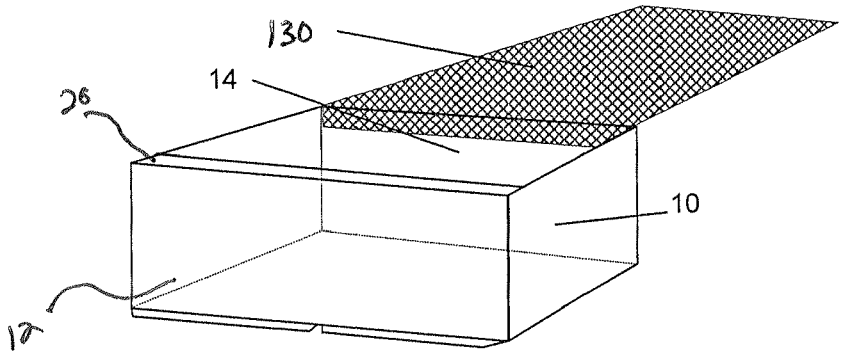

Another advantage of certain embodiments of the mass confinement cells of the present invention is that they also allow for easy storage and transport due to the stackable capabilities present. For example, mass confinement cell are easily transported and stored by nesting the cells within each other or by separating the front panel 12, back panels 14 and/or side panels 16 and stacking and/or nesting the respective panels when in transport or storage. FIG. FIG. 35 depicts a plurality of cell that are nested and FIG. 36 depicts a plurality of partial mass confinement cells 10 that do not include an attached front panel positioned in a nested position. Other nesting positions or stacked positions may also be utilized with various embodiments of the present invention.

Figure 37:
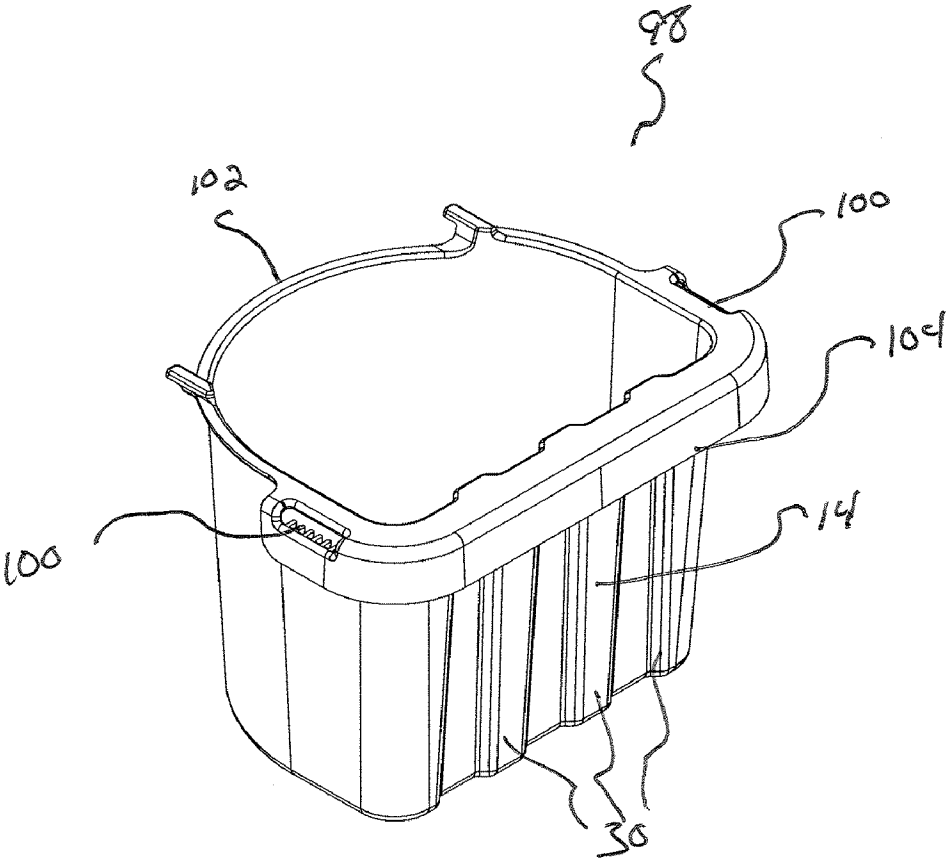
FIG. 37 depicts a perspective view of an embodiment of a deterioration resistant mass confinement cell including a structural stabilization grid.

The mass confinement cell 10 of the present invention may also be utilized with other wall stabilizing products to secure and stabilize a structure constructed of such cells 10. For example, FIG. 37 depicts an embodiment of a mass confinement cell 10 wherein a structural grid 130 is attached to confinement cell 10 (e.g. attachment to the upper front panel 12, back panel 14, partial top panel 20, or bottom panel (not shown) or peg extensions 48 on the back panel 14 or partition 40. The grid 130 is buried behind the wall constructed of the confinement cells of the present invention and acts to support and stabilize the aggregate placed behind the wall and prevent the wall from moving forward away from the embankment it is protecting.

In an alternative embodiment, the mass confinement cell 10 may be utilized with and/or secured to a cellular confinement system or block confinement system (e.g. A commercially available system is the Geo-web® plastic web soil confinement system or the Geo-block® system, sold by Presto Products, Incorporated, P.O. Box 2399, Appleton, Wis. 54913) thereby providing a retaining wall front to an erosion control structure. Suitable cell confinement systems are well known in the art and are generally disclosed in U.S. Pat. No. 6,296,924, issued on Oct. 2, 1001, U.S. Pat. No. 5,927,506, issued on Jul. 27, 1999, U.S. Pat. No. 5,449,543, issued on Sep. 12, 1995 and U.S. Pat. No. 4,778,309, issued on Oct. 18, 1988, the entire contents of which are incorporated by reference herein.

In various embodiments of the present invention, a plurality of confinement cells 10, and/or multiunit confinement cells or partial components of the cells 10 may be positioned upon a base of block confinement systems, such as Geo-block®, and/or operably secured to one or more cell confinement systems, such as Geo-web®. The intermingling of the confinement cells 10 of the present invention with the cell or block confinement systems provides further stability to a retaining wall structure, as well as allows for the construction of an aesthetically pleasing wall.

Figure 38:
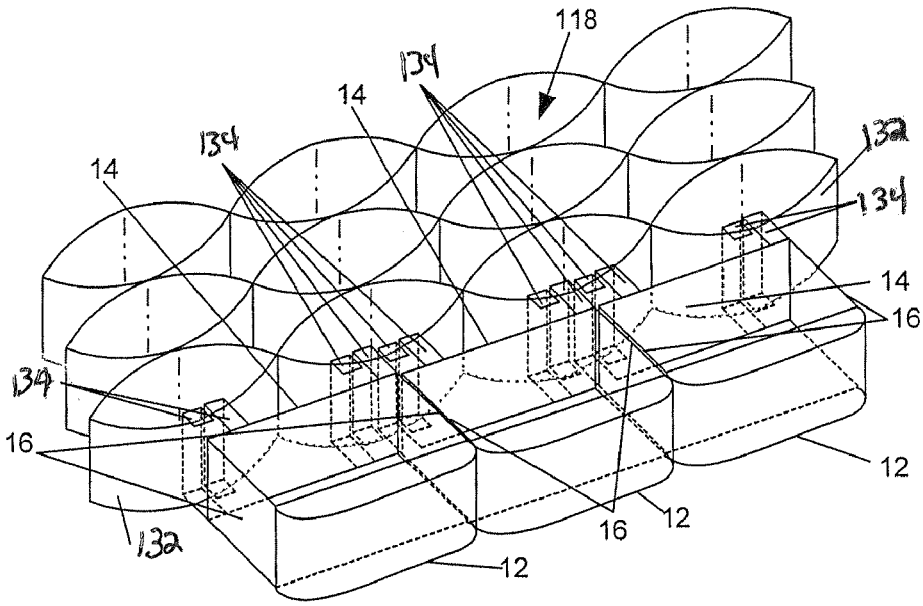
FIG. 38 depicts a perspective view of an embodiment of a plurality of deterioration resistant mass confinement cells adjoined to a cellular confinement system.

FIG. 38 depicts one embodiment of the present invention wherein a plurality of partial confinement cells including a front panel 12 adjoined to two side panels are positioned adjacent to and adjoined to a cell confinement system 132 with a cell confinement fastener 134. The front panel 12 may further include a partial top panel 20. In various embodiments the front panel may be adjoined directly to the cellular confinement system (not shown). In the embodiment depicted in FIG. 38, the front panel 12 and side panels 16 are positioned in front of one or more cells of the front cellular wall of a cell confinement system 132 and secured. If side panels are present the side panels may be secured to one or more cells of the cellular confinement system. The securing of the front panel 12 and/or side panels to the front cellular confinement system 132 may form a chamber that may be filled with one or more fill materials.

In various embodiments, the cell confinement fastener 134 may be any form that extends from one or more panels 12, 14, 16 and over, under or through the front of the cellular confinement system 132 to thereby hold the panel(s) 12, 14, 16 in position. For example, in one embodiment, as depicted in FIGS. 38, the front panel 12, side panels 16 or back panel 14 may be secured to the cell confinement system 132 by one or more U-type clips that extend from the front panel 12, side panels 16 or back panel 14 between two layers of cell confinement systems 132 and up, down and/or through a cell of a cell confinement system 132 to secure the confinement cell 10 to the cell confinement system 132. In other embodiments, pegs may be used to secure the partial cells 10 to the cell confinement system 118 by inserting a peg into threads that extend from the cell 10 and over the front face of the front of the cellular confinement system 132. Other examples of cell confinement fasteners 134 may include any securing mechanism, such as tabs, hooks, clips, cables, rods and the like.

Figure 39:
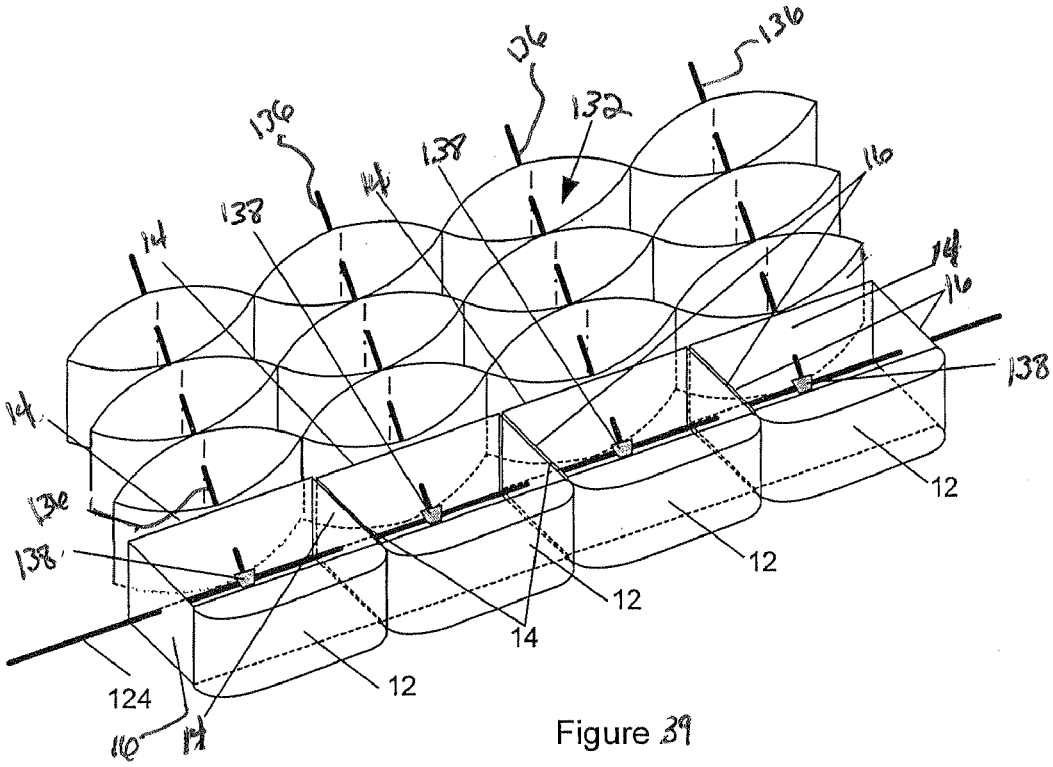
FIG. 39 depicts a perspective view of an embodiment of a plurality of deterioration resistant mass confinement cells adjoined to a cellular confinement system with a plurality of reinforcing members.

Another cell confinement fastener 134 may further include one or more reinforcing members 136, such as cables, tendons and/or bars. Examples of such reinforcing members are disclosed in U.S. Pat. Nos. 5,449,543 and 5,927,906, the entire contents and description of which are incorporated by reference herein. In such embodiments, as depicted in FIG. 39 the reinforcing members 124 may be tendons that extend through the cellular confinement system 132 to secure the confinement cells 10. The reinforcing members 136, such as tendons, may also be extended through the side walls 16 of the confinement cells 10 to secure adjacent cells 10 to each other. In such embodiments, reinforcing members 136 that extend through the side walls 16 of the cells 10 may be intersected and adjoined to tendons that extend through the cellular confinement systems 132. Such intersection and adjoinment may be secured with fasteners 138 such as clips, wire or the fasteners disclosed in U.S. Pat. Nos. 5,449,543 and 5,927,906. The cells 10 and cellular confinement systems 132 may also be further secured and reinforced with fasteners and securing rods as described in U.S. Pat. Nos. 5,449,543 and 5,927,906.

As previously mentioned, the mass confinement cells of the present invention may be manufactured from a deterioration resistant, substantially rigid composite or polymeric material including, but not limited to, plastic (e.g. recycled or virgin), thermoset, a rubber composition, fiberglass, or any other similar material or a combination thereof. Preferable materials comprise light-weight and slightly flexible polymers, such as high and low density polyethylene or polypropylene or thermosets, such as the polyester bulk molding compound produced by BMC, Inc. However, other plastics and thermosets may also be used. Examples of other plastics include, but are not limited to polypropylene, acrylonitrile-butadiene-styrene (ABS), Polyethylene terephthalate (PET), polycarbonate, poly(butylene terephthalate) (PBT), poly(cyclohexanedimethylene terephthalate) (PCT), styrene-acrylonitrile copolymers (SAN), polyesters, polystyrene, polyvinyl chloride (PVC), polyurethane, copolymers including one or more of the previously mentioned polymers and combinations thereof. It is also noted that the deterioration polymeric materials may also be utilized with filler materials or recycled filler materials, such as titanium, carbon fibers, nylon, talc, glass, saw dust or paper byproducts, plastic and the like. Generally, the embodiments of the present invention may comprise any type of material that would have the similar characteristics to plastic, vinyl, silicone, fiberglass, rubber or a combination of these materials. It is noted that the material utilized in the present invention should be rigid enough to hold its form upon addition of filling material and also when placed in contact with other objects. Also the panels of the mass confinement cells should be substantially non-collapsible when in a filled and stacked state. Another material that may be utilized to form the components of the present invention may be comprised of a material similar to that utilized in the production of some types of garbage cans or the utilization of recycled rubber from objects such as tires. Such materials would be capable of holding rigidity and still offer flexibility when placed in contact with other objects, such as ice. Also, such materials have the ability to regain its original form when the object or material has been removed.

Embodiments of the present invention may also vary in appearance. Since embodiments of the present invention may be manufactured by a process such as injection molding, structural foam molding (e.g. low pressure multi-nozzle structural foam), extrusion, thermo-forming, compression molding, roto-molding and the like, the molds may include any type of design or shape. Furthermore, the front panels of the mass confinement cell 10, could be molded in almost any type of configuration. In one embodiment, multiple mass confinement cells 10 could be molded to include designs that, when positioned on a retaining wall, would complete a larger single design, such as the spelling of a company or school name in large letters or the completion of a large image. Also, since the present invention may be manufactured from and/or include a number of different products, such as plastic, a rubber composition or fiberglass, and may include any color or a multitude of colors. For example, a retaining wall installed in a beach setting may be manufactured of a plastic or rubber product and be colored in so that organic matter wash up on it would not show up as readily or may take on the appearance of sand.

Additionally, in various embodiments of the present invention, one or more lighting devices may be incorporated into the mass confinement cells of the present invention. For example, lighting devices (e.g. Light Emitting Diodes (LEDs), halogen lights, fluorescent lights, incandescent lights) may be attached to the frame, pass through the frame or attached to the front or back surface of the fascia. Such lighting devices, when lit, will illuminate the front panel of the frame and/or the fascia. Any power source may be utilized to power the lighting devices. Examples of power sources that may be utilized with the mass confinement cells of the present invention include, but are not limited to, batteries, conventional electrical circuits and wiring, solar, wind or any other source that would provide the requisite power to light the lighting device. In some embodiments, solar panel lighting fixtures are affixed or pass through the front panel of the frame, thereby positioning such lighting fixtures between the frame and fascia. In other embodiments one or more lighting devices may be position on the perimeter of the front panel and fascia to thereby illuminate the front surface of the mass confinement cell.

As previously suggested the environment resistant mass confinement cell is utilized in the construction of any type of wall, border or revetment. In application, the confinement cells 10 are provided in a desired and assembled form. For various embodiments of the confinement cells 10 some assembly may be required, such as inserting the T-hooks or pegs into the T-slots or sockets or attaching the load cell 98 and fascia 68 to a front, back and/or side panels 12, 14, 16. Next, a foundation is prepared in the area that the wall, border or revetment is to be constructed. The foundation preferably is flat, compacted and level and can accommodate one or more mass confinement cells 10 and optionally one or more cellular confinement systems. In various embodiments, one or more courses of confinement cells 10 may be partially submerged or totally submerged below the earth surface to provide wall stability. Once a foundation is completed, a first row is laid by positioning the confinement cells 10 and optionally the cellular confinement systems in their proper position side by side and filling each individual confinement cell 10 with a fill material while back filling behind the row or filling the cellular confinement systems positioned behind the cells 10 until the row is completed. A fill material compacting device may be utilized while or after filling to ensure stability of the fill material as the wall is constructed. For example, a packing device may be utilized to pack the fill material after filling each row of confinement cells 10 and/or cellular confinement system. The chamber 18 is normally filled with materials such as sand, crushed rock, pea rock, gravel, dirt, cement, concrete or other beneficial materials to provide weight and structure stability to the mass confinement cell 10 and the entire retaining wall. The filling of the mass confinement cell 10 gives it the added weight that it needs to retain its structure and hold it in place. A funneling device (not shown) may be utilized, which fits securely into the openings or apertures of the mass confinement cell 10 to guide fill into the chamber 18 of the cell 10. The first row and subsequent rows may be straight or curved. Upon completion of the first row, additional rows are constructed by placing the mass confinement cells 10 and optionally the cellular confinement system 132, in the proper position and performing the same filling and back filling process until a continuous chamber retaining wall is completed. It is noted that with the continuous chamber system of the present invention, multiple rows can be secured in place before filling and/or packing. However, it is recommended that filling and packing be done regularly (e.g. row by row) to ensure proper packing of the fill material.

Figure 40A:
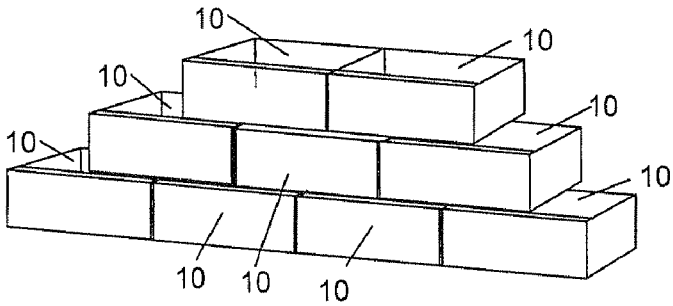
FIG. 40*a-b* depict front perspective views of two retaining walls constructed with embodiments of the mass confinement cells of the present invention.
Figure 40B:
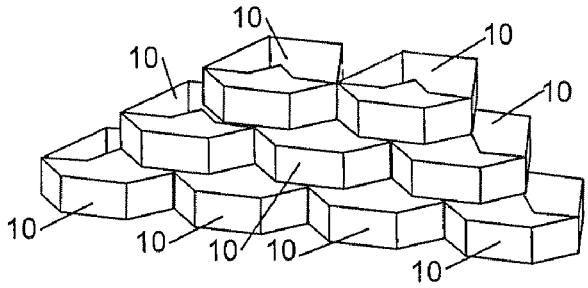
Figure 46:
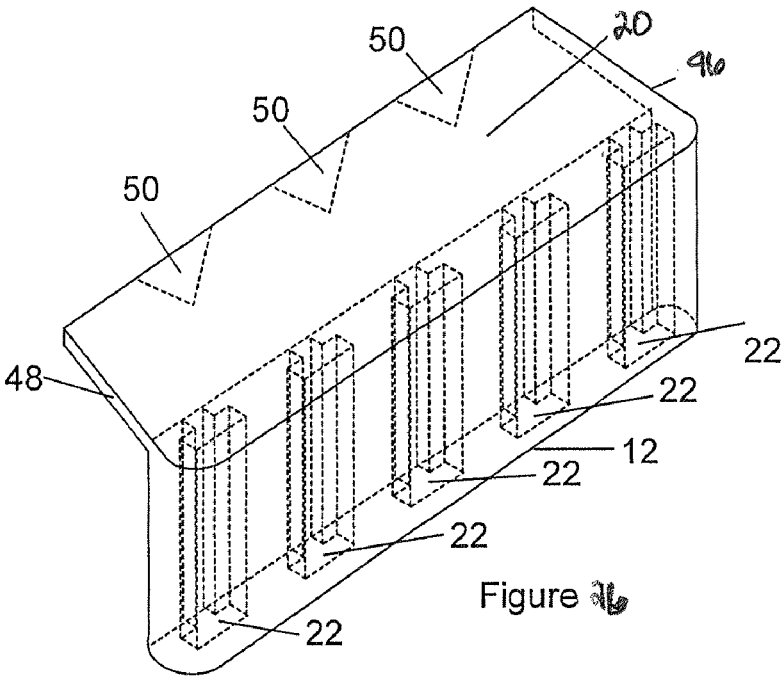

Generally, a continuous chamber system retaining wall includes stacked rows wherein individual confinement cells 10 are placed adjacent to one another thereby eliminating or minimizing cracks or gaps in the wall. Rows of mass confinement cells 10 may be positioned directly over other rows of mass confinement cells 10 wherein the cells 10 of each row are positioned directly over other cells 10. However, many embodiments of the present invention provide a constructed wall wherein the mass confinement cells 10 are staggered in alternating rows as depicted in FIGS. 40*a-b*. It is also noted, that the constructed wall may further be secured to the slope and the aggregate behind the wall can be further stabilized by positioning geogrid between rows of mass confinement cells 10. Such action may be performed between each row or alternated every 2-15 rows, and optionally every 3-10 rows.

Each mass confinement cell 10 placed in the retaining wall is configured to retain and seal the contents of the fill material back towards the slope when the wall has been properly constructed. This may be further accomplished by applying top covers 108 and/or bottom covers 110 that at least partially seal the continuous chamber system. Alternatively, vegetation may be planted on the top row of the retaining wall to assist in sealing in the contents.

Furthermore, in various embodiments, the mass confinement cells 10 of the upper rows may be further positioned into place by an overlap of the back of confinement cells 10 of lower rows if a retaining flange or peg extensions 48 are included on the confinement cell 10. In the alternative or additionally, each individual confinement cell 10 may be locked into position with adjacent cells 10 if spools or reinforcing members and apertures, clipping devices 126 or hooks 128 are present with the confinement cell 10.

Figure 41:
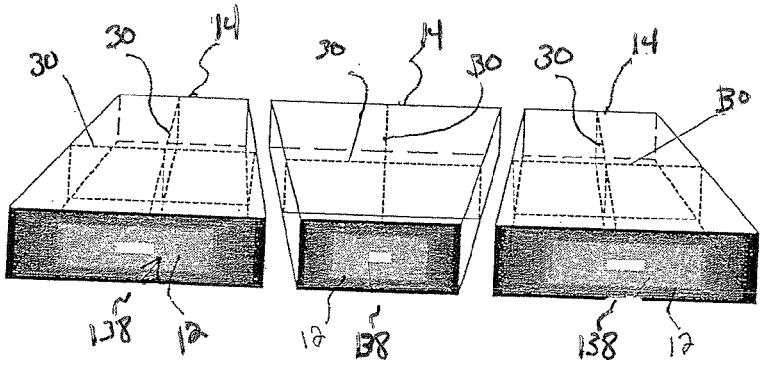
FIG. 41 depicts a front perspective view of one embodiment of a cell cap that may be utilized with various embodiments of the present invention.

As previously mentioned, upon completion of the top row of the retaining wall, a cover, aesthetic top border or cell cap 138 may be placed on or over the top row to close and seal the continuous chamber system or to provide an aesthetic finishing border to the top of the retaining wall or earth retention system. One embodiment of a cell cap 138, as depicted in FIG. 41, may be polygonal in shape and include textured and designed faces on both the front panels 12, back panels 14 and top of the cell cap 138. The cell caps 138 may further include pegs (not shown), similar to those depicted in the previous confinement cell embodiments, that may be utilized to secure the cell cap 138 to the mass confinement cells 10 positioned below. Alternatively, the cell caps 138 may be secured to the mass confinement cells 10 below by any means known in the art, such as clips, tacks, screws, rivets, adhesives or the like. The cell caps 138 may be filled with a fill material, similar to the other embodiments of the present invention, or may be a thinner cap 138 that includes a plurality of reinforcing partitions or ribs 30.

Figure 42:
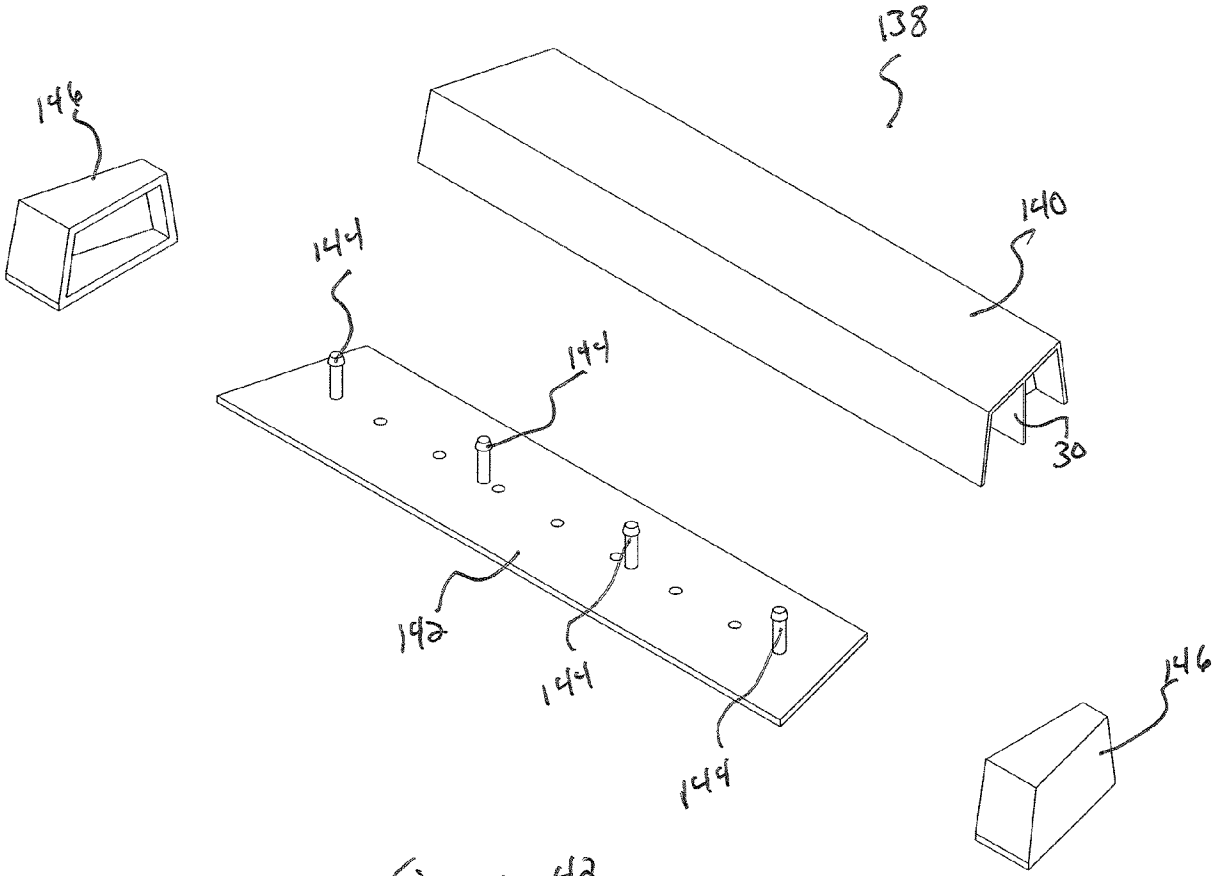
FIG. 42 depicts an exploded view of one embodiment of a cell cap that may be utilized with various embodiments of the present invention.

FIG. 42 depicts another embodiment of a cell cap 138 that may be utilized with the mass confinement cell systems of the present invention. The cell cap 138 of the this embodiment is intended to wholly or partially cover the continuous flow chambers 18 of the confinement cells 10 positioned below when finishing the top course of a retaining wall or edges of a revetment. The cell cap 138 of this embodiment may extend a distance from the front edge, or slightly overhanging the front edge of the mass confinement cell 10 back over the top of the top course of confinement cells 10. In various embodiments, the cell cap 138 may extend back a distance of approximately between 5% to 110% of the confinement cell 10. In various embodiments, this distance may translate to approximately 5 cm to 125 cm.

Figure 43A:
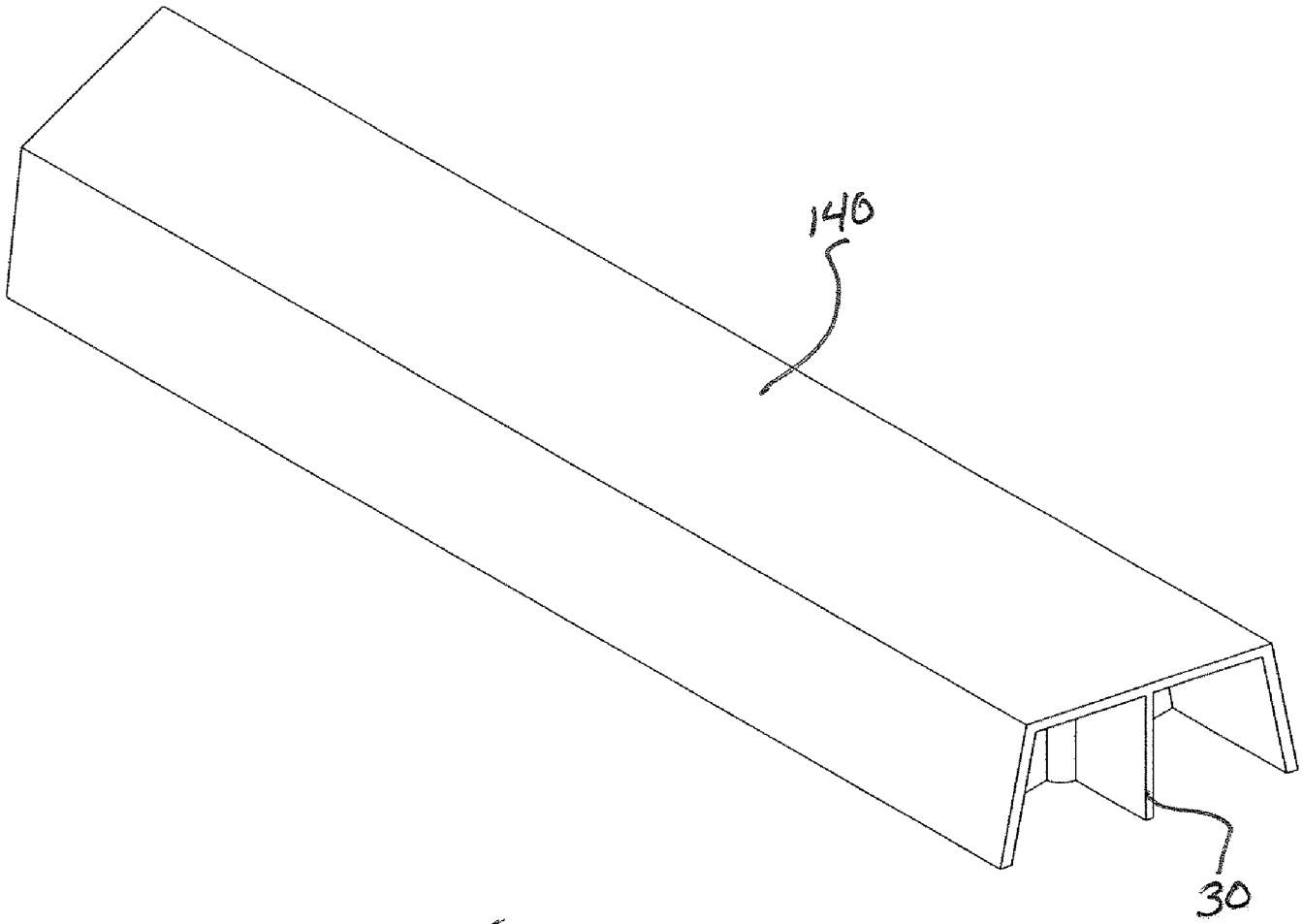
FIG. 43*a* is a perspective view of one top cap embodiment of the cell cap of FIG. 42.
Figure 43B:
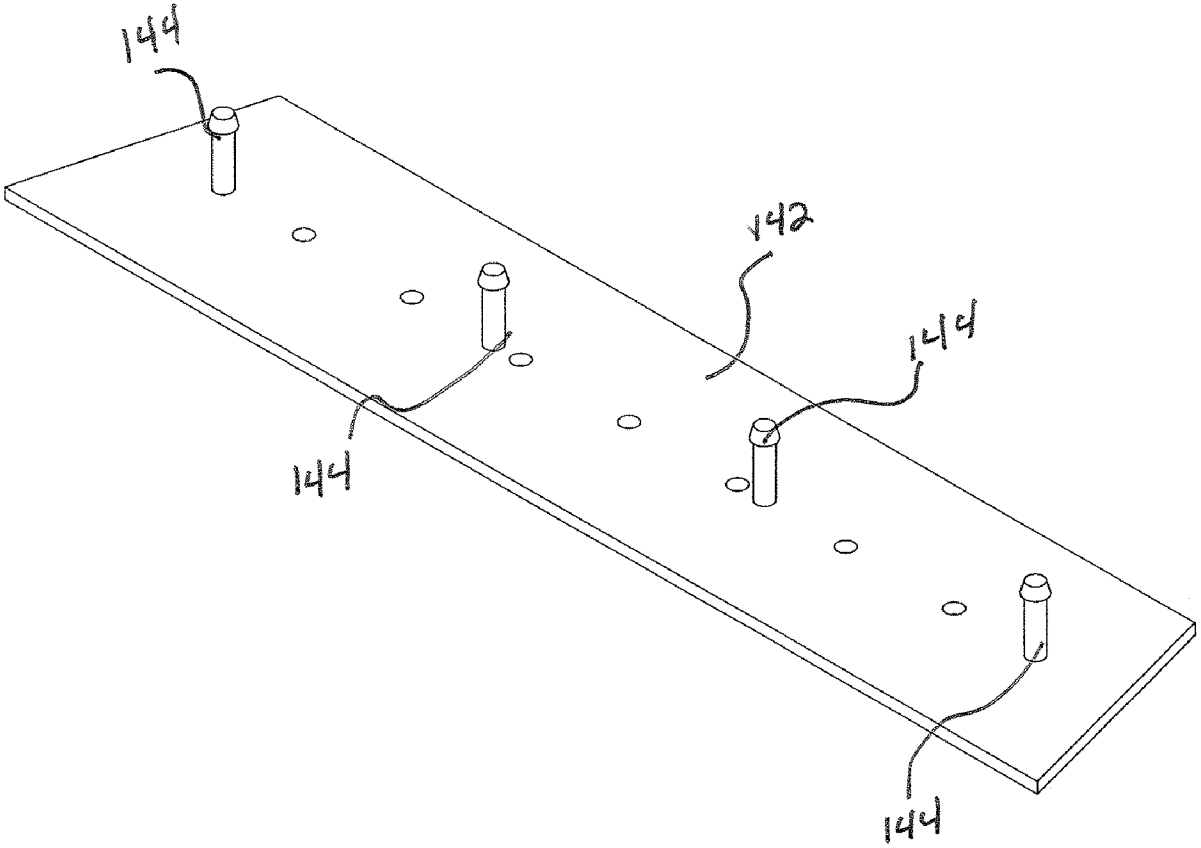
FIG. 43*b* is a perspective view of one top cover embodiment of the cell cap of FIG. 42.
Figure 43C:
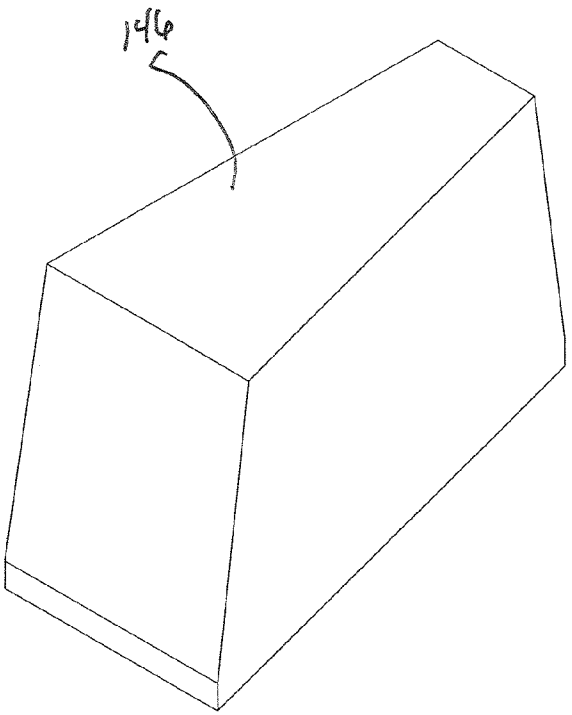
FIG. 43*c* is a back perspective view of an end cap embodiment of the cell cap of FIG. 42.
Figure 43D:
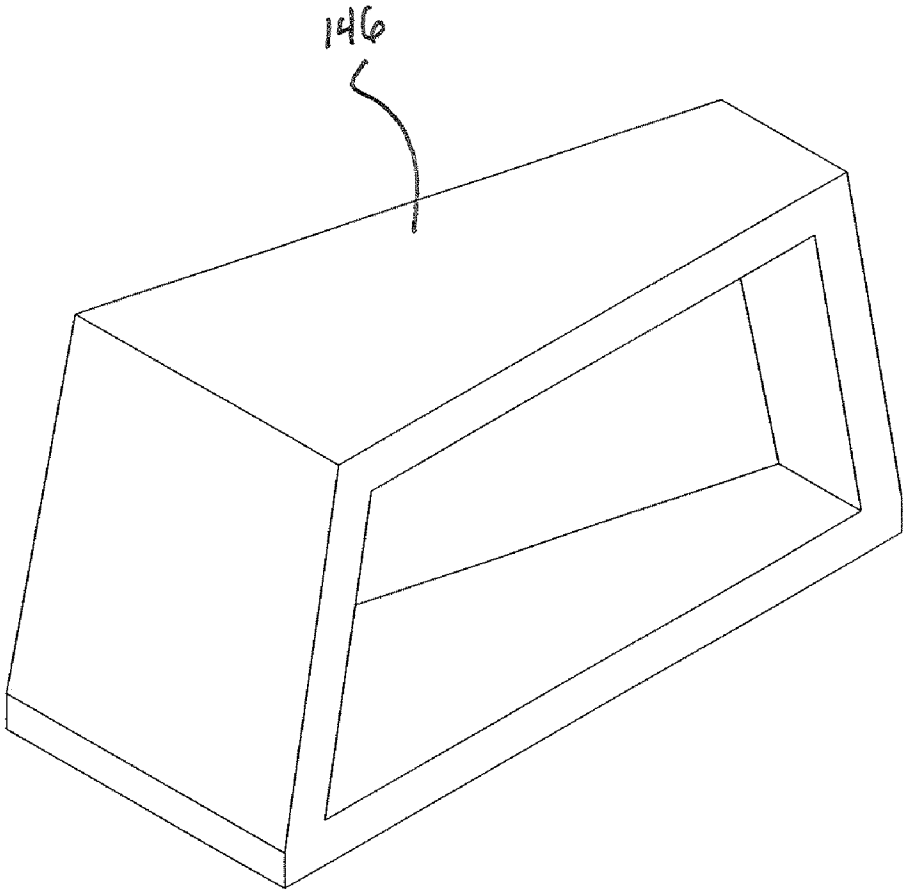
FIG. 43*d* is a front perspective view of an end cap embodiment of the cell cap of FIG. 42.

The cell cap 138 of this embodiment depicted in FIG. 42 generally includes a top cap 140, as depicted in FIG. 43*a*, that is engageable with a confinement cell cover 142, as depicted in FIG. 43*b*. The cell cover 142 generally engages the confinement cell 10 positioned below and thereby is intended to lock the cell cap 138 into position on the wall or revetment. The cell cover 142 can engage the mass confinement cell 10 positioned below utilizing one or more cover fasteners 144 that may engage the confinement cell at any applicable surface (e.g. the front panel, side panels, partitions). The cover fasteners 144 may be any type of fastening device, such as pegs, rivets, screws, adhesives, hooks, snaps, tabs and any other means that will secure the cell cap 138 to the cell confinement cells 10. The top cap 140 of this embodiment engages the cell cover 142 by any means to adequately secure the top cap 140 to the cell cover 142. For example, snaps, pegs, tabs, adhesives and any other means to fasten and secure the top cap may be utilized. Additionally, the top cap 140 may further include one or more ribs 30 to provide additional structural support to the top cap 140. The cell cap 138 may further include one or more end caps 146 that may be secured to the ends of the cell cap 138 to close the outer edges. See FIGS. 43*c-d* for a front and back view of the endcap 146.

Figure 44:
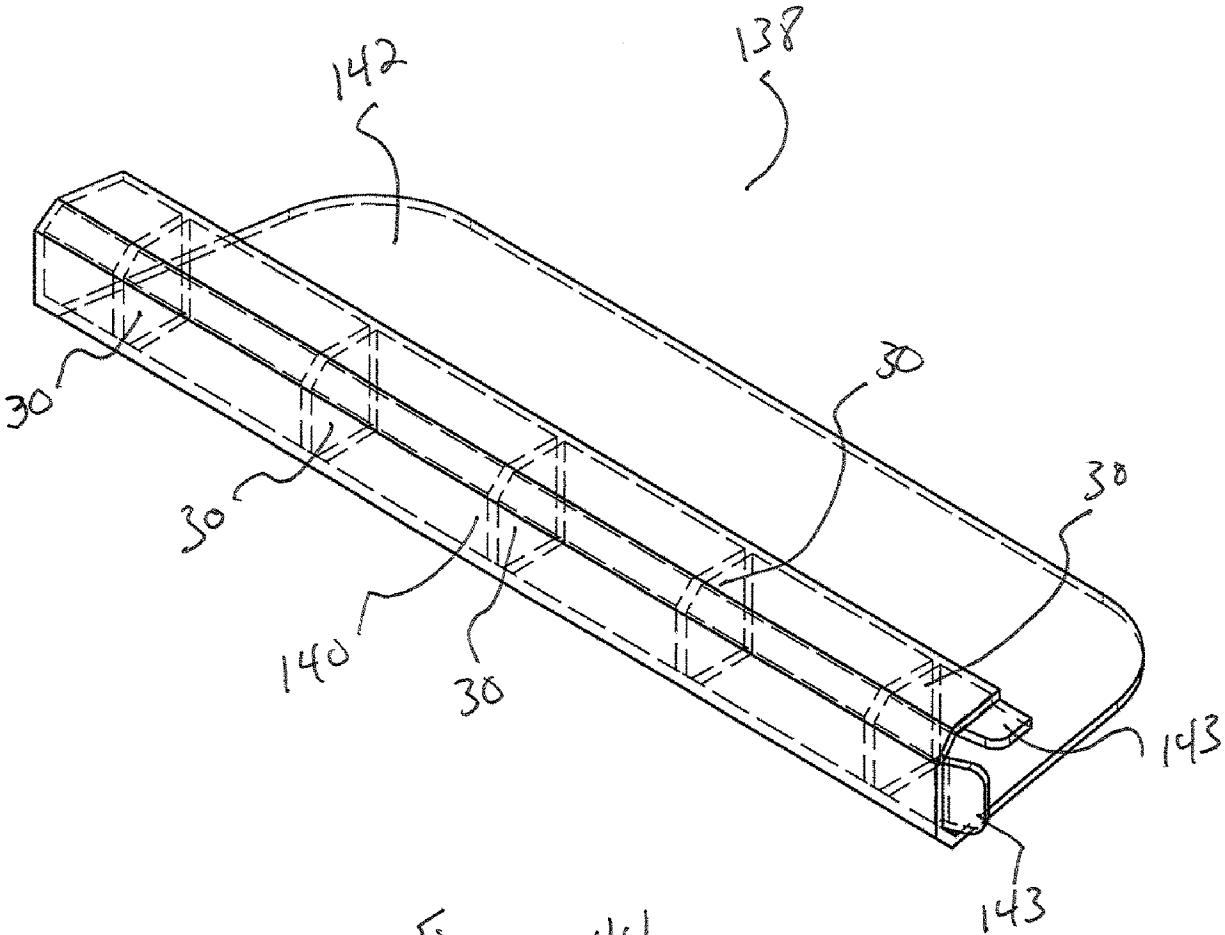
FIG. 44 depicts a perspective view of one embodiment of a cell cap that may be utilized with various embodiments of the present invention.

FIG. 44 depicts another embodiment of a cell cap 138 that may be utilized with the mass confinement cells 10 of the present invention. The cell cap 138 of this embodiment generally includes a top cap 140 adjoined to a cell cover 142. The top cap 140 may be integrally adjoined to the cell cover 142 or may be a separate component attachable to the cell cover 142. The top cap 138 may further include a plurality of ribs 30 to provide additional stability and structure. Similar to the previous embodiment, the cell cover 142 can engage the mass confinement cell 10 positioned below utilizing one or more cover fasteners (not shown) that may engage the confinement cell at any applicable surface (e.g. the front panel, side panels, partitions). The cover fasteners may be any type of fastening device, such as pegs, rivets, screws, adhesives, hooks, snaps, tabs and any other means that will secure the cell cap 138 to the cell confinement cells 10. Additionally, the cell cap 138 of various embodiments may further include one or more extension flaps 143 that bridge the gaps between adjacent cell caps 138. The extension flaps 143 may be stationary and integrally attached or may be moveable to retract or extend, thereby providing less or more length to each flap 143. In various embodiments, the extension flaps may be placed on a track that allows for the extension or retraction of the flaps 143.

Figure 45:
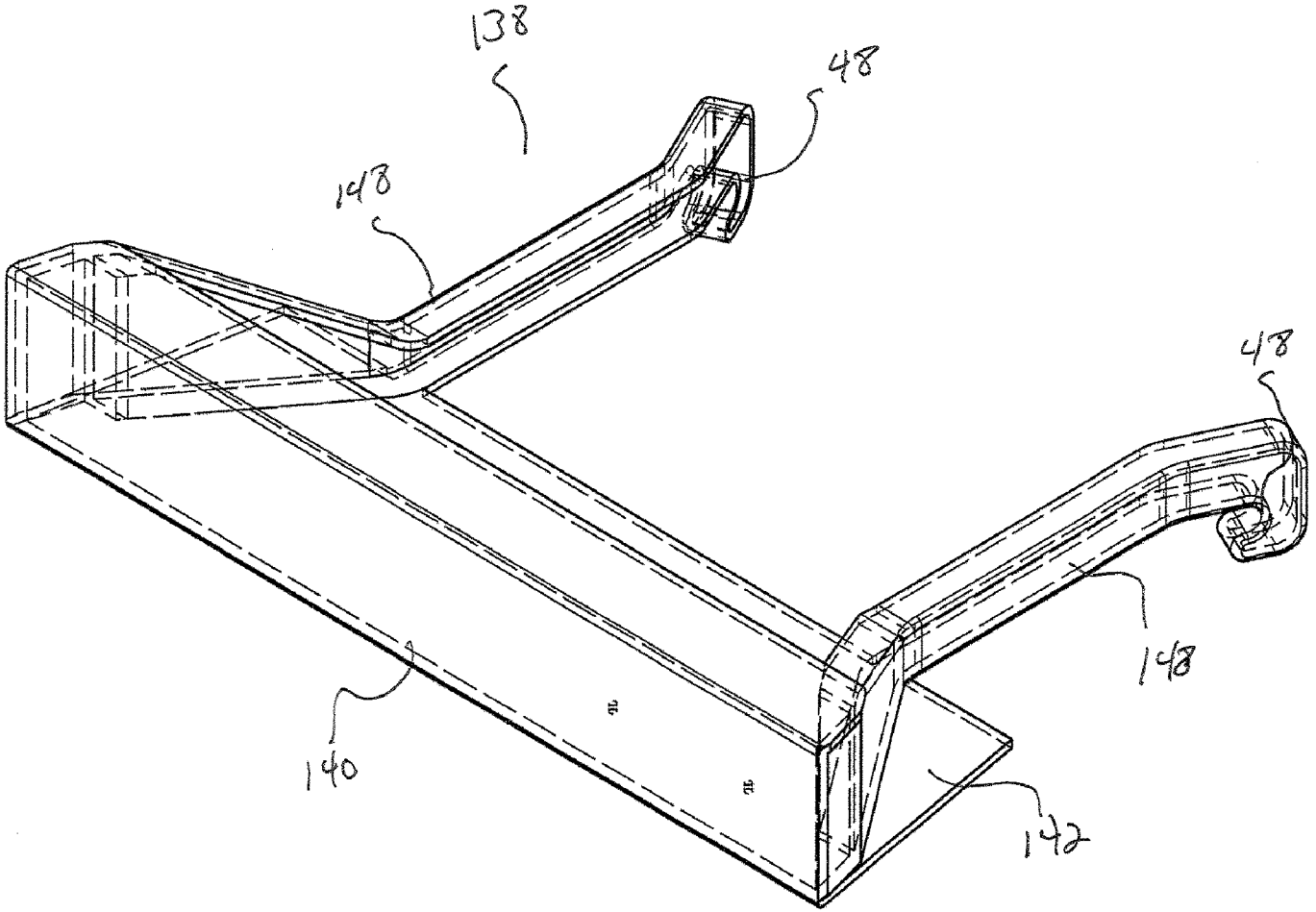
FIG. 45 depicts a perspective view of one embodiment of a cell cap including locking peg extensions that may be utilized with various embodiments of the present invention.

FIG. 45 depicts yet another embodiment of a cell cap 138 that may be utilized with the mass confinement cells 10 of the present invention. The cell cap 138 of this embodiment generally includes a top cap 140 adjoined to a cell cover 142 and one or more anchoring devices. The anchoring devices in this embodiment may include one or more arms 148 that are operably adjoined to one or more peg extensions 48. The peg extensions 48 may further be locking peg extensions that are configured to secure under an anchoring ridge or slot positioned in the back panel or load cell of the mass confinement cells 10 positioned below. Additionally, the arms 148 may be integrally adjoined to the top cap 140 or adjoined with living hinges 150 and securing snaps, which would allow for the cell cap 138 to be transported and/or stored in a flat or nested configuration. Similar to the previous embodiments, the cell cover 142 can engage the mass confinement cell 10 positioned below utilizing one or more cover fasteners (not shown) that may engage the confinement cell at any applicable surface (e.g. the front panel, side panels, partitions). The cover fasteners may be any type of fastening device, such as pegs, rivets, screws, adhesives, hooks, snaps, tabs and any other means that will secure the cell cap 138 to the cell confinement cells 10.

The top cap 140 of many embodiments will include the texture and color of all the surfaces intended to be exposed on the front panel 12 or fascia 68 of the cell confinement systems 10 to provide a natural earthen appearance and/or design. The top cap 140 may further include a plurality of ribs 28 to stabilize the top cap 142 and prevent crushing or damaging. The top cap 142 and top cover 142 in a number of embodiments may be polygonal in shape, thereby allowing for a continuous cell cap 138 alignment over the length of a wall or revetment. The polygonal shape also allows for a continuous coverage when curving a wall structure.

Embodiments of the present invention may also be used in conjunction with regular dry cement process blocks, bricks or stones, such as those produced by Keystone®, Anchor® Wall Systems or Allan Block®. A retaining wall constructed in water or along a waterfront property may utilize the mass confinement cells of the present invention at water level and below and then the conventional retaining wall materials can be used on top of the mass confinement cells of the present invention. The utilization of the mass confinement cells of the present invention would allow ease in matching colors with the conventional retaining wall building materials because the materials utilized to manufacture the present invention can be colored and designed to match virtually any type of retaining wall construction material.

Finally, the mass confinement cells may be manufactured in a multitude of different sizes, shapes and configurations. For example, an embankment or steep shoreline could support a retaining wall configured in a step like arrangement or design. Such a structure may be utilized as a retaining wall and/or a stairway down to a beach or to the water.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

What is claimed is:

1. A mass confinement cell comprising:

a front panel including one or more deterioration resistant composite or polymeric materials and having a front surface including a molded and/or fabricated natural appearance that is produced by imaging a natural surface selected from the group consisting of stone, rock, wood and brick, and applying one or more laminates, surface coatings or paints to the molded and/or fabricated front surface;

a back panel including one or more deterioration resistant composite or polymeric materials;

one or more side panels including one or more deterioration resistant composite or polymeric materials that are operably adjoined to one or both of the front panel and back panel to form a chamber, the side panels extending back from the front panel of the cell at an angle of less than 90° ;

one or more load cell positioned at least partially within the front panel and side panels; and an open top surface including no top panel or a partial top panel extending from a front edge of the front panel back a length no more than 75% of the width of the cell.

2. The mass confinement cell of claim 1, wherein the mass confinement cell further includes one or more securing mechanisms.

3. The mass confinement cell of claim 1 wherein the cell further includes one or more fill materials placed into the chamber of the mass confinement cell.

4. The mass confinement cell of claim 1 wherein the composite or polymeric materials are selected from the group consisting of polyethylene, polyethylene, polyurethane, Acrylonitrile-butadiene-styrene (ABS), Polyethylene terephthalate (PET), polycarbonate, Poly(butylene terephthalate) (PBT), Poly(cyclohexanedimethylene terephthalate) (PCT), styrene-acrylonitrile copolymers (SAN), polystyrene and combinations thereof.

5. The mass confinement cell of claim 4, wherein the composite or polymeric material includes one or more filler materials, colors and/or additives.

6. The mass confinement cell of claim 1 wherein the molded or fabricated front surface is molded or fabricated in the front panel.

7. The mass confinement cell of claim 1 wherein the front panel includes a fascia having a molded or fabricated front surface.

8. The mass confinement cell of claim 1, wherein the cell further includes one or more anchoring devices selected from a group consisting of a retaining flange, peg extensions and securing pins.

9. The mass confinement cell of claim 1, wherein the back panel and side panels are integrally adjoined.

10. The mass confinement cell of claim 1, wherein the front panel and side panels are integrally adjoined.

11. The mass confinement cell of claim 1, wherein the fill materials are selected from a group consisting of sand, gravel, dirt, crushed rock, pea rock and concrete.

12. The mass confinement cell of claim 1, wherein the confinement cell includes one or more partitions.

13. The mass confinement cell of claim 1, wherein the back panel is included in the load cell.

14. A method of building a deterioration resistant retaining wall comprising;

a) placing a plurality of the mass confinement cells comprising a front panel including one or more deterioration resistant composite or polymeric materials and having a front surface including a molded and/or fabricated natural appearance that is produced by imaging a natural surface selected from the group consisting of stone, rock, wood and brick, and applying one or more laminates, surface coatings or paints to the molded and/or fabricated front surface, a back panel including one or more deterioration resistant composite or polymeric materials, one or more side panels including one or more deterioration resistant composite or polymeric materials that are operably adjoined to one or both of the front panel and back panel to form a chamber and an open top surface including a partial top panel extending from a front edge of the front panel back a length no more than 75% of the width of the cell in a row;

b) filling the chamber of each cell in the row with one or more fill materials;

c) positioning a second row of mass confinement cells above the first row of mass confinement cells;

d) filling the second row of mass confinement cells with a fill material; and e) continuing the previously described steps until the desired number of rows is achieved.

15. A deterioration resistant retaining wall comprising a plurality of mass confinement cells comprising:

a front panel or fascia including a deterioration resistant composite or polymeric material and having a molded or fabricated front surface to form an earthen appearance that is produced by imaging a natural surface selected from the group consisting of stone, rock, wood and brick, and applying one or more laminates, surface coatings or paints to the molded and/or fabricated front surface;

a back panel including a deterioration resistant composite or polymeric material;

one or more load cells; and one or more side panels including a deterioration resistant composite or polymeric material that are operably adjoined to one or both of the front panel and back panel to form a chamber.

16. The deterioration resistant retaining wall of claim 15, wherein the mass confinement cell includes one or more securing mechanisms selected from the group consisting of integral peg and socket systems, peg and socket systems, T-hook and T-slot systems, panel slot systems and snap systems.

17. The deterioration resistant retaining wall of claim 15 wherein the cell further includes one or more fill materials placed into the chamber of the mass confinement cell.

18. The deterioration resistant retaining wall of claim 15 wherein the composite or polymeric material is selected from the group consisting of polyethylene, polypropylene, polyurethane, Acrylonitrile-butadiene-styrene (ABS), Polyethylene terephthalate (PET), polycarbonate, Poly(butylene terephthalate) (PBT), Poly(cyclohexanedimethylene terephthalate) (PCT), styrene-acrylonitrile copolymers (SAN), polystyrene and combinations thereof.

19. The deterioration resistant retaining wall of claim 15, wherein the composite or polymeric material includes one or more filler materials, colors, additives and combinations thereof.

20. The mass deterioration resistant retaining wall 15, wherein the cell further includes one or more anchoring devices selected from a group consisting of a retaining flange, peg extensions and securing pins.

21. The deterioration resistant retaining wall of claim 15, wherein the back panel and side panels are integrally adjoined.

22. A mass confinement cell comprising:

a front panel including one or more deterioration resistant composite or polymeric materials and having a front surface including a molded and/or fabricated natural appearance that is produced by imaging a natural surface selected from the group consisting of stone, rock, wood and brick, and applying one or more laminates, surface coatings or paints to the molded and/or fabricated front surface;

a back panel including one or more deterioration resistant composite or polymeric materials;

one or more side panels including one or more deterioration resistant composite or polymeric materials that are operably adjoined to one or both of the front panel and back panel to form a chamber, the side panels extending back from the front panel of the cell at an angle of less than 90° ; and an open top surface including a partial top panel, partial bottom panel or partial top and bottom panels, each top and/or bottom panel extending from a front edge of the front panel back a length no more than 75% of the width of the cell.

23. The mass confinement cell of claim 22 further including one or more fill materials placed into the chamber of the confinement cell.

24. The mass confinement cell of claim 22 wherein the cell includes one or more setting extensions.

25. The mass confinement cell of claim 22 wherein the fascia includes a molded or fabricated earthen appearance and/or aesthetic design.

26. The mass confinement cell of claim 22, wherein the cell further includes one or more partitions.

27. The mass confinement cell of claim 22, further including a load cell.

* * * * *